US005346047A

United States Patent [19]

Ishida et al.

[11] Patent Number: 5,346,047

[45] Date of Patent: Sep. 13, 1994

[54] COIN PROCESSING APPARATUS

[75] Inventors: Takeshi Ishida, Sakado; Kenji Koyama, Kawagoe; Hiroshi Kasama, Tsurugashima; Kenji Nishiumi, Sakado; Kenji Nakajima, Ogose, all of Japan

[73] Assignee: Kabushiki Kaisha Nippon Conlux, Japan

[21] Appl. No.: 67,733

[22] Filed: May 26, 1993

Related U.S. Application Data

[63] Continuation of Ser. No. 761,411, Sep. 17, 1991, abandoned.

[30] Foreign Application Priority Data

| | | | |
|---|---|---|---|
| Sep. 20, 1990 | [JP] | Japan | 2-250684 |
| Nov. 20, 1990 | [JP] | Japan | 2-314561 |
| Nov. 20, 1990 | [JP] | Japan | 2-314562 |
| Nov. 20, 1990 | [JP] | Japan | 2-314563 |
| Nov. 20, 1990 | [JP] | Japan | 2-314564 |
| Nov. 22, 1990 | [JP] | Japan | 2-319464 |

[51] Int. Cl.[5] ..... G07D 3/14; G07F 9/02

[52] U.S. Cl. ..... 194/200; 194/317; 194/351; 453/3; 453/17

[58] Field of Search ..... 194/206, 207, 203, 217, 194/317, 318, 346, 347, 348, 343, 351, 200; 453/2, 3, 4, 20, 21, 16, 17, 56

[56] References Cited

U.S. PATENT DOCUMENTS

| | | | |
|---|---|---|---|
| 2,463,161 | 3/1949 | Du Grenier et al. | 194/346 |
| 3,106,924 | 10/1963 | Peacock et al. | 453/16 |
| 3,242,932 | 3/1966 | Becker | 453/3 |
| 3,347,249 | 10/1967 | Becker . | |
| 3,426,879 | 2/1969 | Walker | 194/207 |
| 3,667,485 | 6/1972 | Sesko . | |
| 3,741,362 | 6/1973 | Shah | 194/346 |
| 3,768,616 | 10/1973 | Dykehouse et al. | 194/206 |
| 3,783,989 | 1/1974 | Jensen | 194/351 X |
| 3,939,954 | 2/1976 | Collins . | |
| 4,056,181 | 11/1977 | Ikeguchi et al. . | |

(List continued on next page.)

FOREIGN PATENT DOCUMENTS

| | | | |
|---|---|---|---|
| 2055134 | 5/1972 | Fed. Rep. of Germany | 194/334 |
| 2742317 | 3/1979 | Fed. Rep. of Germany . | |

(List continued on next page.)

OTHER PUBLICATIONS

L. Lamport, "Latex: A Document Preparation System," Addison-Wesley Publ. Co., Inc., 1985.

F. Hayer-Roth, et al., "Building Expert Systems," Addison-Wesley Publ. Co., Inc., 1983.

Fuji Xerox, "Presentation & Documentation," compiled by Fuji Xerox, 1989.

Tanaka, et al., "A Study on Evaluation Scales for Document Design Quality," reported in Proceedings of the 42nd General Meeting of the Information Processing Society of Japan, 1991.

*Primary Examiner*—F. J. Bartuska

*Attorney, Agent, or Firm*—Welsh & Katz, Ltd.

[57] ABSTRACT

The type of denomination of a coin inserted through a coin slot is discriminated by a coin discriminating section while the coin is being conveyed substantially horizontally by a mechanism for horizontally conveying coins, and the discriminated coin is distributed by coin distributing levers for selectively executing a first distributing operation for distributing coins to a relevant coin accumulating section and a second distributing operation for introducing the coins to an ensuing coin distributing section. As for the coin distributing levers, all the coin distributing levers leading to the coin distributing section corresponding to the discriminated type of denomination are set in a state in which the first distributing operation is prohibited, and subsequently the coin distributing section corresponding to the discriminated type of denomination is caused to effect the first distributing operation, and as the coin to be distributed passes through the coin distributing levers, the state in which the first distributing operation of the coin distributing sections leading to the coin distributing section corresponding to the discriminated type of denomination is prohibited is sequentially canceled.

35 Claims, 42 Drawing Sheets

U.S. PATENT DOCUMENTS

| | | | |
|---|---|---|---|
| 4,121,603 | 10/1978 | Hayashi | 453/21 |
| 4,232,689 | 11/1980 | Nagasaka et al. | 453/20 |
| 4,286,703 | 9/1981 | Schuller et al. | 194/317 |
| 4,347,924 | 9/1982 | Hayashi et al. | 453/2 X |
| 4,361,161 | 11/1982 | Johnson | 194/346 X |
| 4,491,140 | 1/1985 | Eglise et al. | 194/217 X |
| 4,503,963 | 3/1985 | Steiner | 194/206 X |
| 4,629,051 | 12/1986 | Abe | 194/351 X |
| 4,635,661 | 1/1987 | Uematsu et al. | 453/17 X |
| 4,850,468 | 7/1989 | Kobayshi et al. | 194/207 |
| 4,850,469 | 7/1989 | Hayashi et al. . | |
| 4,883,158 | 11/1989 | Kobayashi et al. | 194/217 |
| 5,005,688 | 4/1991 | Yukimoto et al. | 194/206 |
| 5,052,538 | 10/1991 | Satoh | 194/317 |
| 5,082,100 | 1/1992 | Guyonneau | 194/343 |
| 5,083,652 | 1/1992 | Kobayashi et al. | 194/318 |
| 5,184,709 | 2/1993 | Nishiumi et al. | 194/318 |

FOREIGN PATENT DOCUMENTS

| | | | |
|---|---|---|---|
| 2831735 | 1/1980 | Fed. Rep. of Germany | 194/206 |
| 3022794 | 3/1981 | Fed. Rep. of Germany . | |
| 3425030 | 1/1985 | Fed. Rep. of Germany . | |
| 54-139800 | 10/1979 | Japan | 194/206 |
| 62-229364 | 10/1987 | Japan . | |
| 62-245495 | 10/1987 | Japan . | |
| 62-266692 | 11/1987 | Japan . | |
| 63-175965 | 7/1988 | Japan . | |
| 1173189 | 7/1989 | Japan | 453/56 |
| 1180062 | 7/1989 | Japan . | |
| 1304975 | 12/1989 | Japan . | |
| 2-233692 | 2/1990 | Japan | 453/17 |
| 2148380 | 6/1990 | Japan | 194/206 |
| 646000 | 10/1984 | Switzerland | 194/351 |
| 77107375 | 11/1989 | Taiwan . | |
| 2178212 | 2/1987 | United Kingdom | 453/17 |
| 2204682 | 11/1988 | United Kingdom | 194/206 |
| 8700401 | 12/1987 | World Int. Prop. O. . | |

COIN PROCESSING APPARATUS

This is a continuation of application Ser. No. 761,411, filed Sep. 17, 1991 now abandoned.

BACKGROUND OF THE INVENTION

1. Field of the Invention

The present invention relates to a coin processing apparatus for use in an automatic vending machine, a money exchanger, service equipment, or the like, and more particularly to a coin processor whose vertical dimension is reduced.

2. Description of the Related Art

Conventionally, a typical coin processing apparatus comprises a coin discriminating section and a coin sorting section. The coin discriminating section is arranged such that an inserted coin is allowed to roll along a coin discriminating passage provided with a coin discriminating device, by means of its free fall, and the coin rolling along the coin discriminating passage is discriminated by the coin discriminating device. The coin sorting section is arranged such that the coin discriminated by the coin discriminating device is introduced to a coin distributing passage, and the coin is sorted on the coin distributing passage by the type of denomination on the basis of the output of discrimination by the coin discriminating device and is accumulated in a relevant coin tube (coin accumulating device). The reason the inserted coins are arranged to be sorted and accumulated in the coin tubes by the types of denominations is to reutilize the inserted coins as change, thereby preventing a shortage of change as practically as possible and securing the opportunity of sales to a maximum degree.

This coin processing apparatus is mounted in, for instance, an automatic vending machine, effects the sorting processing of inserted coins, and controls the paying out of change from coin tubes, as necessary.

In an automatic vending machine or the like equipped with this conventional coin processing apparatus, since the coin discriminating section makes use of the free fall of coins, a dimension of a certain extent is required in the direction of the fall. In addition, since the coin sorting section includes a mechanism for mechanically sorting coins on the basis of their diameters by making use of the free fall, the coin storing section also requires a dimension of a certain extent. Hence, in some coin processing apparatuses, the distance from a coin slot to a coin return port extends as far as 200 mm.

For this reason, in the automatic vending machine or the like equipped with the conventional coin processing apparatus, if, for example, the coin slot is disposed at a position suitable for the user of the automatic vending machine, it has consequently been unavoidable to dispose the change paying-out port at a lower portion of the automatic vending machine. Therefore, the user of the automatic vending machine is compelled to receive the change by bending down, which is very inconvenient to the user. This has been one factor reducing the number of users of the automatic vending machines.

Accordingly, various proposals have been made to reduce the vertical dimension of the coin processing apparatus. For instance, an arrangement has been conceived in which a horizontal passage for conveying coins by means of a belt is adopted in the coin discriminating section, and the coin discriminating device is disposed at the conveying passage, thereby reducing the vertical dimension of the coin processing apparatus.

With this arrangement, however, the vertical dimensions of the coin discriminating section and the coin conveying section remain unchanged, so that it cannot be said that this arrangement is satisfactory.

In addition, another arrangement has been conceived in which, to reduce the vertical dimension of the coin sorting section, a plurality of coin distributing sections are arranged in a vertical row in correspondence with a plurality of coin tubes arranged along a coin distributing passage. As these coin distributing sections are controlled on the basis of the output of discrimination by the coin discriminating device, an inserted coin is distributed so as to be introduced to a corresponding coin tube or to a next coin distributing section, thereby allowing inserting coins to be distributed to relevant coin tubes by the types of denominations.

With this arrangement, however, if the coin distributing sections are controlled to distribute an ensuing coin before the destination of the previous coin has not been discriminated, there can be cases where the previous coin is introduced not to a coin tube of its destination but to another coin tube. In addition, if the acceptance of an ensuing coin is prohibited until the previous coin is introduced to a final coin tube, it is impossible to cope with the continual insertion of coins.

Furthermore, among the coins discriminated by the coin discriminating section, the coins which are to be used as change are accumulated in the coin tubes by the types of denominations, and change is paid out by using the coins accumulated in the coin tubes. However, there are certain limitations to the coin-accumulating capacities of the coin tubes. Hence, the conventional coin processing apparatus is arranged such that the coin tubes are respectively provided with mechanically arranged levers, and the coins overflowing from the coin tubes are introduced to a cash box by means of the levers.

Nevertheless, each of the levers for controlling overflow requires a substantial vertical dimension for disposition thereof, which has been one factor making it impossible to reduce the vertical dimension of the coin discriminating section.

With this conventional arrangement using the levers, when coins are stacked in each of the coin tubes up to a fixed point, the passage leading to that coin tube is blocked, so that the coins subsequently led toward the coin tube are introduced to a passage leading to the cash box. Hence, the number of coins which can be stacked in each of the coin tubes is mechanically fixed. In cases where this coin processing apparatus is mounted in an automatic vending machine which does not require much change, it follows that unnecessary coins are introduced to the coin tubes. In this case, in the operation of collecting coins, a large number of coins must always be collected from the coin tubes, so that there has been a drawback in that the operation of collecting coins is very troublesome.

With this conventional arrangement using the levers, since the operation is effected by bringing the coin itself into contact with the lever, there has been another drawback in that an intended operation cannot be performed owing to wear affecting durability as well as stains.

In the case where the horizontal passage for conveying coins by means of a belt is adopted for the coin discriminating section, the conventional arrangement provided is such that even when a foreign object other than a coin is deposited, the foreign object is temporarily led to the belt conveying passage and is returned after being detected. According to this arrangement, a mechanical blockage by the foreign object is induced, so that the coin processing apparatus cannot be used until the foreign object is removed.

In particular, most of the automatic vending machines equipped with such a coin processing apparatus are used for sale without being attended by salespersons; hence, the detection of the above drawback is liable to be delayed. Consequently, there arises a shortcoming in that opportunities of sales are lost.

In the case of the arrangement wherein the horizontal passage for conveying coins by means of a belt is adopted for the coin discriminating section, there are mechanical limitations to the coin-conveying speed by means of the belt, so that an ensuing coin may be inserted before the detection processing of a previously inserted coin is completed. Accordingly, control which is devoted only to the detection of one coin is insufficient, and parallel detection processing of a plurality of continually inserted coins is required.

Hence, it is conceivable to adopt an arrangement wherein an inlet sensor is provided at the coin slot, and the processing of a coin is commenced when the inlet sensor has shifted from an "on" state to an "off" state. In this case, however, the inlet sensor automatically shifts from the "on" state to the "off" state even if the user of the coin processing apparatus pulls out the coin midway in the insertion of the coin. Hence, if the processing of the coin is commenced at this point of time, unnecessary coin processing must be executed although the coin has not actually been deposited. In particular, if the user of the coin processing apparatus repeatedly turns on and off the inlet sensor by way of a prank, unnecessary coin processing must be commenced on each such occasion, giving rise to problems in that the capacity of software for coin processing must be increased and that the processing becomes complicated.

SUMMARY OF THE INVENTION

Accordingly, it is an object of the present invention to provide a coin processing apparatus in which a distance from a coin slot to a coin return port can be reduced by devising the arrangement of a coin delivering section, thereby making it unnecessary for a user to receive change by bending down in cases where the coin processing apparatus is used in an automatic vending machine or the like.

Another object of the present invention is to provide a coin processing apparatus capable of coping with continual insertion of coins although an arrangement is adopted in which a plurality of coin distributing sections are arranged in a vertical row along a coin distributing passage.

Still another object of the present invention is to provide a coin processing apparatus in which a vertical dimension thereof is reduced, and which is capable of arbitrarily setting the number of coins overflowing, and of effecting overflow processing which is free from drawbacks due to wear affecting durability and stains.

A further object of the present invention is to provide a coin processing apparatus capable of preventing a foreign object from being drawn in.

A still further object of the present invention is to provide a coin processing apparatus which, even if an inlet sensor is turned on and off by a user of the coin processing apparatus by way of a prank, is capable of coping with the same, and which does not entail an increase in the capacity of software for coin processing and complicated processing.

To attain the above objects, in accordance with the present invention there is provided a coin processing apparatus comprising: a coin conveying section for substantially horizontally conveying coins inserted through a coin slot; a coin discriminating section for discriminating the type of denomination of the coin being conveyed by the conveying section; a plurality of coin accumulating sections for accumulating the coins by the types of denominations as coins to be used as change; a distributing section for distributing the coins to be used as change to the plurality of coin accumulating sections by the types of denominations in correspondence with an output of discrimination by the coin discriminating section; and a coin paying-out section for paying out the coins from the coin accumulating sections.

In accordance with this arrangement, since the discrimination of a coin is effected while the coin inserted through the coin slot is being conveyed substantially horizontally, the vertical dimension of the coin processing apparatus can be reduced. As a result, in cases where the coin processing apparatus is applied to an automatic vending machine or the like, the distance between the coin slot and the coin return port can be reduced, so that the user of the automatic vending machine need not bend down to receive change.

In addition, in accordance with this invention, the coin processing apparatus comprises the coin discriminating section for discriminating the type of denomination of the coin inserted through the coin slot; the plurality of coin accumulating sections for accumulating the coins by the types of denominations; and a plurality of distributing sections arranged in correspondence with the coin accumulating sections, wherein the distributing sections comprise: coin distributing sections each adapted to selectively execute a first distributing operation for introducing a coin passing therethrough to a corresponding one of the coin accumulating sections and a second distributing operation for introducing the same to an ensuing one of the coin distributing sections; and control means for setting to a prohibited state the first distributing operation of all the coin distributing sections leading to the coin distributing section corresponding to a type of denomination discriminated by the coin discriminating means in correspondence with the discriminated type of denomination, for causing the coin distributing section corresponding to the type of denomination discriminated by the coin discriminating means to execute the first distributing operation in correspondence with the discriminated type of denomination, and for sequentially canceling the prohibited state of the first distributing operation of the coin distributing sections leading to the coin distributing section corresponding to the discriminated type of denomination as the coin to be distributed passes through the coin distributing sections.

In this arrangement, if the discrimination of an inserted coin is effected by the coin discriminating means, the first distributing operation of all the coin distributing sections leading to the coin distributing section corresponding to the discriminated type of denomination, in correspondence with the discriminated type of denomination is set in a prohibited state. Subsequently, the coin distributing section corresponding to the type of denomination discriminated by the coin discriminating means is caused to execute the first distributing operation in correspondence with the discriminated type of denomination, and the prohibited state of the first distributing operation of the coin distributing sections leading to the coin distributing section corresponding to the discriminated type of denomination is sequentially canceled as the coin to be distributed passes through the coin distributing sections.

In addition, in this invention, each coin tube is provided with an overflow sensor for detecting the amount of coins held in each coin tube, and processing for causing coins for change led to the coin tube to be introduced to a cash box is effected on the output of detection by the overflow sensor.

In this arrangement, when the amount of coins held in the coin tube reaches a predetermined amount, the overflowing state is detected by the overflow sensor, and processing for causing the coins for change led to the coin tube to be introduced to the cash box is effected on the output of detection by the overflow sensor.

In this case, a vertical dimension thereof is reduced, the number of coins overflowing can be arbitrarily set through the position in which the overflow sensor is disposed. Morever, since mechanical levers are not used, drawbacks due to wear affecting durability and stains do not occur, and the vertical dimension of the apparatus can be reduced.

In addition, in this invention, inlet sensor means is disposed at the coin slot to selectively sense a usable coin.

That is, the coin inserted through the coin slot is primarily detected by this inlet sensor. As a result, the coin inserted through the coin slot is prevented at the coin slot, thereby preventing a foreign object from entering the interior of the main body of the apparatus.

Furthermore, in this invention, a gate sensor is disposed on an inner side of the coin slot by being spaced apart from the coin slot at least by a distance greater than a diameter of the coin having a maximum diameter among the usable coins; and the processing of an inserted coin is started upon detection of the inserted coin by the gate sensor.

In this arrangement, when the coin inserted through the coin slot is detected by the gate sensor, the processing of the coin is started. Here, since the gate sensor is disposed at a position where it cannot be manipulated by the person who inserted the coin, i.e., on an inner side of the coin slot and at a position spaced apart from the coin slot at least by a distance greater than the diameter of the coin having a maximum diameter among the usable coins, this gate sensor cannot be turned on or off by the person who inserted the coin. Thus, since the gate sensor cannot be turned on or off by the user by way of a prank, for example, so that the capacity of software for coin processing does not increase, and that processing is prevented from becoming complicated.

The above and other objects, features and advantages of the present invention will become more apparent from the following detailed description of the invention when read in conjunction with the accompanying drawings.

DESCRIPTION OF THE PREFERRED EMBODIMENTS

Figure 1:
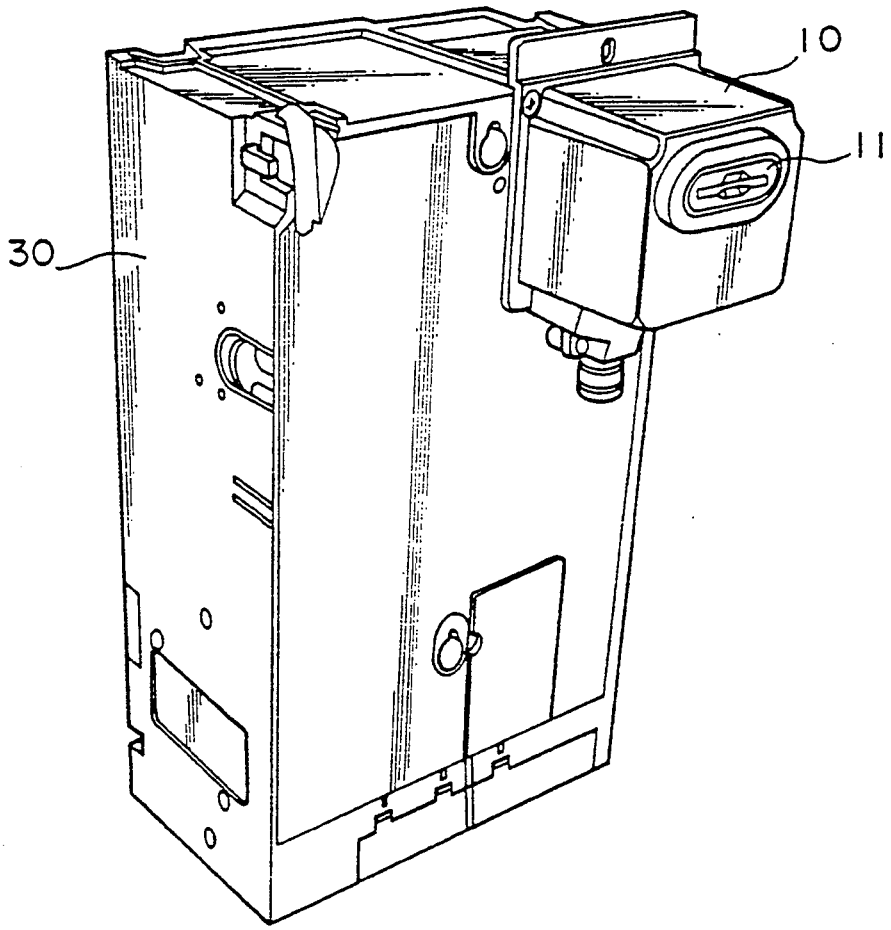
FIG. 1 is a perspective front view of the appearance of an embodiment of a coin processing apparatus in accordance with the present invention.
Figure 2:
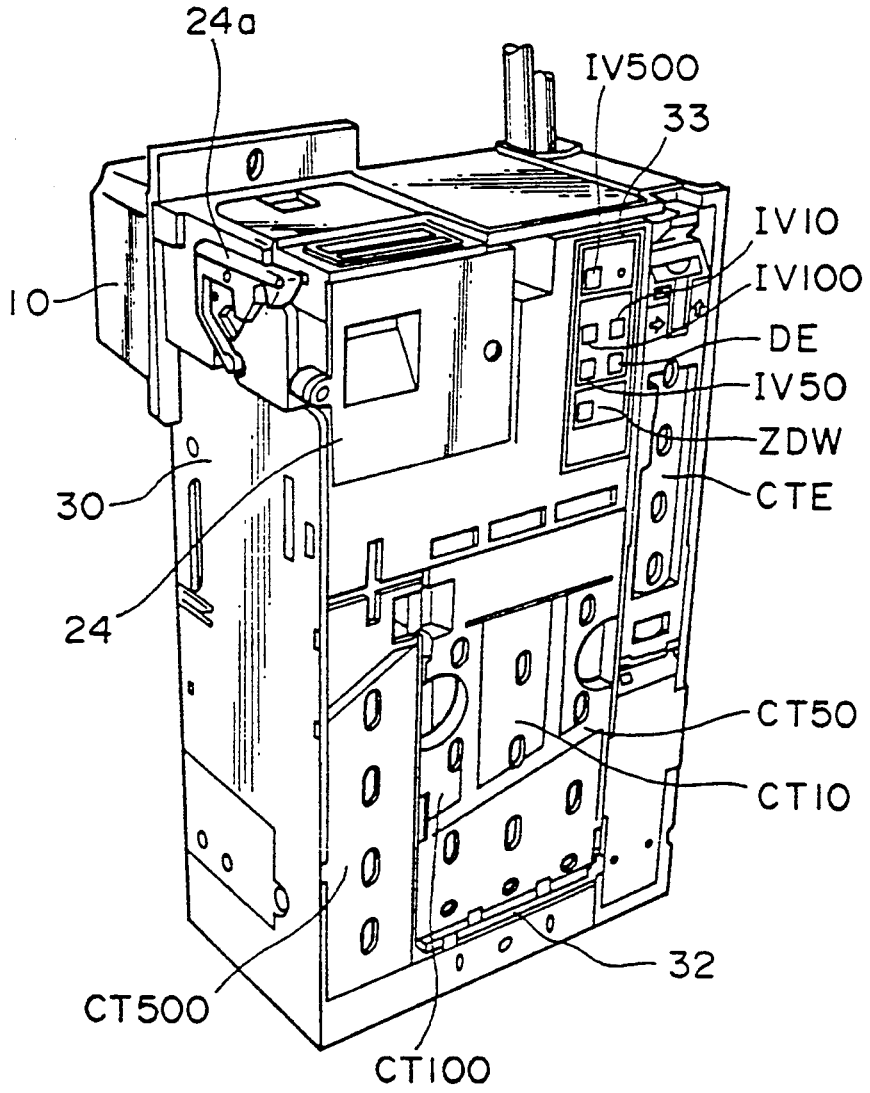
FIG. 2 is a perspective rear view of the coin processing apparatus of the embodiment.

FIGS. 1 and 2 are a perspective front view and a perspective rear view of a coin processing apparatus in accordance with the present invention. As shown in FIG. 1, the coin processing apparatus of this embodiment comprises a coin receiving section 10 projecting forwardly and a main body section 30. The coin receiving section 10 is provided with a coin slot 11. As shown in FIG. 2, a mechanism section 24 for horizontally conveying coins is provided within the coin receiving section 10, and this mechanism section 24 for horizontally conveying coins is adapted to be pulled out rearwardly upon release of a latch mechanism 24*a* so as to facilitate maintenance. In addition, as shown in detail in FIGS. 4 and 5, which will be referred to later, disposed in a lower portion of the main body section 30 are a plurality of coin tubes, constituting both a coin sorting section and a coin accumulating section, i.e., a ¥ 500 tube CT500, a ¥ 100 tube CT100, a ¥ 10 tube CT10, and ¥50 tube CT50. A coin paying-out mechanism 32 is disposed below the ¥ 100 tube CT100, the ¥ 10 tube CT120, and the ¥ 50 tube CT50. In addition, a tube CTD indicates one of two auxiliary tubes for manual replenishment provided in this embodiment. Arranged on a panel 33 are an internal auxiliary unit inventory switch DE, an external auxiliary unit inventory switch ZDW, a ¥ 500 inventory switch IV500, a ¥ 100 inventory switch IV100, a ¥ 10 inventory switch IV10, and a ¥50 inventory switch IV50, which will be described later in detail.

In cases where the coin processing apparatus of this embodiment is mounted in, for instance, an automatic vending machine, the apparatus is mounted in such a manner that the coin slot 11 of the coin receiving section 10 directly faces the outside of the automatic vending machine.

Figure 3:
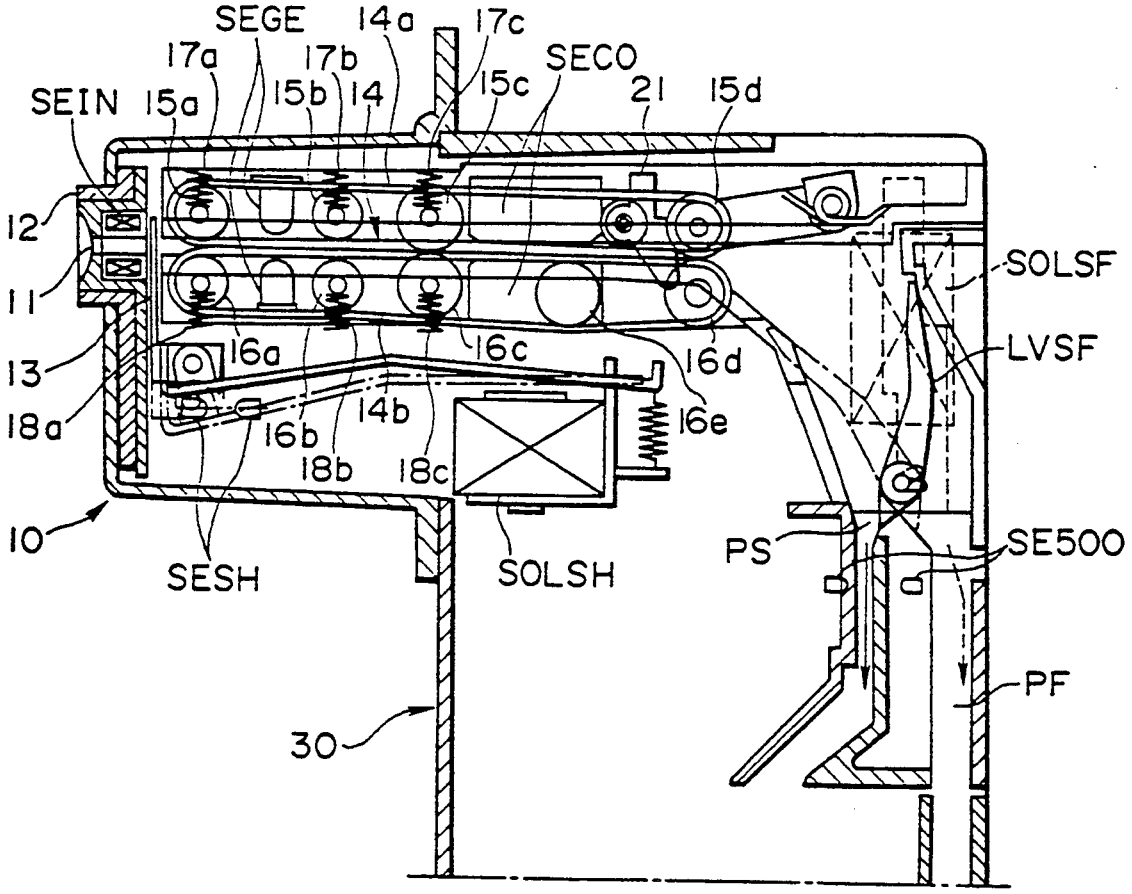
FIG. 3 is a fragmentary side-elevational view of essential portions of the coin processing apparatus of the embodiment.

FIG. 3 shows a side cross-sectional view of the coin processing apparatus of this embodiment, centering on a coin discriminating section.

In FIG. 3, a light-emitting unit 12 having a light-emitting element accommodated therein is fitted at the coin slot 11. This light-emitting unit 12 is provided so that the user of the automatic vending machine or the like equipped with this coin processing apparatus will be able to readily identify the coin slot 11. The light-emitting unit 12 is effective for use particularly during the night, thereby improving the operational efficiency of the automatic vending machine or the like equipped with the coin processing apparatus.

In the coin processing apparatus of this embodiment, a coin discriminating passage based on belt conveyance is adopted to reduce the vertical dimension of the coin discriminating section. In the case where the coin discriminating passage based on belt conveyance is adopted, a foreign object other than a coin, when led to the belt conveying passage, induces mechanical blockage. In this case, the automatic vending machine equipped with the coin processing apparatus cannot be used until the foreign object is removed. In view of the fact that sales by means of automatic vending machines are mostly unattended by salespersons, the detection of the mechanical blockage is frequently delayed, in which case the opportunities of sales are lost.

For this reason, in this embodiment, an inlet sensor SEIN for effecting the primary detection of an inserted coin is disposed at the coin slot 11. This inlet sensor SEIN is adapted to remove a foreign object inserted through the coin slot 11 and detect the insertion of a coin through the coin slot 11. The inlet sensor SEIN is constituted by a proximity switch using a coil which reacts to usable or genuine coins only.

A shutter 13 is adapted to prevent the foreign object inserted through the coin slot 11 and restrict the coin inserted therethrough, and the shutter 13 is driven by a shutter solenoid SOLSH operated on the basis of the output of the inlet sensor SEIN. The operating state of the shutter 13 is detected by a shutter sensor SESH.

Figure 5:
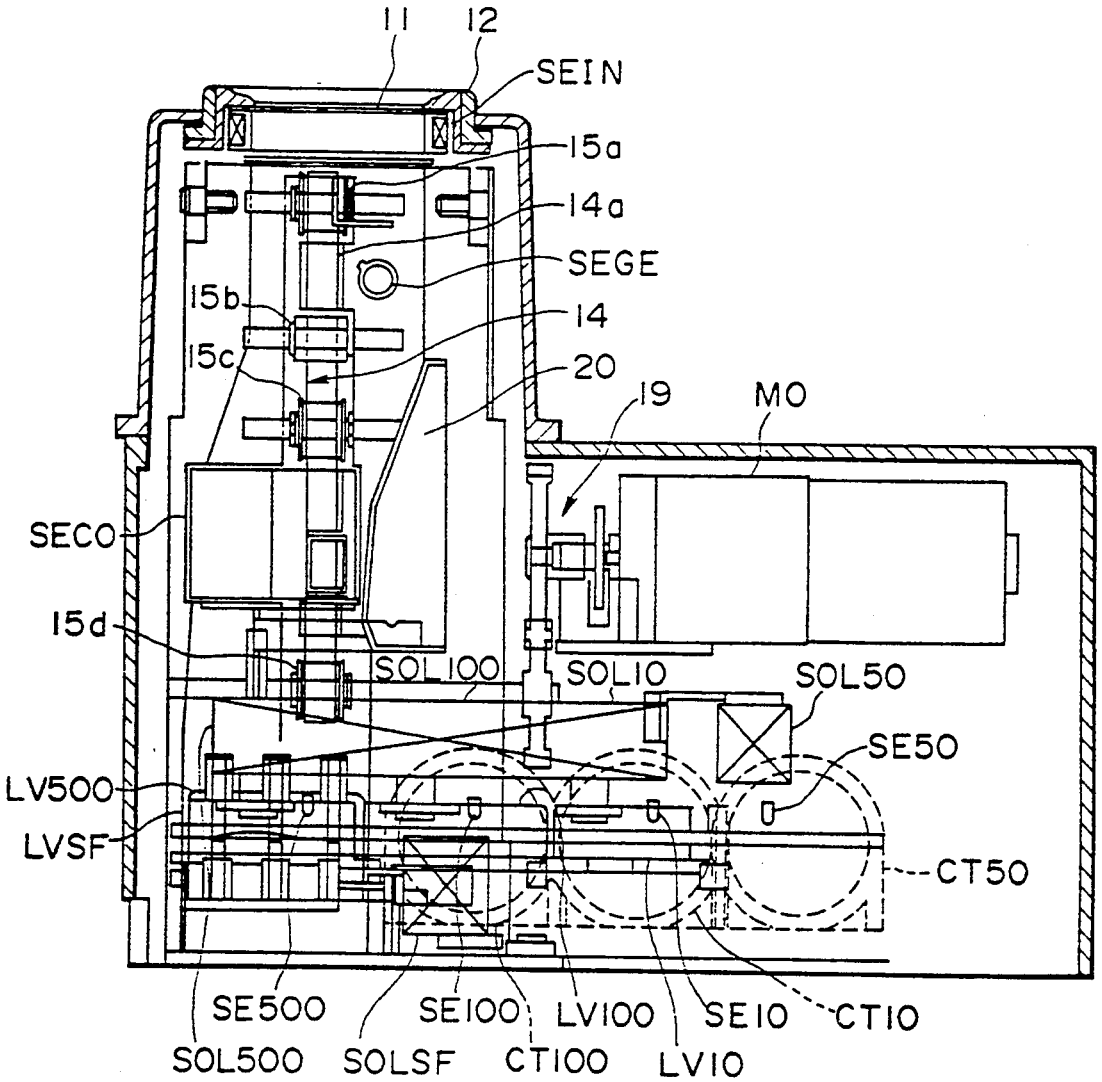
FIG. 5 is a fragmentary plan view of the coin processing apparatus of the embodiment.

A belt conveying passage 14 comprises a pair of upper and lower conveying belts 14*a*, 14*b*, and rollers 15*a*, 15*b*, 15*c*, 15*d* and 16*a*, 16*b*, 16*c*, 16*d*, 16*e* for driving these belts. The shafts of the rollers 15*a*, 15*b*, 15*c* and the shafts of the rollers 16*a*, 16*b*, 16*c* are resiliently supported by springs 17*a*, 17*b*, 17*c*, and springs 18*a*, 18*b*, 18*c*, respectively, so as to allow coins of varying sizes to be conveyed thereby. The roller 16*d* is driven by a belt conveyance motor MO via a reduction gear system 19, as shown in FIG. 5 which is a plan view of FIG. 3. The roller 16*d*, in turn, causes the other rollers 16*a*, 16*b*, 16*c*, 16*e* to be driven via the conveying belt 14*b* and the rollers 15*a*, 15*b*, 15*c*, 15*d* to be driven via the conveying belts 14*b*, 14*a*.

A gate sensor SEGE and a sorting sensor SECO are disposed along the belt conveying passage 14.

The gate sensor SEGE is disposed at a position spaced apart from the coin slot 11 by more than a distance corresponding to the diameter of the coin having the largest diameter among the coins used, i.e., at a position at which the coin cannot be manipulated by the person who inserted it. In this embodiment, an arrangement is provided such that the sorting processing of the coin is commenced when this gate sensor SEGE is turned on. Here, it is conceivable to adopt an arrangement wherein, for instance, without providing the gate sensor SEGE, the sorting processing of the coin is commenced when the inlet sensor SEIN is turned on. In that case, however, if, by way of a prank, the coin is repeatedly inserted and taken out from the portion where the inlet sensor SEIN is disposed, and the inlet sensor SEIN is thereby turned on and off repeatedly, coin sorting processing is commenced on each such occasion. Hence, the capacity of software for coin processing must be increased, and processing itself becomes complicated. Accordingly, the arrangement provided in this embodiment is such that coin sorting processing is commenced upon the turning on of the gate sensor SEGE disposed at a position where the coin cannot be manipulated by the person who inserted it. This gate sensor SEGE comprises a light-emitting element and a light-receiving element disposed with the belt conveying passage 14 located therebetween, and optically detects the coin being conveyed along the belt conveying passage 14.

The sorting sensor SECO discriminates the authenticity and the types of denominations of the coins conveyed along the belt conveying passage 14. The sorting sensor SECO comprises a transmission coil for being excited by an exciting signal of a predetermined frequency and a reception coil for receiving the output of the transmission coil, the transmission coil and the reception coil being disposed in such a manner as to face each other with the belt conveying passage 14 located therebetween. As a coin which is conveyed along the belt conveying passage 14 and whose rim on one side thereof is guided by a guide 20 passes between the transmission coil and the reception coil, the authenticity and the type of denomination are determined on the basis of an attenuation waveform generated in the reception coil. That is, in this embodiment, four types of denominations including ¥ 500, ¥ 100, ¥ 50, and ¥ 10 are assumed to be used as the coins. Peak values of attenuation waveforms produced in the reception coil are compared with window values set in advance in correspondence with ¥ 500, ¥ 100, ¥ 50, and ¥ 10. When the peak value of the attenuation waveform falls within the window value corresponding to ¥ 500, it is determined that the coin is a ¥ 500 coin. When the peak value falls within the window value corresponding to ¥ 100, it is determined that the coin is a ¥ 100 coin. When the peak value falls within the window value corresponding to ¥ 50, it is determined that the coin is a ¥ 50 coin. When the peak value falls within the window value corresponding to ¥ 10, it is determined that the coin is a ¥ 10 coin. When the peak value does not fall under the window values of ¥ 500, ¥ 100, ¥ 50, and ¥10, it is determined that the coin is counterfeit. A pullout preventing lever 21 is designed to prohibit an unauthorized operation in which, for example, after a string or the like is tied in advance to a coin, the coin is made to pass once through the coin sensor and is then pulled out.

The coins which passed the belt conveying passage 14 and dropped therefrom are sorted by a true/false sorting lever LVSF, and true coins are introduced to a true coin passage PS, while false coins are introduced to a false coin passage PF. The true/false coin sorting lever LVSF is driven by a true/false coin solenoid SOLSF which is actuated by the output of discrimination by the sorting sensor SECO. That is, if the coin discriminated by the sorting sensor SECO is a false coin, the true/false coin solenoid SOLSF is not energized (off), the true/false coin sorting lever LVSF is located at the position indicated by the dotted line in FIG. 3, and the coin which has dropped from the belt conveying passage 14 is introduced to the false coin passage PF. In addition, in the case where the coin discriminated by the sorting sensor SECO is any of the true ¥ 500, ¥ 100, ¥ 50, and ¥ 10 coins, the true/false coin solenoid SOLSF is energized (turned on), which in turn causes the true/false coin sorting lever LVSF to be changed over to the position shown by the solid line in FIG. 3, thereby allowing the coin falling from the belt conveying passage 14 to be introduced to the true coin passage PS.

Figure 4:
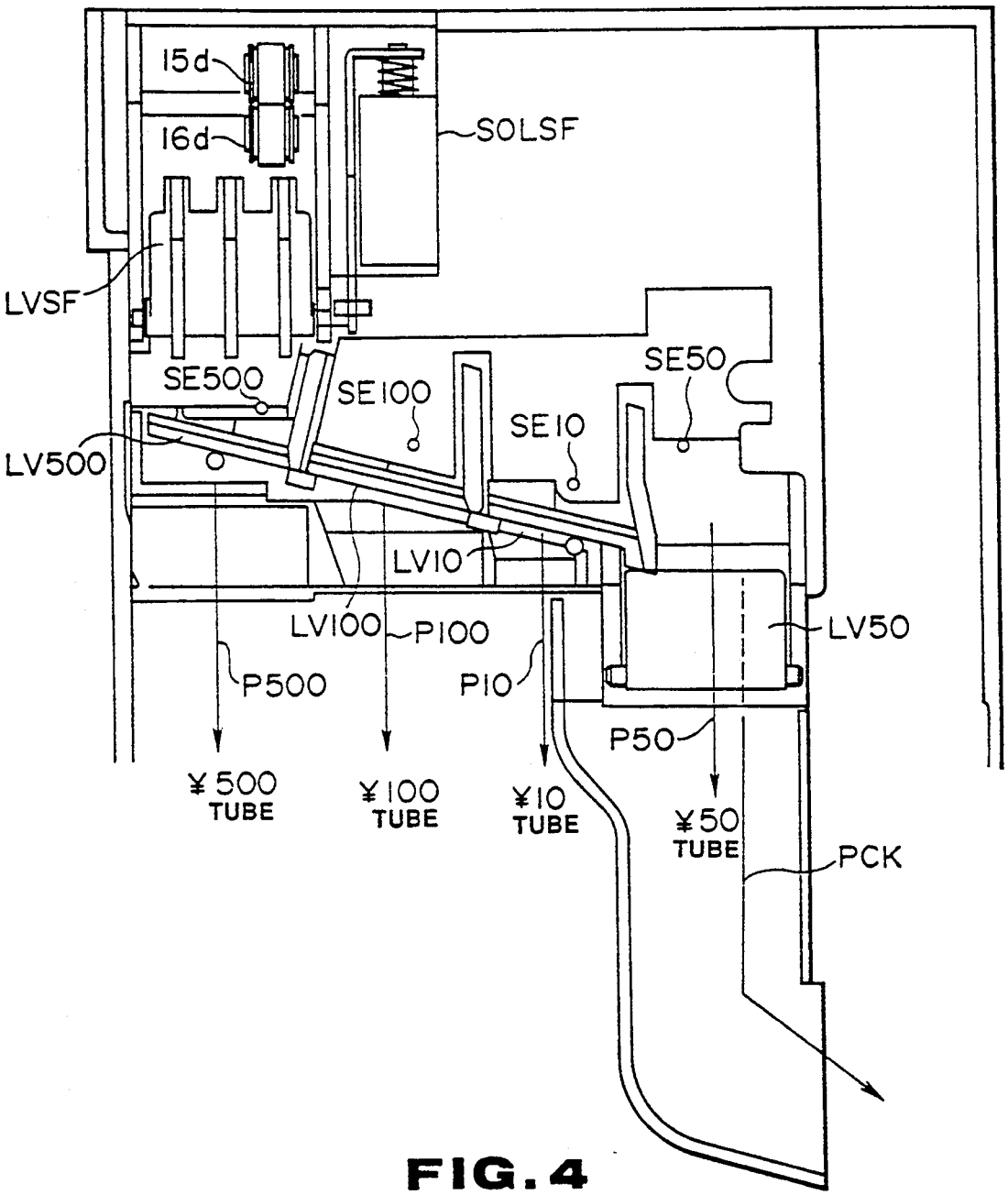
FIG. 4 is a fragmentary rear view of the coin processing apparatus of the embodiment.

As shown in FIG. 4, arranged along the true coin passage PS are a ¥ 500 lever LV500, a ¥ 100 lever LV100, and a ¥10 lever LV10 which are each substantially L-shaped. A lower portion of each of the ¥ 500 lever LV500, the ¥ 100 lever LV100, and the ¥ 10 lever LV10 forms a diagonally inclined coin passage. In addition, a ¥ 50 lever LV50 is disposed at a stage following the ¥ 10 lever LV10. The ¥ 500 tube CT500, ¥ 100 tube CT100, and ¥ 10 tube CT50 are disposed in correspondence with the ¥ 500 lever LV500, ¥ 100 lever LV100, and ¥ 10 lever LV10, respectively. The ¥ 500 lever LV500 is driven by a ¥ 500 solenoid SOL500. When the ¥ 500 solenoid SOL500 is de-energized, a coin passage on its side is opened to introduce the coin to the position where the ensuing ¥ 100 lever LV100 is disposed. When the ¥ 500 solenoid SOL500 is energized, a ¥ 500 coin passage P500 located therebelow is opened to introduce the coin to the ¥ 500 tube CT500. In addition, the ¥ 100 lever LV100 is driven by a ¥ 100 solenoid SOL100. When the ¥ 100 solenoid SOL100 is de-energized, a coin passage on its side is opened to introduce the coin to the position where the ensuing ¥ 10 lever LV10 is disposed. When the ¥ 100 solenoid SOL100 is energized, a ¥ 100 coin passage P100 located therebelow is opened to introduce the coin to the ¥ 100 tube CT100. In addition, the ¥ 10 lever LV10 is driven by a ¥ 10 solenoid SOL10. When the ¥ 10 solenoid SOL is de-energized, a coin passage on its side is opened to introduce the coin to the position where the ensuing ¥ 50 lever LV50 is disposed. When the ¥ 10 solenoid SOL10 is energized, a ¥ 10 coin passage P10 located therebelow is opened to introduce the coin to the ¥ 10 tube CT10.

The ¥ 50 lever LV50 is driven by a ¥ 50 solenoid SOL50. When the ¥ 50 solenoid SOL50 is de-energized, a coin passage PCK on its side for introducing the coin to an unillustrated cash box is opened. When the ¥ 50 lever LV50 is energized, a ¥ 50 coin passage P50 is opened to introduce the coin to the ¥ 50 tube CT50.

A ¥ 500 sensor SE500, a ¥ 100 sensor SE100, a ¥ 10 sensor SE10, and a ¥ 50 sensor SE50 are respectively disposed at the positions where the ¥ 500 lever LV500, ¥100 lever LV100, ¥ 10 lever LV10, and ¥ 50 lever LV50 are disposed, The ¥ 500 sensor SE500, ¥ 100 sensor SE100, ¥ 10 sensor SE10, and ¥ 50 sensor SE50 each comprise a light-emitting device and a light-receiving device. As the coin in the tube interrupts an optical path leading from the light-emitting element to the light-receiving element, each of these sensors is actuated (turned on). It should be noted that in this embodiment the inserted coins are counted on the basis of the output of the ¥ 500 sensor SE500.

Figure 6:
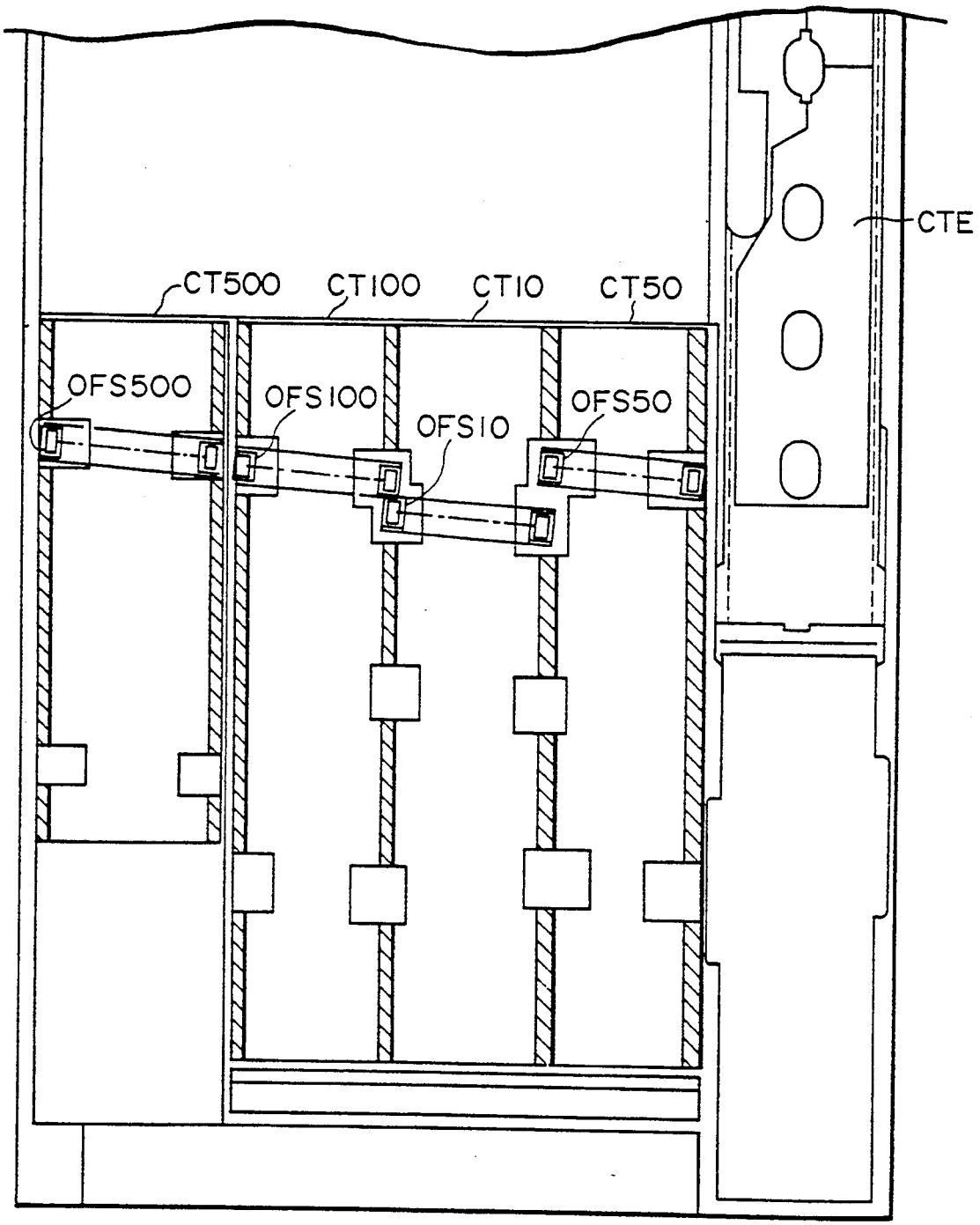
FIG. 6 is a diagram illustrating the state in which overflow sensors are disposed in relation to coin tubes.
Figure 7:
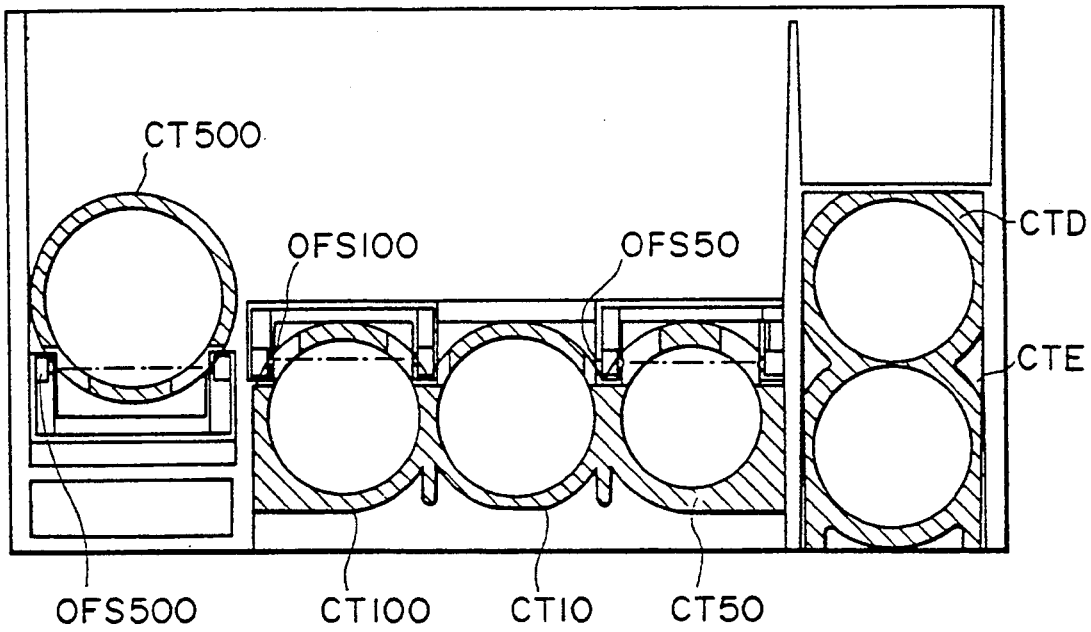
FIG. 7 is a fragmentary cross-sectional view of a main plate in this embodiment.

The manner in which the ¥ 500 tube CT500, ¥ 100 tube CT100, ¥ 10 tube CT10, and ¥ 50 tube CT50 are arranged is shown in FIGS. 6 and 7. It should be noted that, in FIGS. 6 and 7, tubes CTD, CTE indicate auxiliary tubes for manual replenishment.

As shown in FIG. 6, overflow switches OFS500, OFS100, OFS10, and OFS50 are respectively disposed at predetermined positions in the ¥ 500 tube CT500, ¥ 100 tube CT100, ¥ 10 tube CT10, and ¥ 50 tube CT50. The overflow switches OFS500, OFS100, OFS10, OFS50 are used for overflow control which will be described later, and the positions in which they are disposed are so arranged to be changed over into two stages according to the use of the coin processing apparatus. That is, in cases where the coin processing apparatus is used for an automatic vending machine which requires much change, the overflow switches OFS500, OFS100, OFS10, OFS50 are disposed at an upper stage, while it is used for an automatic vending machine which does not require much change, the overflow switches OFS500, OFS100, OFS10, OFS50 are disposed at a lower stage. The overflow switches OFS500, OFS100, OFS10, OFS50 each comprise a light-emitting element and a light-receiving element, and are actuated (turned on) as the coin in the respective tube interrupts the optical path leading from the light-emitting element to the light-receiving element. It should be noted that the overflow switches OFS500, OFS100, OFS10, OFS50 are fixed in such a manner as to be inclined with respect to the ¥ 500 tube CT500, ¥ 100 tube CT100, ¥ 10 tube CT10, ¥ 50 tube CT50 so as to positively detect coins in the respective tubes. Incidentally, the coin tubes CT100, CT10, CT50 are formed integrally and constitute a cassette tube, the cassette tube being detachable with respect to the main body section 30.

FIGS. 8 to 11 respectively show the manner in which the coins are sorted by the ¥ 500 lever LV500, ¥ 100 lever LV100, ¥ 10 lever LV10, and ¥ 50 lever LV50.

Figure 8:
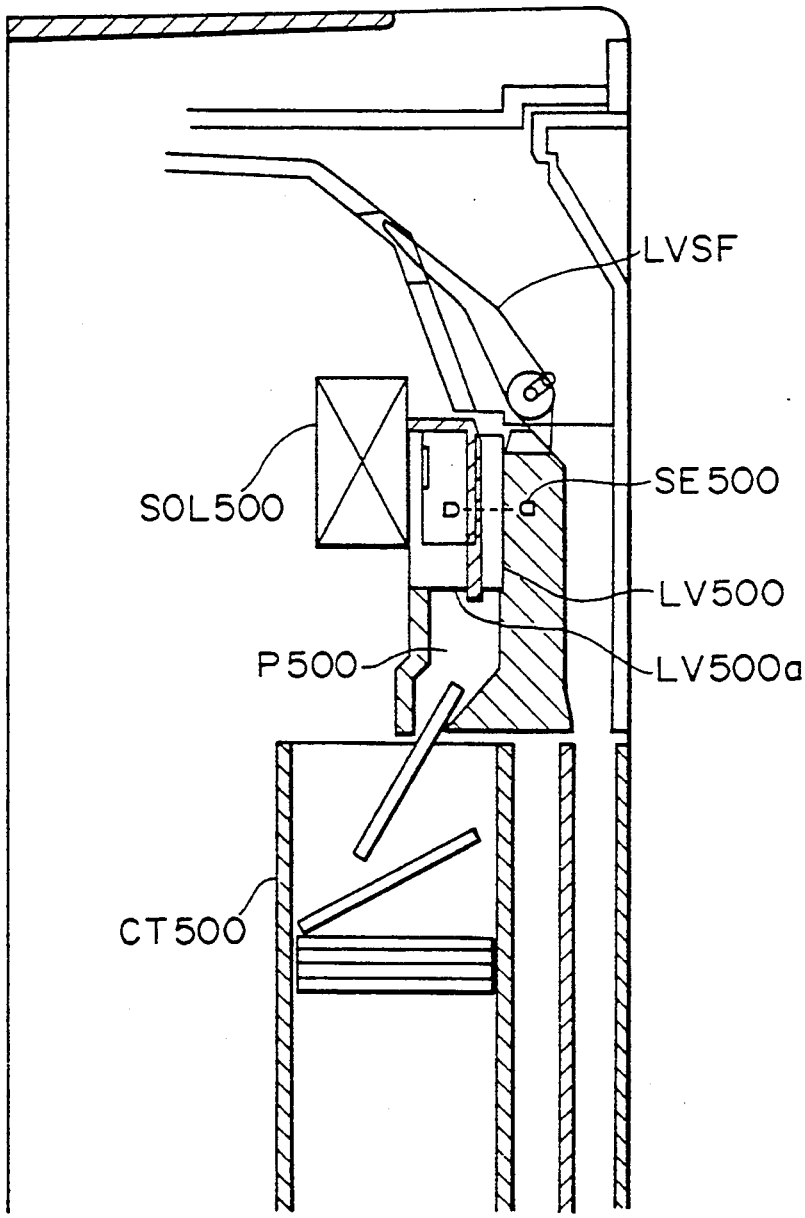
FIG. 8 is a diagram illustrating the state of distribution of a ¥ 500 coin in this embodiment.

As shown in FIG. 8, when the ¥ 500 solenoid SOL500 is energized and the ¥ 500 lever LV500 is thereby withdrawn, a lower portion LV500*a* of the ¥ 500 lever LV500 opens the ¥ 500 coin passage P500, allowing the coin at the position of the ¥ 500 lever LV500 to be introduced to the ¥ 500 tube CT500.

Figure 9:
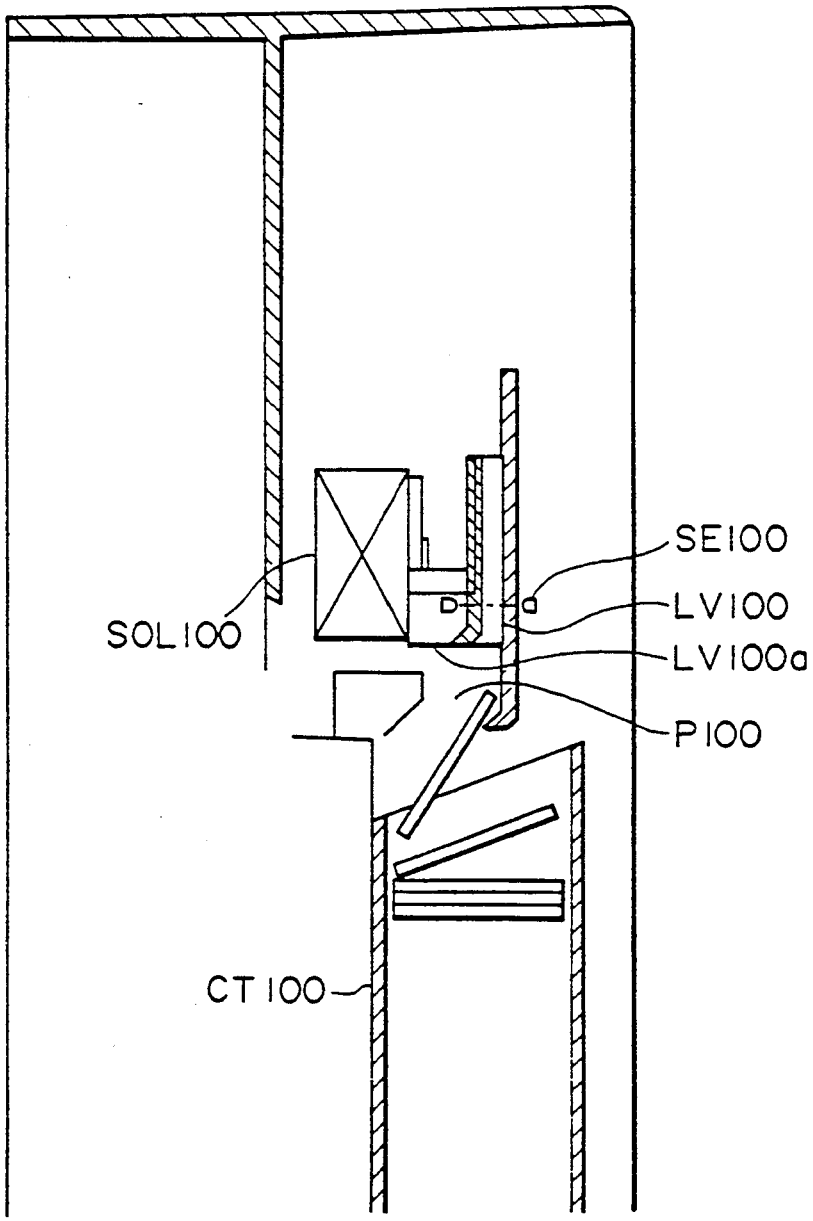
FIG. 9 is a diagram illustrating the state of distribution of a ¥ 100 coin in this embodiment.

In addition, as shown in FIG. 9, when the ¥ 100 solenoid SOL100 is energized and the ¥ 100 lever LV100 is thereby withdrawn, a lower portion LV100*a* of the ¥ 100 lever LV100 opens the ¥ 100 coin passage P100, allowing the coin located at the position of the ¥ 100 lever LV100 to be introduced to the ¥ 100 tube CT100.

Figure 10:
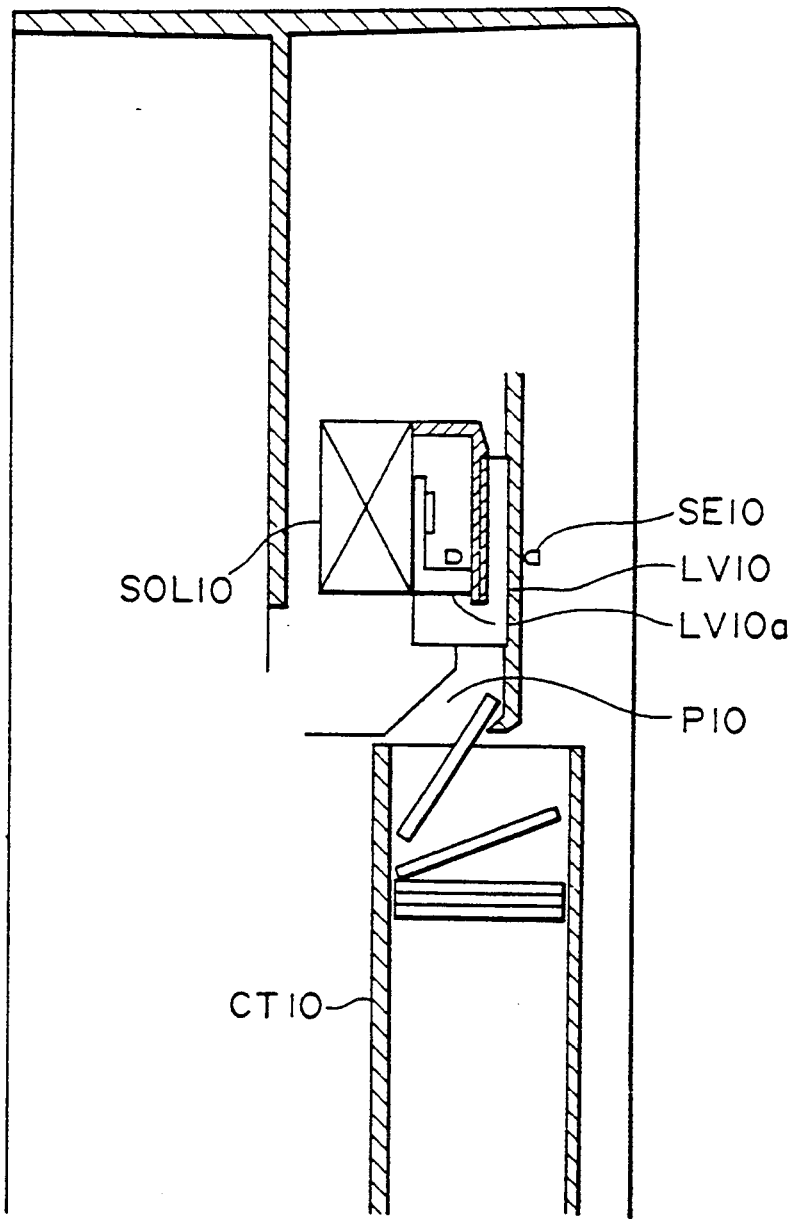
FIG. 10 is a diagram illustrating the state of distribution of ¥ 10 coin in this embodiment.

As shown in FIG. 10, when the ¥ 10 solenoid SOL10 is energized and the ¥ 10 lever LV10 is thereby withdrawn, a lower portion LV10*a* of the ¥ 10 lever LV10 opens the ¥ 10 coin passage P10, allowing the coin located at the position of the ¥ 10 lever LV10 to be introduced to the ¥ 10 tube CT10.

Figure 11:
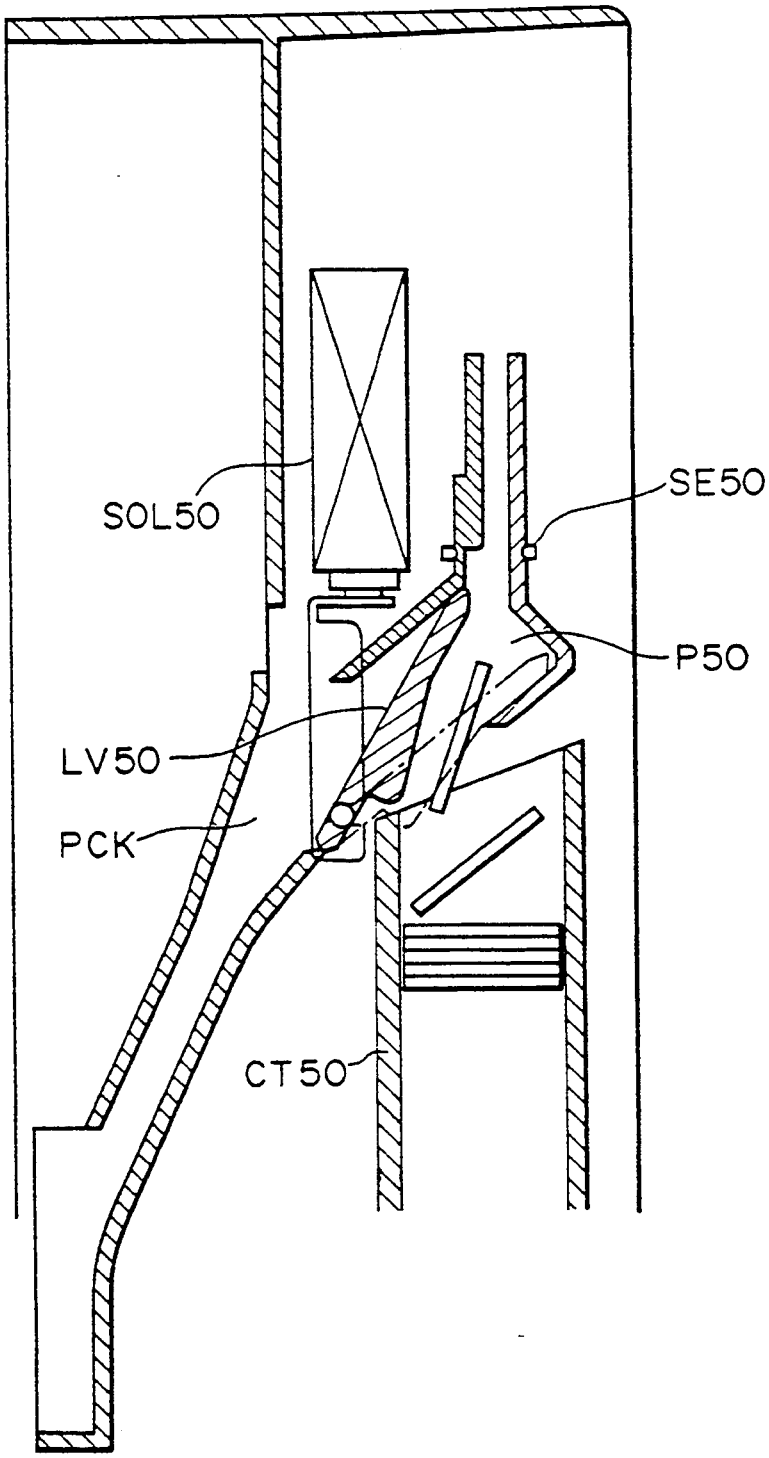
FIG. 11 is a diagram illustrating the state of distribution of ¥ 50 coin in this embodiment.

As shown in FIG. 11, when the ¥ 50 solenoid SOL50 is energized and the ¥ 50 lever LV50 is thereby changed over from the position shown by the dotted line to the position shown by the solid line, the ¥ 50 coin passage P50 is opened, allowing the coin to be introduced to the ¥ 50 tube CT50.

Figure 12:
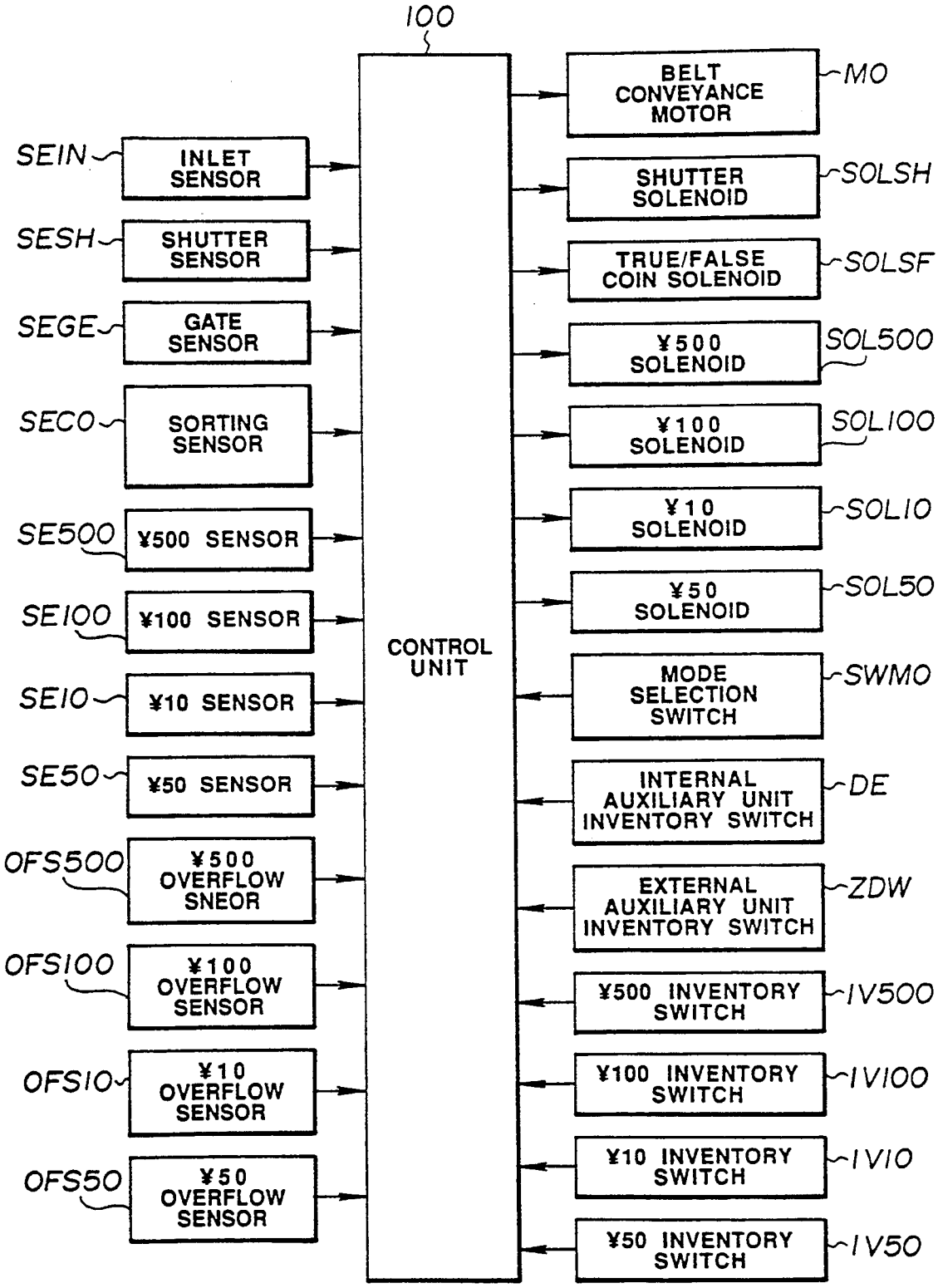
FIG. 12 is a block diagram illustrating a control system of this embodiment.

FIG. 12 is a block diagram of a control system in accordance with this embodiment. In this control system, applied to a control unit 100 are the outputs of the inlet sensor SEIN, shutter sensor SESH, gate sensor SEGE, sorting sensor SECO, ¥ 500 sensor SE500, ¥ 100 sensor SE100, ¥ 10 sensor SE10, ¥ 50 sensor SE50, ¥ 500 overflow sensor OFS500, ¥ 100 overflow sensor OFS100, ¥ 10 overflow sensor OFS10, and ¥ 50 overflow sensor OFS50. On the basis of the outputs of these sensors, the control unit 100 controls the belt conveyance motor MO, shutter solenoid SOLSH, true/false coin solenoid SOLSF, ¥ 500 solenoid SOL500, ¥ 100 solenoid SOL100, ¥ 10 solenoid SOL10, and ¥ 50 solenoid SOL50.

The control unit 100 receives as its input the output of the mode selection switch SWMO, and controls the coin paying-out mode in response to the changeover mode of the mode selection switch SWMO.

In addition, the control unit 100 switches over the coin-sorting accuracy by making use of the outputs of the internal auxiliary unit inventory switch DE, external auxiliary unit inventory switch ZDW, ¥ 500 inventory switch IV500, ¥ 100 inventory switch IV100, ¥ 10 inventory switch IV10, and ¥ 50 inventory switch IV50.

Referring now to flowcharts shown in FIGS. 13 to 30, a description will be given of the operation of the above-described control unit 100.

Figure 13:
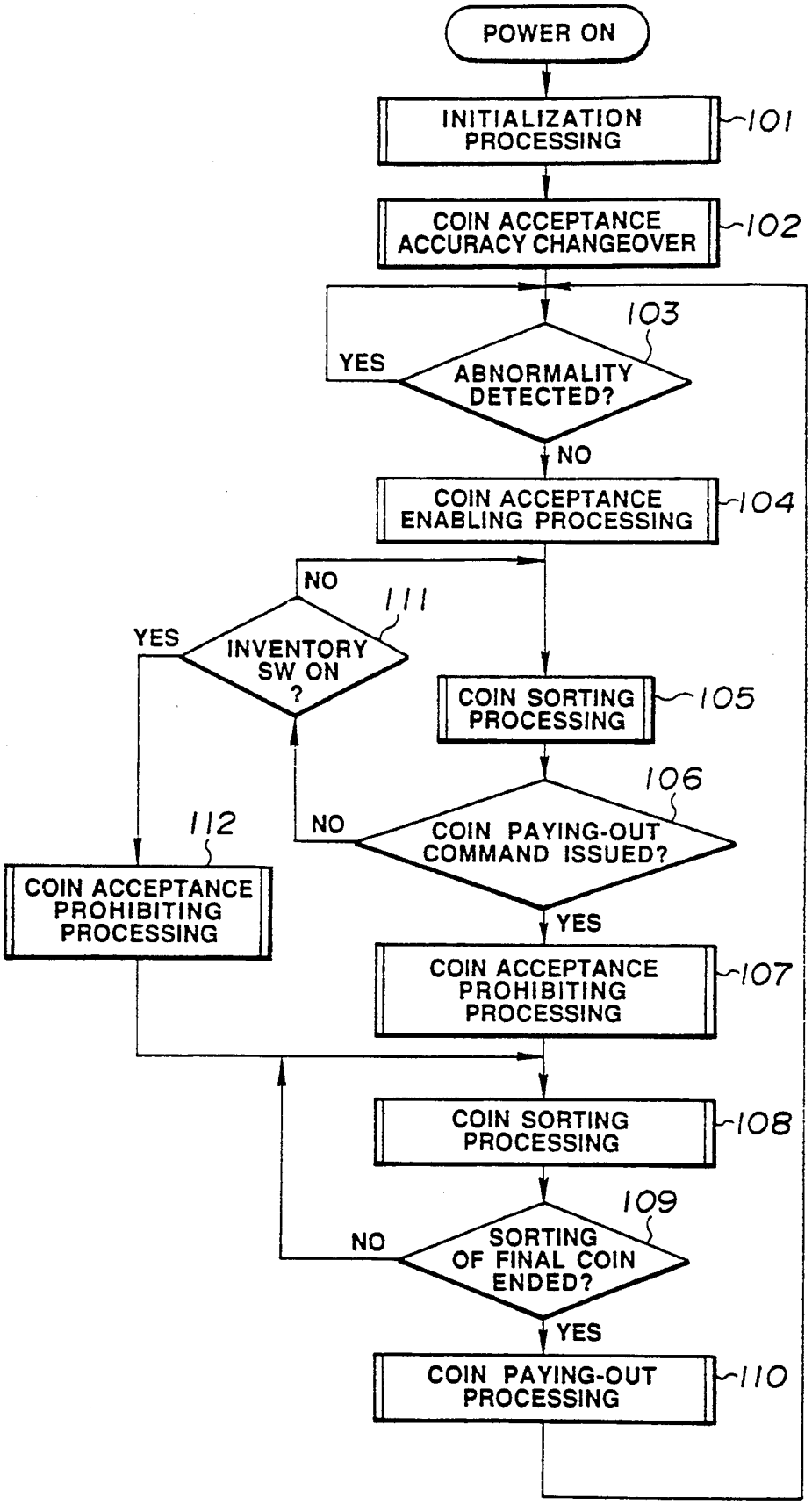
FIG. 13 is a main flowchart illustrating the operation of this embodiment.

FIG. 13 shows a main flow of this embodiment. In FIG. 13, when the power source of the apparatus is turned on, predetermined initialization processing is first executed (Step 101), and changeover of coin acceptance accuracy is then effected, as required (Step 102). Details of the changeover of coin acceptance accuracy are shown in FIGS. 14 to 17 which will be described later.

Next, abnormalities of various component parts of the apparatus are checked (Step 103). If abnormalities are not detected in the abnormality check, coin acceptance enabling processing for enabling the acceptance of the coin is executed (Step 104).

At this juncture, if a coin is inserted, coin sorting processing is executed (Step 105). Details of coin sorting processing are shown in FIGS. 18 to 29. Subsequently, a determination is made as to whether or not a coin paying-out command has been issued (Step 106). If the coin paying-out command has been issued, coin acceptance prohibiting processing for prohibiting the acceptance of a coin is executed (Step 107).

Meanwhile, if it is determined in Step 106 that the coin paying-out con, hand has not been issued, a determination is then made as to whether or not any inventory switch has been turned on (Step 10). If an inventory switch has been turned on, coin acceptance prohibiting processing for prohibiting the acceptance of the coin is executed (Step 112).

The reason for executing coin acceptance prohibiting processing in Steps 107 and 112 is because control would become impossible if a coin is inserted during a coin paying-out operation or an inventory operation.

After execution of coin acceptance prohibiting processing, coin sorting processing is executed again (Step 108). The reason for executing coin sorting processing in this step is to sort a coin which was inserted before the acceptance of a previous coin is effected and for which sorting processing has not been completed.

Figure 30:
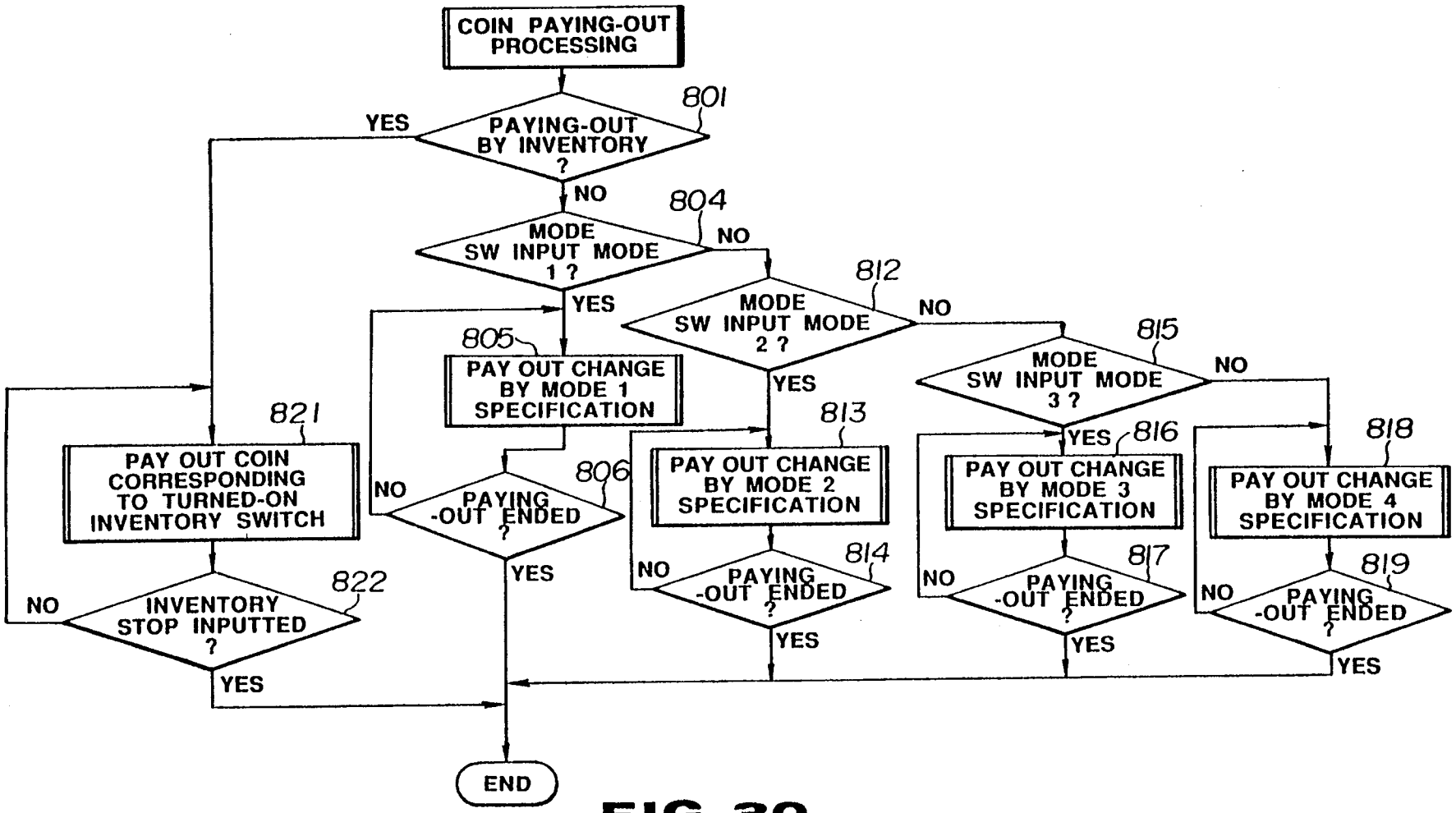
FIG. 30 is a flowchart illustrating the details of coin paying-out processing in the main flowchart shown in FIG. 13.

Upon completion of the sorting of a final coin through coin sorting processing (Step 109), coin paying-out processing is executed (Step 110). Details of coin paying-out processing are shown in FIG. 30 which will be described later.

Changeover of Coin Acceptance Accuracy

Details of an operation of changing over coin acceptance accuracy are shown in FIGS. 14 to 17. This changeover of coin acceptance accuracy is effected by making use of the inventory switches provided for collecting the coins in the respective tubes. The inventory switches include the following: the internal auxiliary unit inventory switch DE for commanding the operation of collecting the coins accommodated in the internal auxiliary unit (corresponding to the auxiliary tubes CTD, CTE shown in FIG. 7), the external auxiliary unit inventory switch ZDW for commanding the operation of collecting the coins accommodated in an unillustrated external auxiliary unit, the ¥ 500 inventory switch IV500 for commanding the operation of collecting the coins accommodated in the ¥ 500 tube CT500, the ¥ 100 inventory switch IV100 for commanding the operation of collecting the coins accommodated in the ¥ 100 tube CT100, the ¥ 10 inventory switch IV10 for commanding the operation of collecting the coins accommodated in the ¥ 10 tube CT10, and the ¥ 50 inventory switch IV50 for commanding the operation of collecting the coins accommodated in the ¥ 50 tube CT50.

Since the inventory switches are provided for collecting coins to be used as change, as described above, it is necessary to distinguish between the intrinsic operation for collecting the coins to be used as change and the operation for changing over coin acceptance accuracy. In addition, since a changeover to the coin acceptance accuracy change-over mode should not be effected during a normal operation, an arrangement is provided such that a changeover to the coin acceptance accuracy changeover mode cannot be made unless the following procedure is taken. That is, the arrangement provided is such that the changeover to the coin acceptance accuracy changeover mode can be effected only when the internal auxiliary unit inventory switch DE and the external auxiliary unit inventory switch ZDW are turned on and the power source is then turned on.

Figure 14:
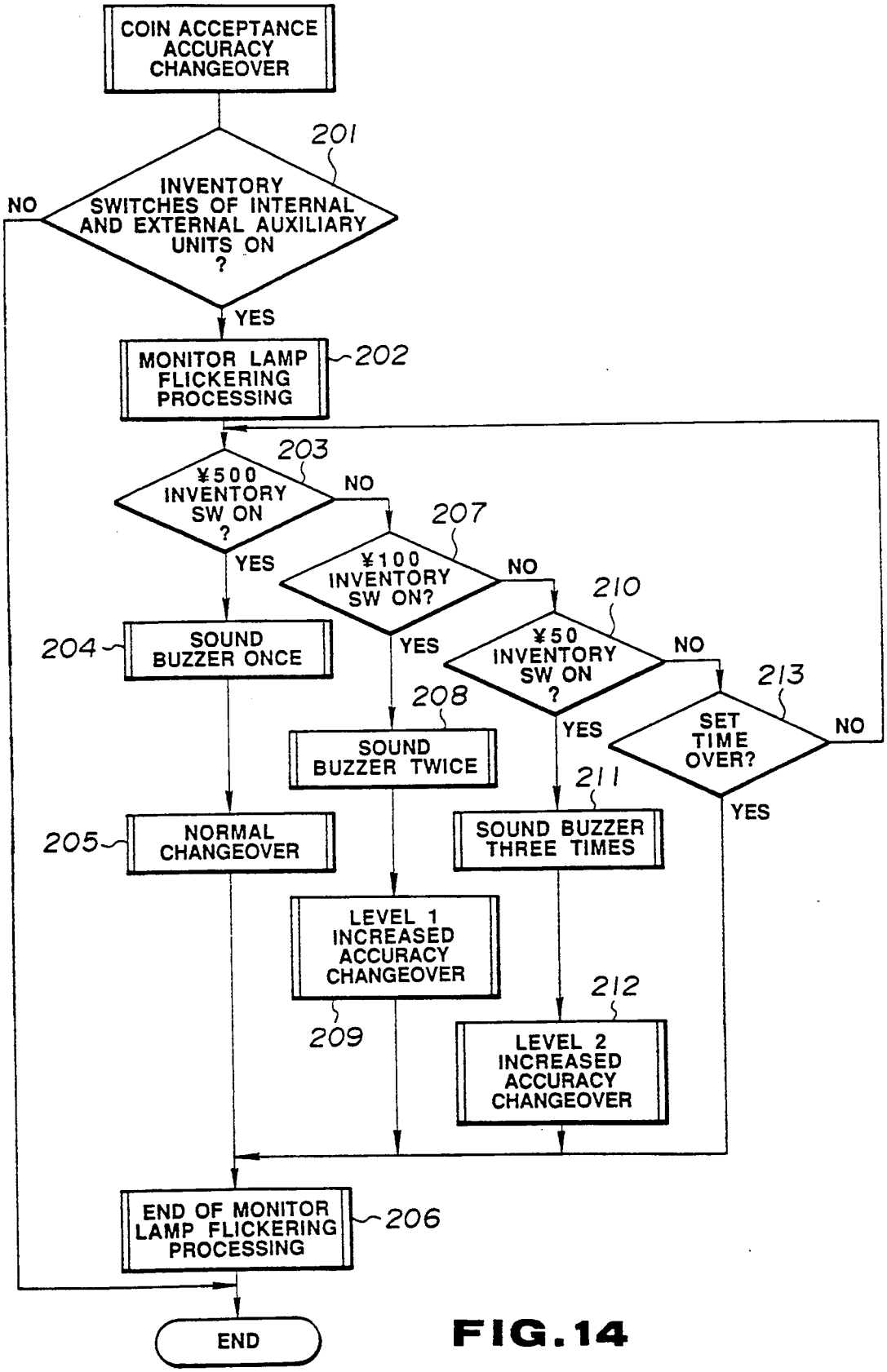
FIG. 14 is a flowchart illustrating the details of coin acceptance accuracy changeover in the main flowchart shown in FIG. 13.

In FIG. 14, a determination is first made as to whether or not both the internal auxiliary unit inventory switch DE and the external auxiliary unit inventory switch ZDW have been turned on (Step 201). If both the internal auxiliary unit inventory switch DE and the external auxiliary unit inventory switch ZDW have been turned on, monitor-lamp flickering processing for controlling the flickering of an unillustrated monitor lamp is executed (Step 202).

Through the flickering of the monitor lamp, the operator ascertains that the mode has been set to the coin acceptance accuracy changeover mode.

In this embodiment, an arrangement is provided such that the turning on of the ¥500 inventory switch IV500 effects a changeover to a normal changeover mode for switching to normal accuracy, the turning on of the ¥100 inventory switch IV100 effects a changeover the to a level-1 increased accuracy mode for switching to level-1 increased accuracy, and the turning on of the ¥50 inventory switch IV50 effects a changeover to a level-2 increased accuracy mode for switching to level-2 increased accuracy. The normal accuracy referred to herein is the normal accuracy of coin acceptance, and the level 1 increased accuracy is made stricter in coin acceptance than the normal accuracy and is particularly aimed at eliminating counterfeit coins. The level 2 increased accuracy is designed to virtually prohibit the acceptance of such a coin deposited. By setting the level 2 increased accuracy, the number of the types of denominations of acceptable coins can be restricted to from four to one.

Figure 15:
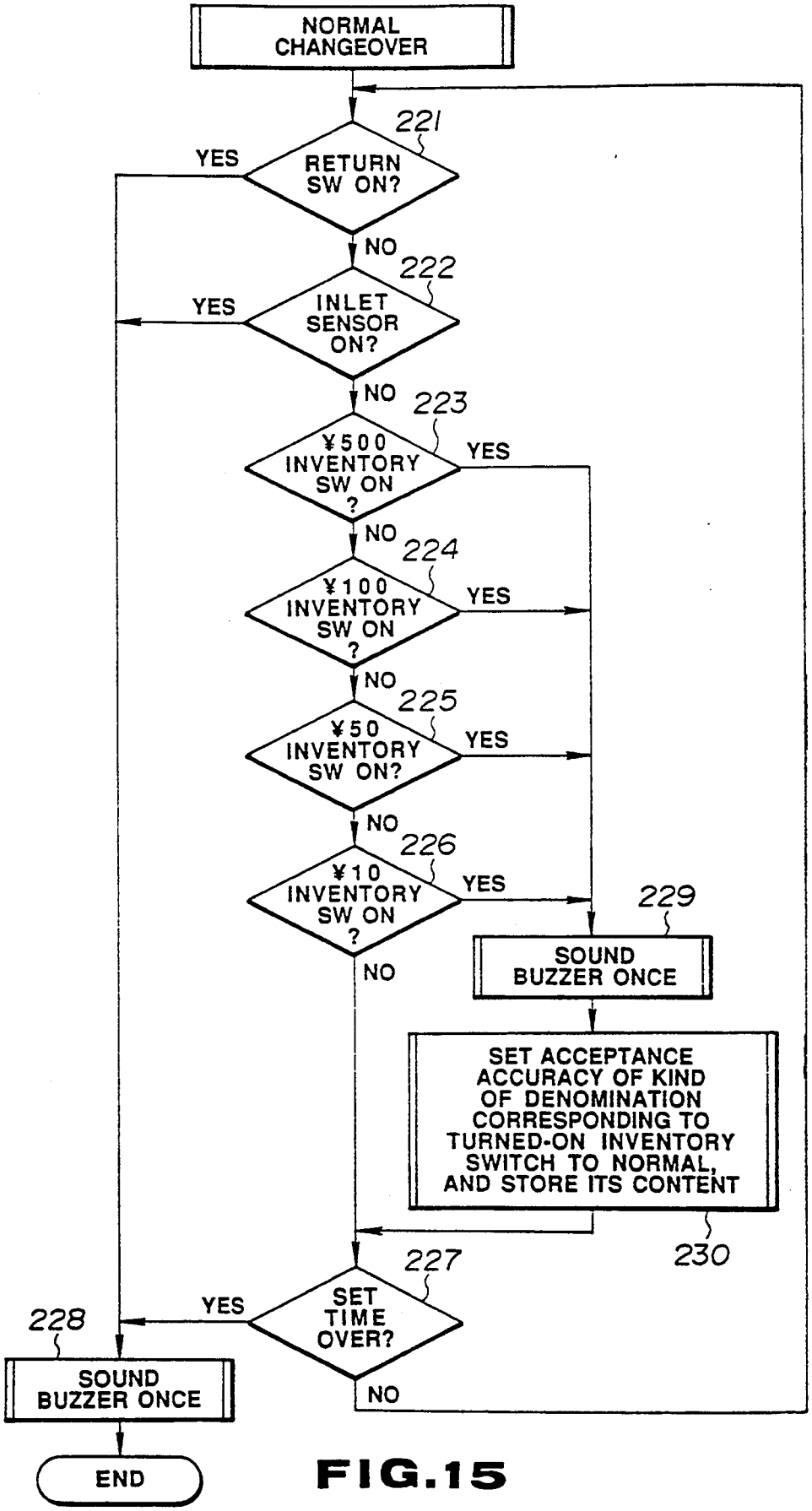
FIG. 15 is a flowchart illustrating the details of normal changeover in the flowchart shown in FIG. 14.
Figure 16:
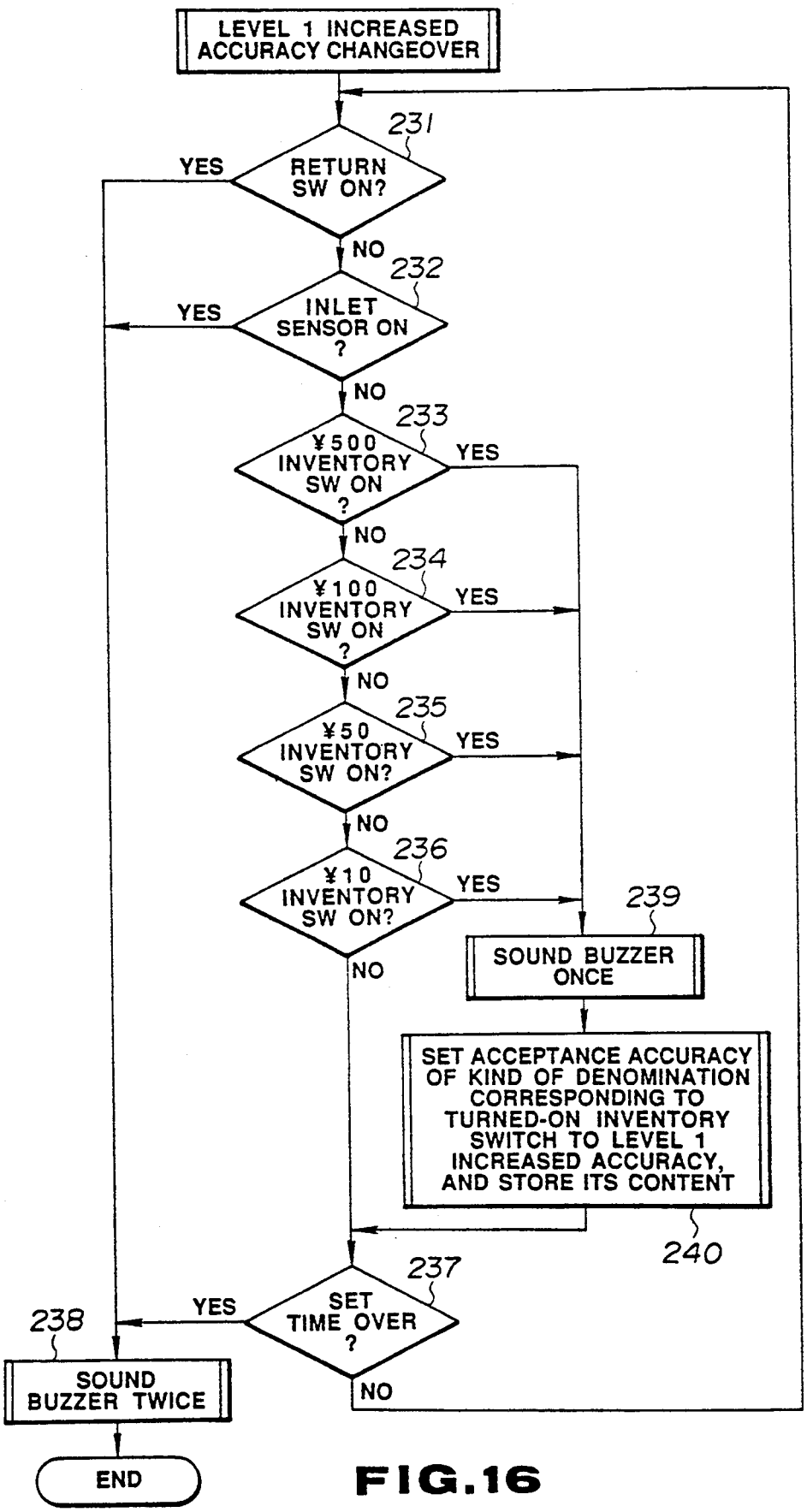
FIG. 16 is a flowchart illustrating the details of level-1 increased accuracy in the flowchart shown in FIG. 14.
Figure 17:
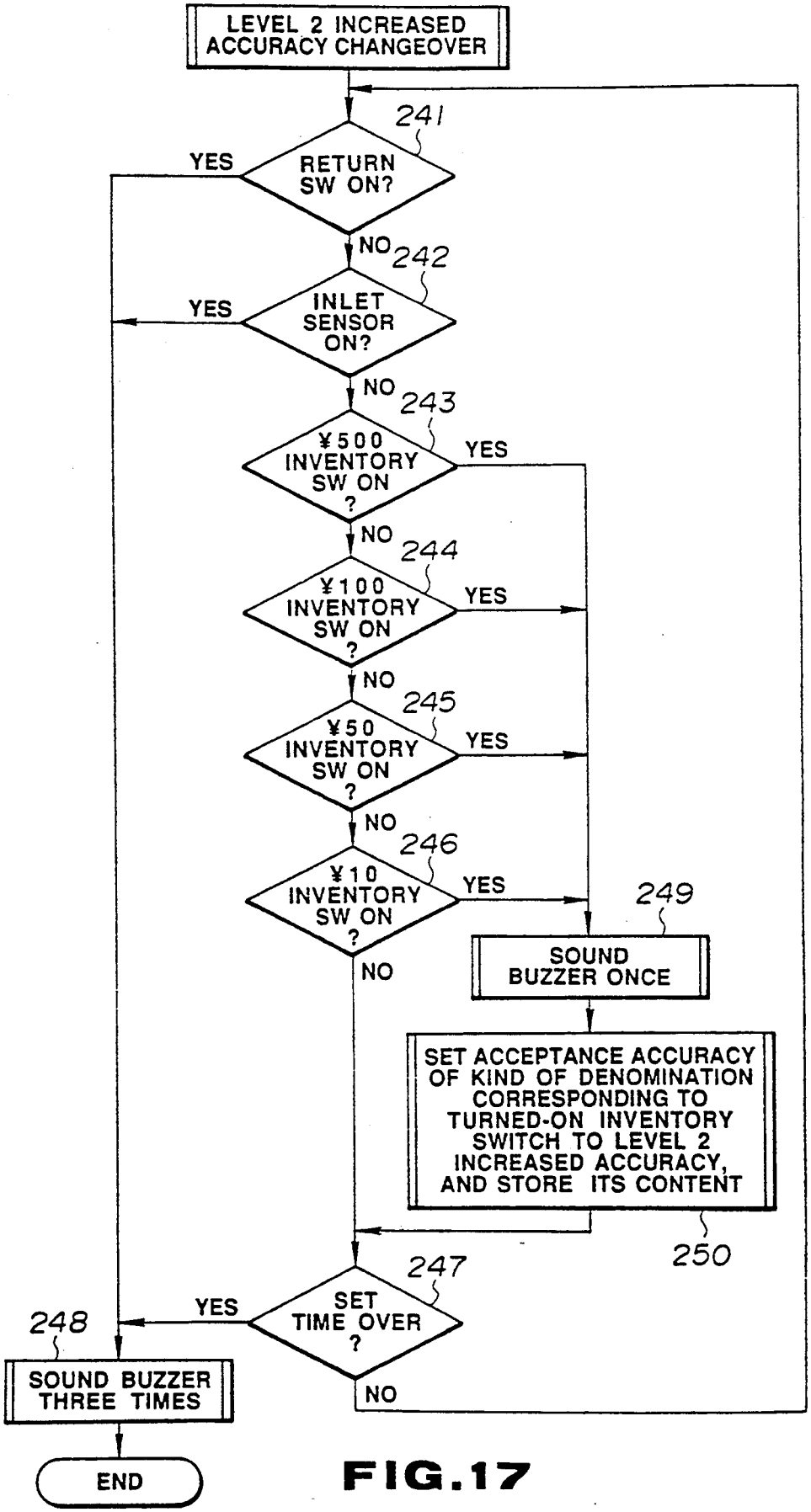
FIG. 17 is a flowchart illustrating the details of changeover to level-2 increased accuracy in the flowchart shown in FIG. 14.

In the coin acceptance accuracy changeover mode, if the ¥ 500 inventory switch IV500 has been turned on (Step 203), a buzzer is sounded once (Step 204), and the operation proceeds to a normal changeover (Step 205). If the ¥ 100 inventory switch IV100 has been turned on (Step 207), the buzzer is sounded twice (Step 208), and the operation proceeds to a changeover to the level-1 increased accuracy (Step 209). When the ¥ 50 inventory switch IV50 has been turned on (Step 210), the buzzer is sounded three times (Step 211), and the operation proceeds to the level 2 increased accuracy (Step 212). Details of the normal changeover are shown in FIG. 15, details of the level-1 increased accuracy are shown in FIG. 16, and details of the level-2 increased accuracy are shown in FIG. 17. It should be noted that upon completion of each changeover operation or in the event that a predetermined time has elapsed without the turning on of any of the ¥ 500 inventory switch IV500, ¥ 100 inventory switch IV100, and ¥ 50 inventory switch IV50 after the mode has been set to the coin acceptance changeover mode (Step 213), the monitor-lamp flickering processing ends (Step 206), thereby completing this coin acceptance changeover flow.

Normal Changeover

In the normal changeover mode shown in FIG. 15, when the ¥ 500 inventory switch IV500 is turned on, the sorting accuracy with respect to the ¥ 500 coin is changed over to the normal accuracy. When the ¥ 100 inventory switch IV100 is turned on, the sorting accuracy with respect to the ¥ 100 coin is changed over to the normal accuracy. When the ¥ 50 inventory switch IV50 is turned on, the sorting accuracy with respect to the ¥ 50 coin is changed over to the normal accuracy. When the ¥ 10 inventory switch IV10 is turned on, the sorting accuracy with respect to the ¥ 10 coin is changed over to the normal accuracy. In addition, in the event that an unillustrated return switch, which is turned on to command the return of the coin, has been turned on, or in the event that a coin is inserted into the coin slot and the inlet sensor SEIN has been turned on, this normal changeover mode is forcedly canceled.

That is, in FIG. 15, a determination is first made as to whether or not the return switch has been turned on (Step 221), and if the return switch has not been turned on, a determination is then made as to whether or not the inlet sensor SEIN has been turned on (Step 222). At this juncture, if the inlet sensor SEIN has not been turned on, either, determinations are consecutively made as to whether or not the ¥ 500 inventory switch IV500 has been turned on (Step 223), the ¥ 100 inventory switch IV100 has been turned on (Step 224), the ¥ 50 inventory switch IV50 has been turned on (Step 225), and the ¥ 10 inventory switch IV10 has been turned on (Step 226). If any of the ¥ 500 inventory switch IV500, ¥ 100 inventory switch IV100, ¥ 50 inventory switch IV50, and ¥ 10 inventory switch IV10 has been turned on, the buzzer is sounded once (Step 229), the accuracy of acceptance of the coin of the type of denomination corresponding to the inventory switch turned on is changed over to normal accuracy, and its content is stored in an unillustrated control memory (Step 230). As a result, the accuracy of acceptance of the respective coins is thereafter changed over on the basis of the acceptance accuracy stored in the control memory.

If the return switch or the inlet sensor SEIN has been turned on (Steps 221, 222), or in the even that none of the ¥ 500 inventory switch IV500, ¥ 100 inventory switch IV100, ¥ 50 inventory switch IV50, and ¥ 10 inventory switch IV10 has been turned on even after the lapse of a predetermined time subsequent to a changeover to the normal changeover mode (Step 227), the buzzer is sounded once (Step 228), thereby completing the normal changeover mode.

Changeover to Level-1 Increased Accuracy

In the level-1 increased accuracy changeover mode shown in FIG. 16, if the ¥ 500 inventory switch IV500 is turned on, the sorting accuracy with respect to the ¥500 coin is changed over to the level-1 increased accuracy. If the ¥ 100 inventory switch IV100 is turned on, the sorting accuracy with respect to the ¥ 100 coin is changed over to the level-1 increased accuracy. If the ¥ 50 inventory switch IV50 is turned on the sorting accuracy with respect to the ¥ 50 coin is changed over to the level-1 increased accuracy. If the ¥ 10 inventory switch IV10 is turned on, the sorting accuracy with respect to the ¥ 10 coin is changed over to the level-1 increased accuracy. In addition, in the event that the unillustrated return switch for commanding the return of the coin has been turned on, or in the event that a coin is inserted into the coin slot and the inlet sensor SEIN has been turned on, this level-1 increased accuracy is forcedly canceled.

That is, in FIG. 16, a determination is first made as to whether or not the return switch has been turned on (Step 231), and if the return switch has not been turned on, a determination is then made as to whether or not the inlet sensor SEIN has been turned on (Step 232). If the inlet sensor SEIN has not been turned on, either, determinations are consecutively made as to whether or not the ¥ 500 inventory switch IV500 has been turned on (Step 233), the ¥ 100 inventory switch IV100 has been turned on (Step 234), the ¥ 50 inventory switch IV50 has been turned on (Step 235), and the ¥ 10 inventory switch IV10 has been turned on (Step 236). If any of the ¥ 500 inventory switch IV500, ¥ 100 inventory switch IV100, ¥ 50 inventory switch IV50, and ¥ 10 inventory switch IV10 has been turned on, the buzzer is sounded once (Step 239), the accuracy of acceptance of the coin of the type of denomination corresponding to the inventory switch turned on is changed over to the level-1 increased accuracy, and its content is stored in the unillustrated control memory (Step 240). As a result, the accuracy of acceptance of the coins is thereafter controlled on the basis of the acceptance accuracy stored in the control memory.

In the event that the return switch or the inlet sensor SEIN has been turned on (Steps 231, 23), or in the event that any of the ¥ 500 inventory switch IV500, ¥ 100 inventory switch IV100, ¥ 50 inventory switch IV50, ¥ 10 inventory switch IV10 has not been turned on even after the lapse of a predetermined time subsequent to a changeover to the normal changeover mode (Step 237), the buzzer is sounded twice (Step 238), thereby completing the changeover mode to the level-1 increased accuracy

Changeover to Level-2 Increased Accuracy

In the level-2 increased accuracy changeover mode shown in FIG. 17, if the ¥ 500 inventory switch IV500 is turned on, the sorting accuracy with respect to the ¥ 500 coin is changed over to the level-2 increased accuracy. When the ¥ 100 inventory switch IV100 is turned on, the sorting accuracy with respect to the ¥ 100 coin is changed over to the level-2 increased accuracy. When the ¥ 50 inventory switch IV50 is turned on, the sorting accuracy with respect to the ¥ 50 coin is changed over to the level-2 increased accuracy. When the ¥ 10 inventory switch IV10 is turned on, the sorting accuracy with respect to the ¥ 10 coin is changed over to the level-2 increased accuracy. In addition, when the unillustrated return switch which is turned on for commanding the return of the coin is turned on, or a coin is inserted into the coin slot and the inlet sensor SEIN has been turned on, this changeover mode to the level-2 increased accuracy is forcedly canceled.

That is, in FIG. 17, a determination is first made as to whether or not the return switch has been turned on (Step 241), and if the return switch has not been turned on, a determination is then made as to whether or not the inlet sensor SEIN has been turned on (Step 242). If the inlet sensor SEIN has not been turned on, either, determinations are consecutively made as to whether or not the ¥ 500 inventory switch IV500 has been turned on (Step 243), the ¥ 100 inventory switch IV100 has been turned on (Step 244), the ¥ 50 inventory switch IV50 has been turned on (Step 245), and the ¥ 10 inventory switch IV10 has been turned on (Step 246). If any of the ¥ 500 inventory switch IV500, ¥ 100 inventory switch IV100, ¥ 50 inventory switch IV50, and ¥ 10 inventory switch IV10 has been turned on, the buzzer is sounded once (Step 249), the accuracy of acceptance of the coin of the type of denomination corresponding to the inventory switch turned on is changed over to the level-2 increased accuracy, and its content is stored in the unillustrated control memory (Step 250). As a result, the accuracy of acceptance of the respective coins is thereafter changed over on the basis of the acceptance accuracy stored in the control memory.

In the event that the return switch or the inlet sensor SEIN has been turned on (Steps 241, 242), or in the event that none of the ¥ 500 inventory switch IV500, ¥ 100 inventory switch IV100, ¥ 50 inventory switch IV50, and ¥ 10 inventory switch IV10 has been turned on even after the lapse of a predetermined time subsequent to a changeover to the normal changeover mode (Step 247), the buzzer is sounded three times (Step 248), thereby completing this changeover mode to the level-2 increased accuracy.

Coin Sorting Processing

Figure 18:
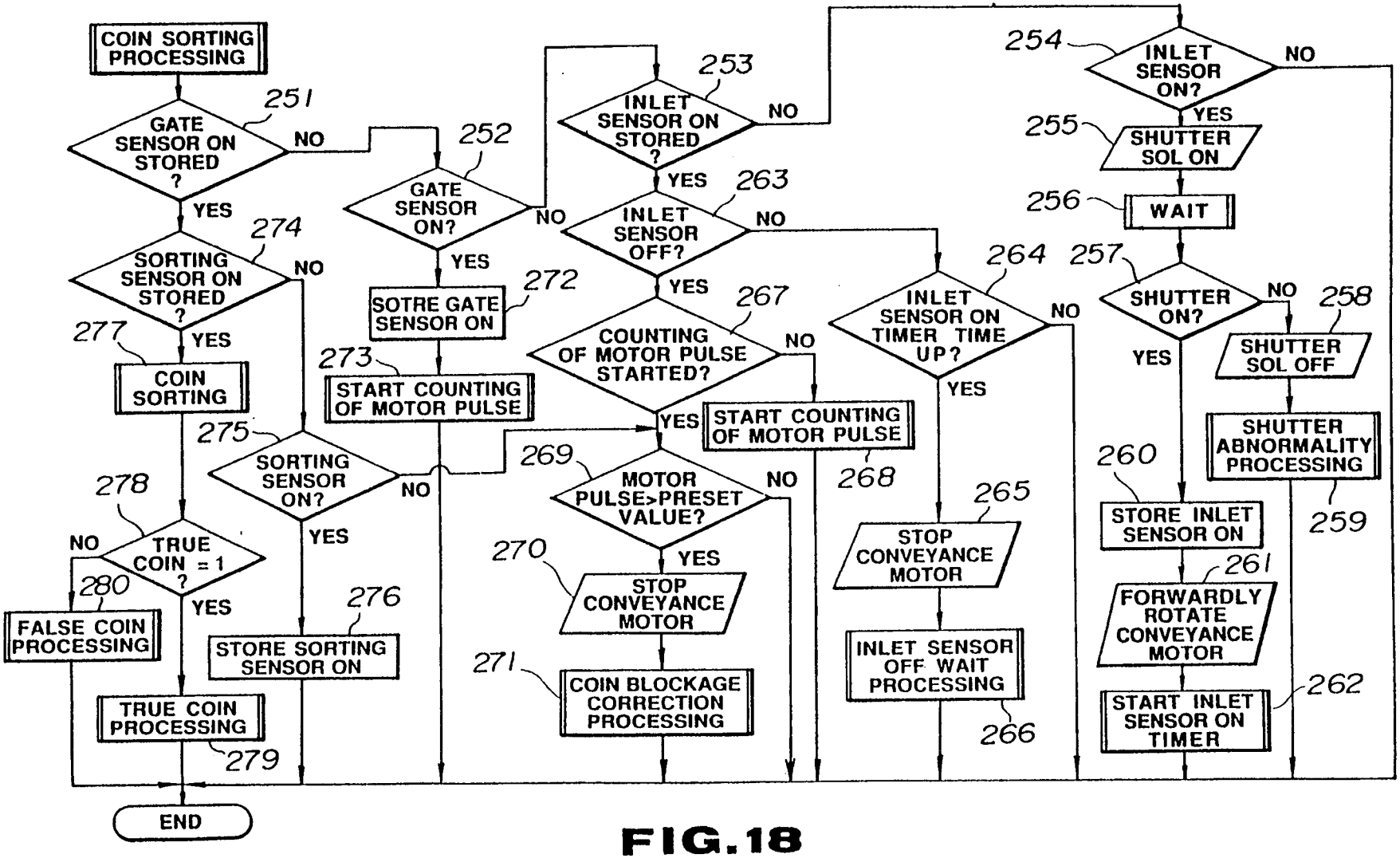
FIG. 18 is a flowchart illustrating the details of coin sorting processing in the flowchart shown in FIG. 13.

Coin sorting processing is shown in FIG. 18. This coin sorting processing is so arranged as to be started upon the turning on of the gate sensor SEGE disposed along the belt conveying passage 14, as described before.

In FIG. 18, a determination is first made as to whether or not memory of the gate sensor "on" indicating that the gate sensor SEGE has been turned on is present (Step 251). If the memory of the gate sensor "on" is not present, a determination is then made as to whether or not the gate sensor SEGE has been turned on (Step 252). If the gate sensor SEGE has not been turned on, a determination is then made as to whether or not memory of the inlet sensor "on" indicating that the inlet sensor SEIN has been turned on is present (Step 253). If the memory of the inlet sensor "on" is not present, a determination is then made as to whether or not the inlet sensor SEIN has been turned on (Step 254). If the inlet sensor SEIN has not been turned on, it means that the operating state of the apparatus is the standby state in which no coins have been inserted through the coin slot 11, so that the flow of coin sorting processing ends. This coin sorting processing is repeated until a coin paying-out command is issued, as shown in FIG. 13.

When a coin is inserted through the coin slot 11, and the inlet sensor SEIN is thereby turned on, in an ensuing coin sorting process this state is determined in Step 254, and the shutter solenoid SOLSH is turned on (Step 255). After a fixed duration (Step 256), when the shutter sensor SESH is turned on (Step 257), the memory of the inlet sensor "on" is set to "present" (Step 260), the conveyance motor MO for driving the belt conveying passage 14 is rotated forwardly (Step 261), and an unillustrated inlet sensor "on" timer is started (Step 262). This inlet sensor "on" timer is desired to detect the blockage of a coin in a portion where the inlet sensor SEIN is disposed or an unauthorized operation of a coin in the portion where the inlet sensor SEIN is disposed. This inlet sensor "on" timer can be realized as a softwarewise timer in the control unit 100.

It should be noted that if the shutter sensor SESH is not turned on after a fixed duration upon the turning on of the shutter solenoid SOLSH, the shutter solenoid SOLSH is turned off (Step 258), and predetermined shutter abnormality processing is executed (Step 259).

If the memory of the inlet sensor "on" is set to "present," in the next coin sorting processing, it is determined in Step 253 that the memory of the inlet sensor "on" is present. In this case, a determination is then made as to whether or not the inlet sensor SEIN has been turned off (Step 263), and if it has been turned off, a determination is made as to whether or not the counting of motor pulses for detecting the amount of the belt conveying passage 14 conveyed by the conveyance motor MO has been started (Step 267). Here, since the counting of motor pulses has not been started, the counting of motor pulses is started (Step 268).

It should be noted that if it is determined in Step 263 that the inlet sensor SEIN has not been turned off, a determination is made as to whether or not the time of the inlet sensor "on" timer started in Step 262 is up (Step 264). If the time is up, the conveyance motor MO is stopped (Step 265), wait processing for inlet sensor off to wait for the turning off of the inlet sensor SEIN is executed (Step 266).

In addition, if it is determined in Step 267 that the counting of motor pulses has already been started, a determination is made as to whether or not the count value of motor pulses is greater than a predetermined value (Step 269). If YES is the answer, the conveyance motor MO is stopped (Step 270), and predetermined coin blockage correction processing is subsequently executed (Step 271). The details of this coin blockage correction processing will be described later with reference to FIG. 29.

When the coin being conveyed on the belt conveying passage 14 is detected by the gate sensor SEGE, and the gate sensor SEGE is thereby turned on (Step 252), the memory of the gate sensor "on" indicating that the gate sensor SEGE has been turned on is set to "present" (Step 272). Then, the counting of motor pulses for detecting the amount of the belt conveying passage 14 conveyed by the conveyance motor MO is started (Step 273).

If it is determined in the next coin sorting processing that the memory of the gate sensor "on" is present (Step 251), a determination is made as to whether or not memory of the sorting sensor "on" indicating that the coin has been detected by the sorting sensor SECO is present (Step 274). If the memory of the sorting sensor "on" is not present, a determination is then made as to whether or not the coin has been detected by the sorting sensor SECO (i.e., whether or not the sorting sensor SECO has been turned on) (Step 275). If the sorting sensor SECO has been turned on, a setting is provided that the memory of the sorting sensor "on" is present (Step 276). However, if the sorting sensor SECO has not been turned on, a determination is made as to whether or not the count value of motor pulses is greater than a predetermined value (Step 269). If YES is the answer, the conveyance motor MO is stopped (Step 270), and predetermined coin blockage correction processing is subsequently executed (Step 271). It should be noted that if the count value of motor pulses is smaller than the predetermined value, this coin sorting processing ends, and the operation waits for the turning on of the sorting sensor SECO.

When the sorting sensor SECO is turned on, and a setting is provided that the memory of the sorting sensor "on," in the next coin processing, it is determined in Step 274 that the memory of the sorting sensor "on" is present, and "coin sorting" is executed (Step 277). In this "coin sorting," the determination and storage of a true or false coin on the basis of the output of determination by the sorting sensor SECO as well as the setting and storage of the state of allowance of attraction (energization) by the ¥ 500 solenoid SOL500, ¥ 100 solenoid SOL100, ¥ 10 solenoid SOL10, and ¥ 50 solenoid SOL50 are carried out. In the true coin processing and false coin processing which will be described later, on the basis of the state of this storage, control is effected with respect to the ¥ 500 solenoid SOL500, ¥ 100 solenoid SOL100, ¥ 10 solenoid SOL10, ¥ 50 solenoid SOL50, and true/false coin solenoid SOLSF. The details of this coin sorting are shown in FIGS. 19 to 23 which will be described later.

If a sorted coin is set to be a true coin, i.e., "true coin=1" in the "coin sorting" (Step 278), true coin processing is subsequently executed (Step 279). In the true coin processing, the true/false coin solenoid SOLSF is turned on, and the true coin is introduced to the true coin passage PS by the true/false coin distributing lever LVSF, so as to execute the distributing processing of the true coin. The details of this true coin processing are shown in FIGS. 24 to 28.

Meanwhile, if a sorted coin is set to be a false coin, i.e., "true coin=0" in the "coin sorting" (Step 278), false coin processing is subsequently executed (Step 278). In the false coin processing, the true/false coin solenoid SOLSF remains off, and the false coin is introduced to the false coin passage PF by the true/false coin distributing lever LVSF.

Coin Sorting

Figure 19:
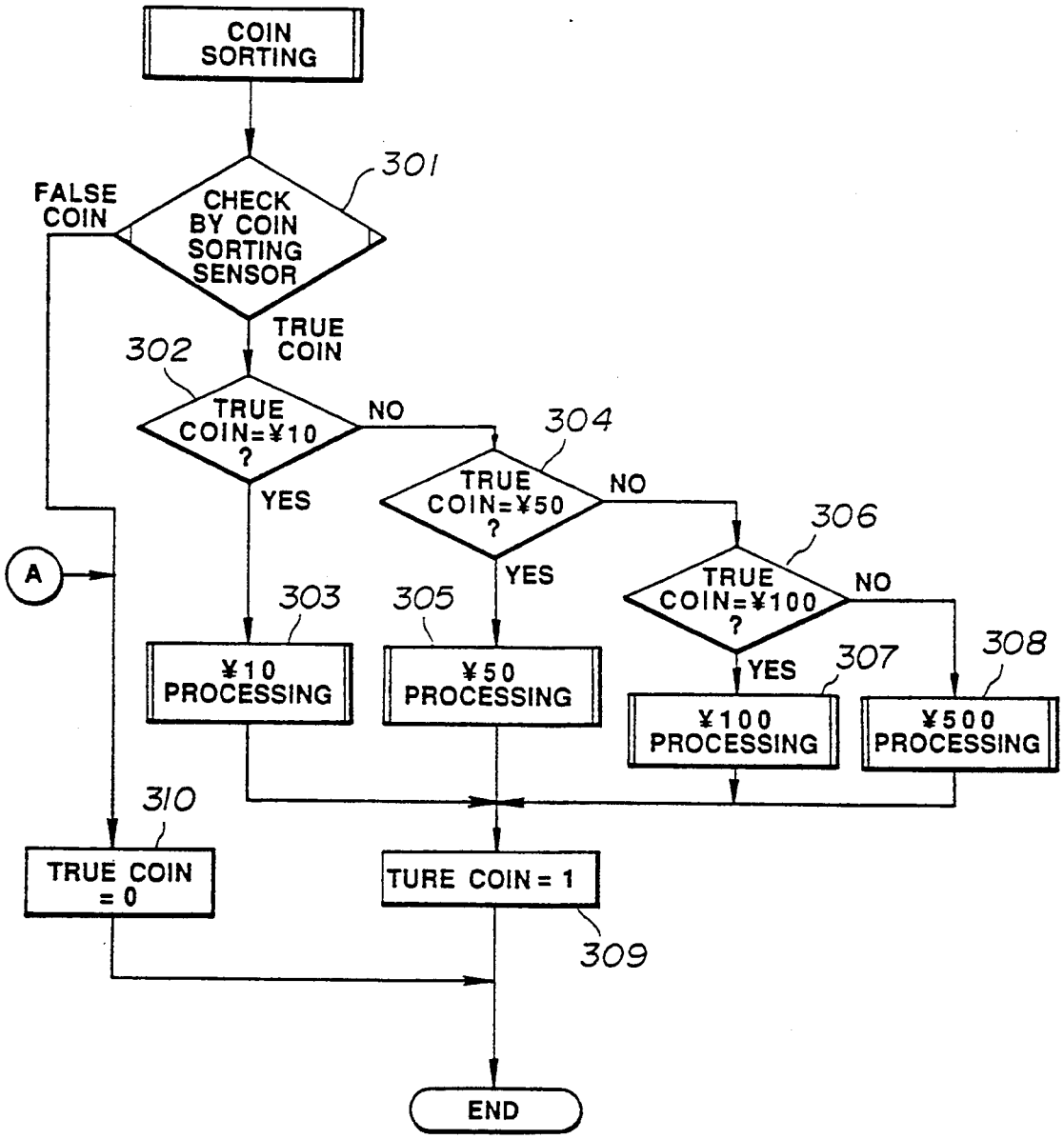
FIG. 19 is a flowchart illustrating the details of coin sorting processing in the flowchart shown in FIG. 18.
Figure 20:
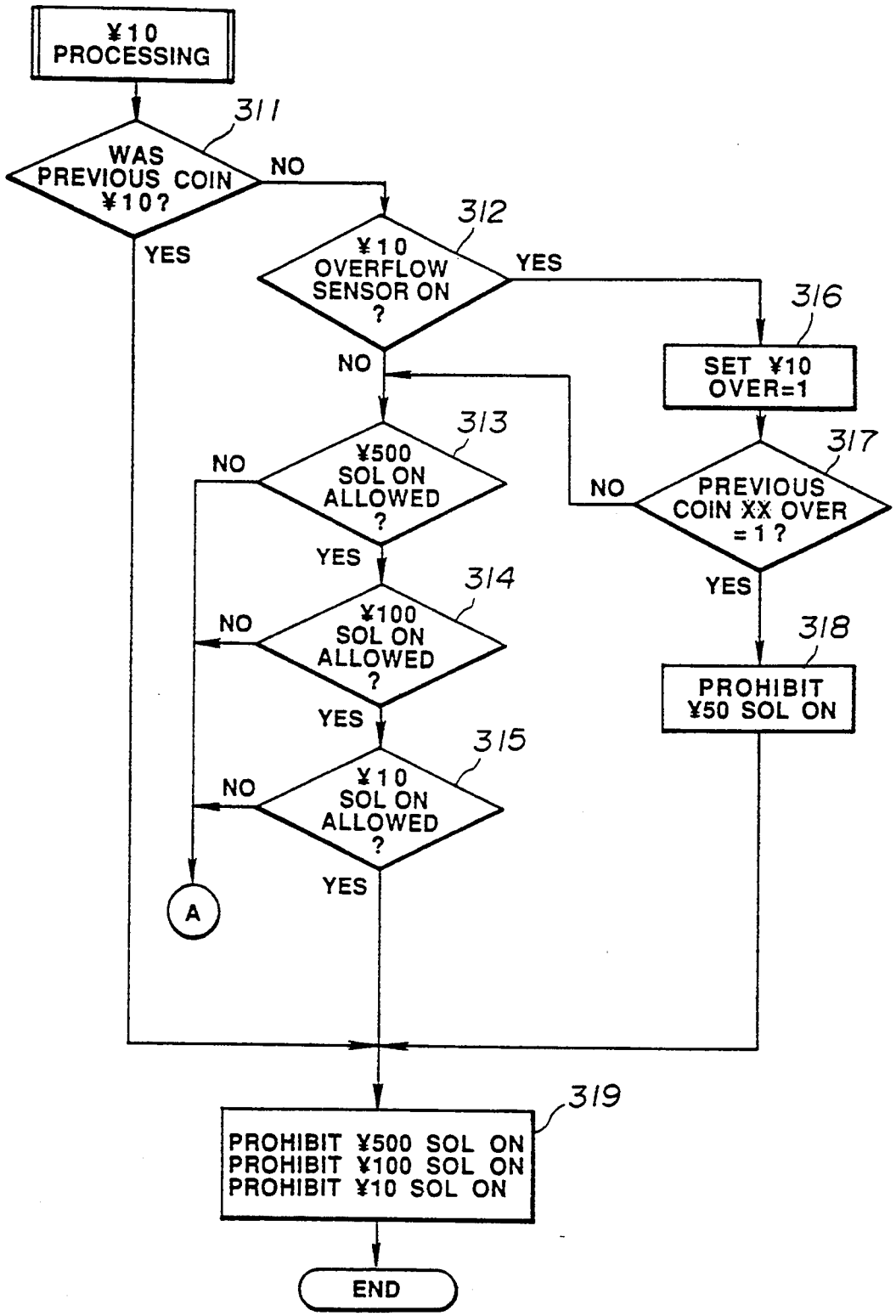
FIG. 20 is a flowchart illustrating the details of ¥ 10 processing in the flowchart shown in FIG. 19.

As shown in FIG. 19, in the coin sorting, a discrimination between a true coin and a false coin is made on the basis of the output of determination by the sorting sensor SECO (Step 301). Here, the coin is determined to be a true coin, a determination is made as to whether or not it is ¥ 10 (Step 302). If it is ¥ 10, predetermined ¥ 10 processing is executed (Step 303) . The details of this ¥ 10 processing are shown in FIG. 20.

Figure 21:
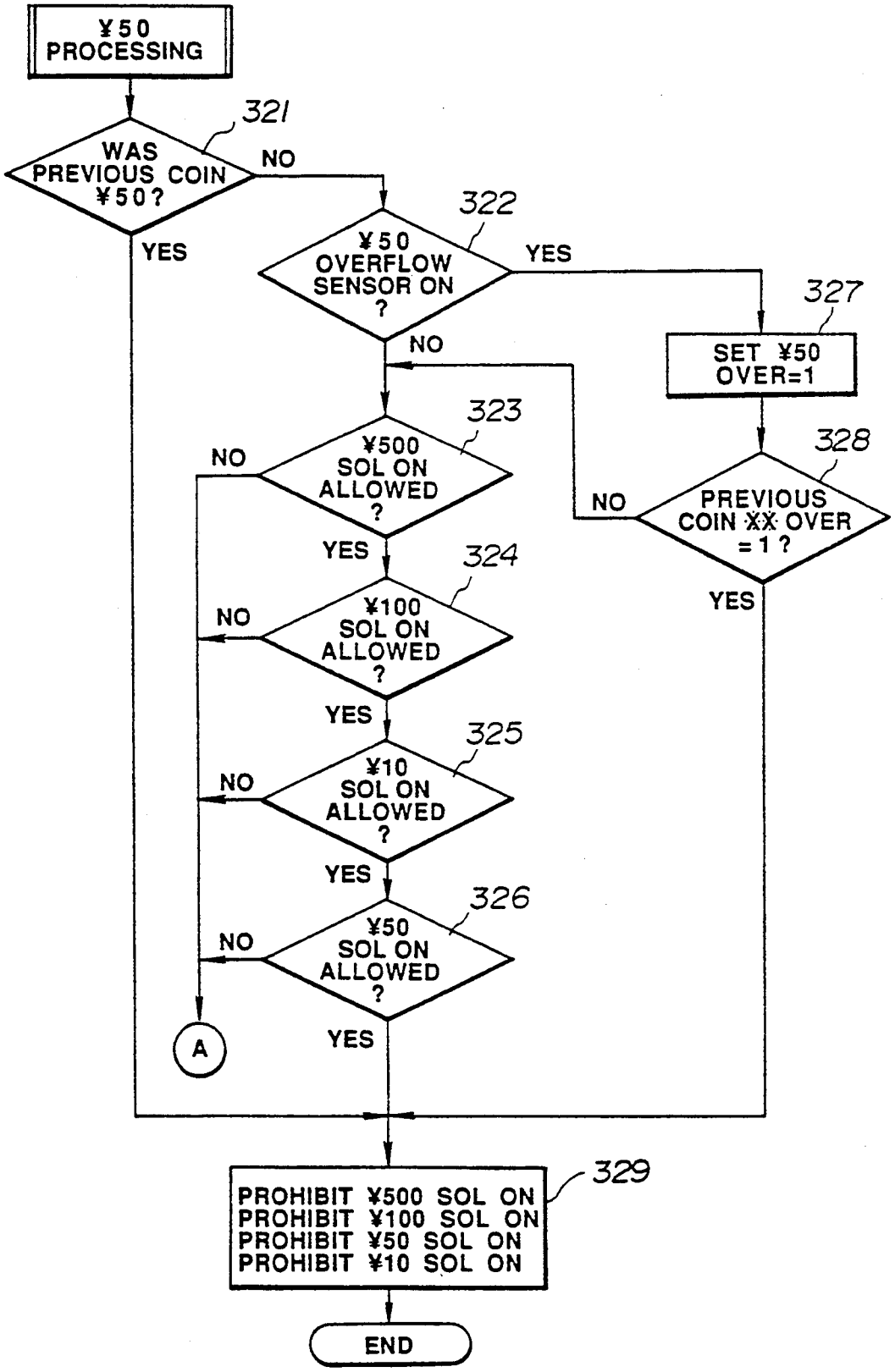
FIG. 21 is a flowchart illustrating the details of ¥ 50 processing in the flowchart shown in FIG. 19.

Meanwhile, if it is determined in Step 302 that the true coin is not ¥ 10, a determination is then made as to whether or not this true coin is ¥ 50 (Step 304). If it is ¥50, predetermined ¥ 50 processing is executed (Step 305). The details of this ¥ 50 processing are shown in FIG. 21.

Figure 22:
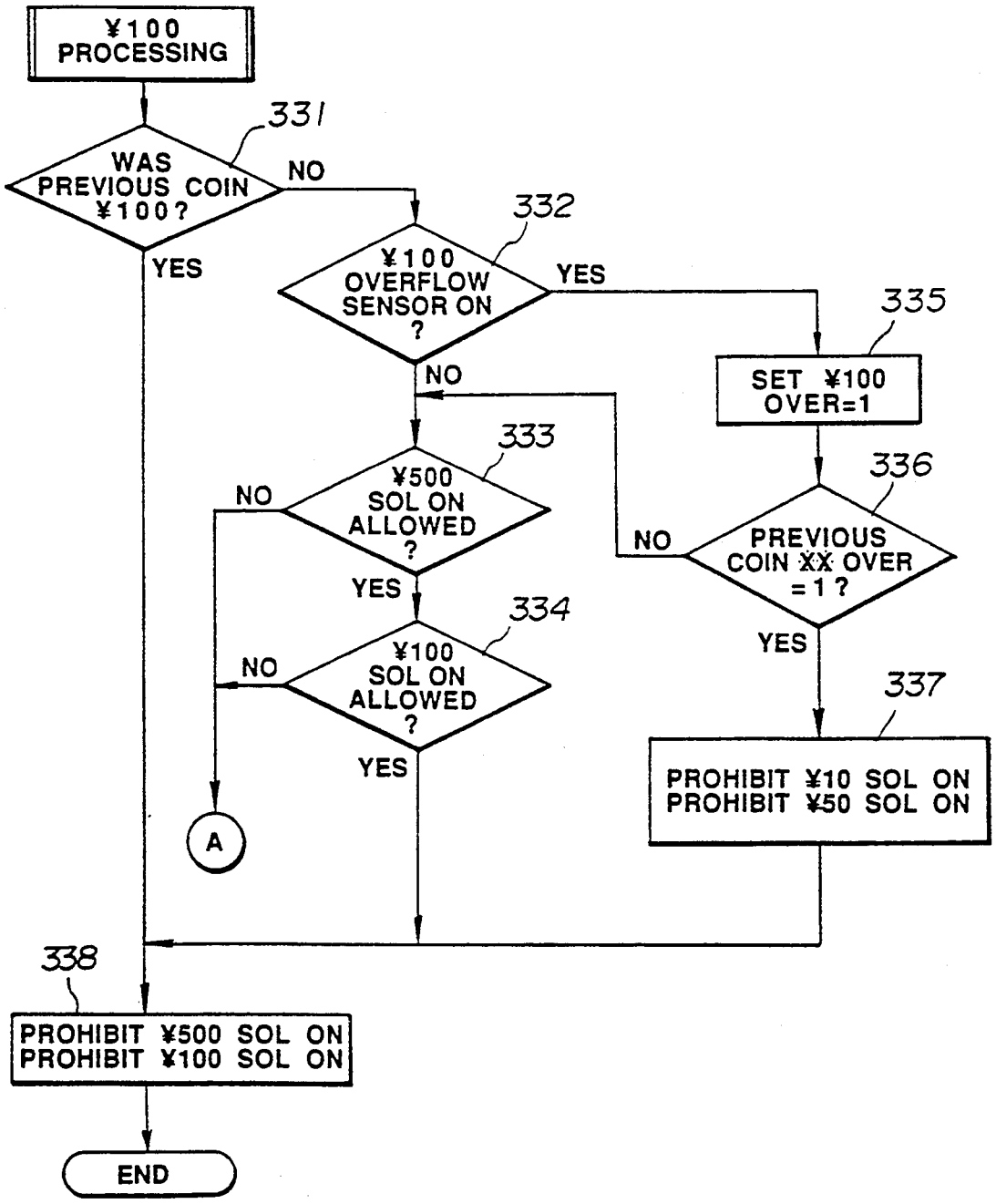
FIG. 22 is a flowchart illustrating the details of ¥ 100 processing in the flowchart shown in FIG. 19.

If it is determined in Step 304 that the true coin is not ¥ 50, a determination is then made as to whether or not this true coin is ¥ 100 (Step 306). If it is ¥ 100, predetermined ¥ 100 processing is executed (Step 307). The details of this ¥ 100 processing are shown in FIG. 22.

Figure 23:
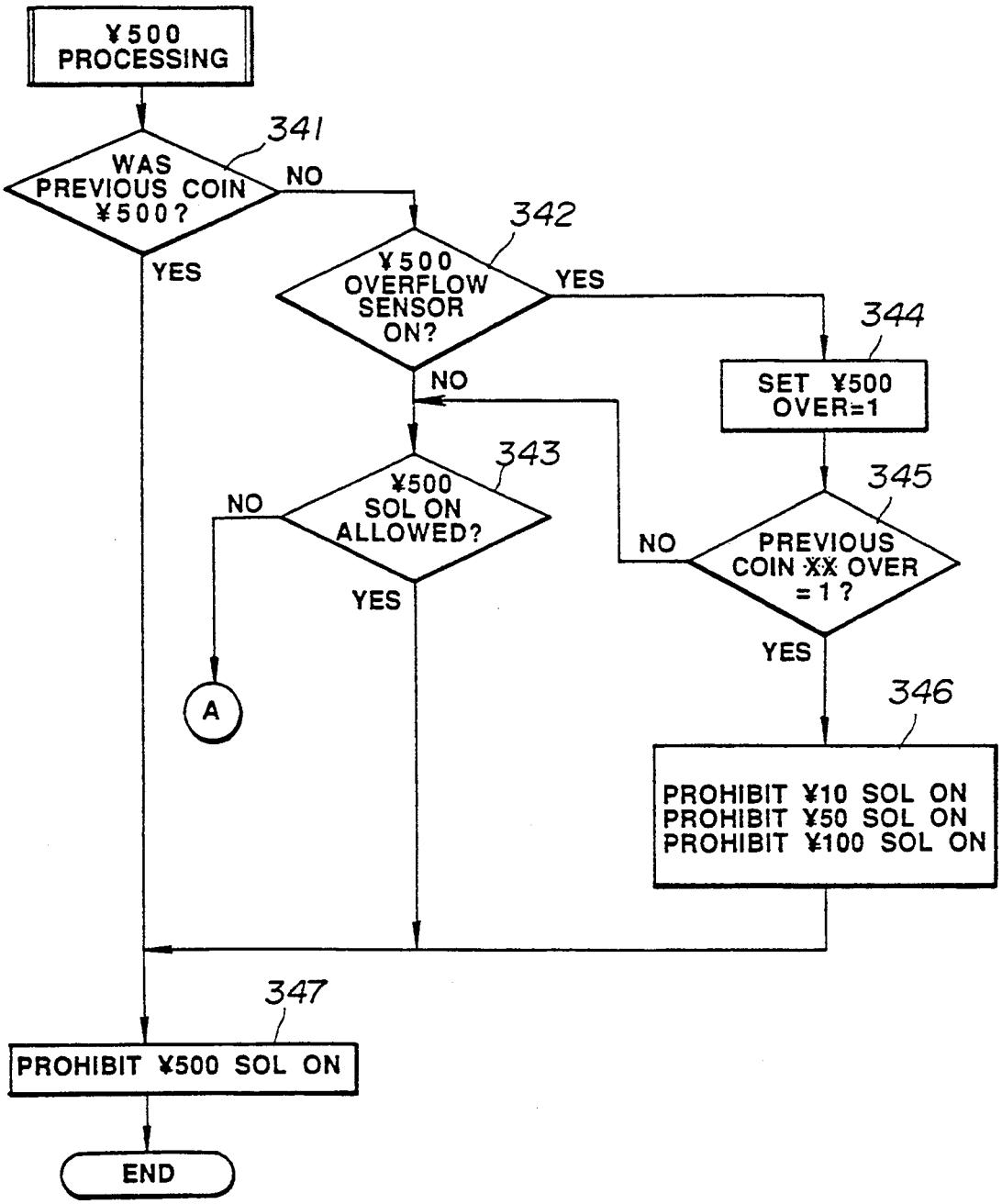
FIG. 23 is a flowchart illustrating the details of ¥ 500 processing in the flowchart shown in FIG. 19.

If it is determined in Step 306 that the true coin is not ¥100, a determination is then made this true coin is ¥500, and predetermined ¥ 500 processing is executed (Step 308). The details of this ¥ 500 processing are shown in FIG. 23.

Upon completion of ¥ 10 processing, ¥ 50 processing, ¥ 100 processing, and ¥ 500 processing, a setting is provided that "true coin=1" (Step 309), and this coin sorting flow ends.

In addition, if it is determined in Step 301 that the coin is a false coin, a setting is provided that "true coin =0" (Step 310), and this coin sorting flow ends.

¥10 Processing

As shown in ¥10 processing shown in FIG. 20, a determination is made as to whether or not the previous coin is a coin of the same type of denomination, i.e., ¥10 (Step 311). If it is not a coin of the same type of denomination, a determination is then made as to whether or not the ¥ 10 overflow sensor OFS10 is on (Step 312). Here, if the ¥ 10 overflow sensor OFS10 is not on, determinations are respectively made as to whether or not all the solenoids which the coin passes through up to the position where the ¥10 solenoid SOL10 corresponding to ¥ 10 is disposed, i.e., the ¥500 solenoid SOL500, ¥ 100 solenoid SOL100, and ¥10 solenoid SOL10, have been allowed to be turned on (Steps 313, 314, 315). If all the solenoids have been allowed to be turned on, a setting is provided that the turning on of all the solenoids which the coin passes through up to the position where the ¥ 10 solenoid SOL10 corresponding to ¥ 10 is disposed, i.e., the ¥500 solenoid SOL500, ¥ 100 solenoid SOL100, and ¥10 solenoid SOL10, is prohibited (Step 319), and this ¥10 processing ends. Here, in a case where the previous coin was a ¥10 coin and the coin being presently processed is ¥ 10, and an ensuing coin is, for example, ¥ 50, then the ¥ 50 solenoid SOL50 may be allowed to be turned on. However, if the turning on of any one of the ¥ 500 solenoid SOL500, ¥ 100 solenod SOL100, and ¥ 10 solenoid SOL10 has been prohibited, the operation proceeds to Step 310 in FIG. 19, and a setting provided that "true coin=0", so as to process the coin as a false coin.

Meanwhile, if it is determined in Step 312 that the ¥10 overflow sensor OFS10 is on, a setting is provided that "¥10 OVERFLOW=1" indicating that the ¥ 10 overflow sensor OFS10 is on (Step 316). Then, a determination is made as to whether or not the previous coin has been processed as overflowing (Step 317). If it has been processed as overflowing, a setting is provided that the turning on of the solenoid in the stage following the ¥ 10 solenoid SOL10, i.e., the ¥ 50 solenoid SOL50, is prohibited (Step 318). and the operation then proceeds to Step 319. It should be noted that if a determination is made in Step 317 that the previous coin has not been processed as overflowing, the operation proceeds to Step 313.

In addition, if it is determined in Step 311 that the previous coin is a coin of the same type of denomination, i.e., ¥ 10, the operation proceeds directly to Step 319.

¥ 50 Processing

In the ¥ 50 processing shown in FIG. 21, a determination is made as to whether or not the previous coin is a coin of the same type of denomination, i.e., ¥ 50 (Step 321). If it is not a coin of the same type of denomination, a determination is then made as to whether or not the ¥ 50 overflow sensor OFS50 is on (Step 322). Here, if the ¥ 50 overflow sensor OFS50 is not on, determinations are respectively made as to whether or not all the solenoids which the coin passes through up to the position where the ¥ 50 solenoid SOL50 corresponding to ¥ 50 is disposed, i.e., the ¥ 500 solenoid SOL500, ¥ 100 solenoid SOL100, ¥ 10 solenoid SOL10, and ¥ 50 solenoid SOL50, have been allowed to be turned on (Steps 323, 324, 325, 326). If all the solenoids have been allowed to be turned on, a setting is provided that the turning on of all the solenoids which the coin passes through up to the position where the ¥ 50 solenoid SOL50 corresponding to ¥ 50 is disposed, i.e., the ¥500 solenoid SOL500, ¥ 100 solenoid SOL100, ¥ 50 solenoid SOL50, and ¥ 10 solenoid SOL10, is prohibited (Step 329), and this ¥ 50 processing ends. However, if the turning on of any one of the ¥ 500 solenoid SOL500, ¥ 100 solenod SOL100, ¥ 10 solenoid SOL10, and ¥ 50 solenoid SOL50 has been prohibited, the operation proceeds to Step 310 in FIG. 19, and a setting provided that "true coin=0", so as to process the coin as a false coin.

Meanwhile, if it is determined in Step 322 that the ¥50 overflow sensor OFS50 is on, a setting is provided that "¥50 OVERFLOW=1" indicating that the ¥ 50 overflow sensor OFS50 is on (Step 327). Then, a determination is made as to whether or not the previous coin has been processed as overflowing (Step 328). If it has been processed as overflowing, the operation proceeds to Step 329, whereas if it is determined that the previous coin has not been processed as overflowing, the operation proceeds to Step 323.

In addition, if it is determined in Step 321 that the previous coin is a coin cf the same type of denomination, i.e., ¥ 50, the operation proceeds directly to Step 329.

¥100 Processing

In the ¥ 100 processing shown in FIG. 22, a determination is made as to whether or not the previous coin is a coin of the same type of denomination, i.e., ¥ 100 (Step 331). If it is not a coin of the same type of denomination, a determination is then made as to whether or not the ¥ 100 overflow sensor OFS100 is on (Step 332). Here, if the ¥ 100 overflow sensor OFS100 is not on, determinations are respectively made as to whether or not all the solenoids which the coin passes through up to the position where the ¥ 100 solenoid SOL100 corresponding to ¥ 100 is disposed, i.e., the ¥ 500 solenoid SOL500 and ¥ 100 solenoid SOL100, have been allowed to be turned on (Steps 333, 334). If all the solenoids have been allowed to be turned on, a setting is provided that the turning on of all the solenoids which the coin passes through up to the position where the ¥100 solenoid SOL100 corresponding to ¥ 100 is disposed, i.e., the ¥ 500 solenoid SOL500 and ¥ 100 solenoid SOL100, is prohibited (Step 338), and this ¥ 100 processing ends. However, if the turning on of either of the ¥ 500 solenoid SOL500 and ¥ 100 solenod SOL100 has been prohibited, the operation proceeds to Step 310 in FIG. 19, and a setting provided that "true coin=0", so as to process the coin as a false coin.

Meanwhile, if it is determined in Step 332 that the ¥100 overflow sensor OFS100 is on, a setting is provided that "¥100 OVERFLOW=1" indicating that the ¥ 100 overflow sensor OFS100 is on (Step 335). Then, a determination is made as to whether or not the previous coin has been processed as overflowing (Step 336). If it has been processed as overflowing, a setting is provided that the turning on of the solenoids in the stages following the ¥ 100 solenoid SOL100, i.e., the ¥ 10 solenoid SOL10 and the ¥ 50 solenoid SOL50, is prohibited (Step 337), and the operation proceeds to Step 333.

In addition, if it is determined in Step 331 that the previous coin is a coin of the same type of denomination, i.e., ¥ 100, the operation proceeds directly to Step 338.

¥ 500 Processing

In the ¥ 500 processing shown in FIG. 23, a determination is made as to whether or not the previous coin is a coin of the same type of denomination, i.e., ¥ 500 (Step 341). If it is not a coin of the same type of denomination, a determination is then made as to whether or not the ¥ 500 overflow sensor OFS500 is on (Step 342). Here, if the ¥ 500 overflow sensor OFS500 is not on, a determination is made as to whether or not the ¥ 500 solenoid SOL500 has been allowed to be turned on (Steps 343). If it has been allowed to be turned on, a setting is provided that the turning on of the ¥ 500 solenoid SOL500 is prohibited (Step 347), and this ¥ 500 processing ends. However, if the turning on of the ¥ 500 solenoid SOL500 has been prohibited, the operation proceeds to Step 310 in FIG. 19, and a setting provided that "true coin=0", so as to process the coin as a false coin.

Meanwhile, if it is determined in Step 342 that the ¥ 500 overflow sensor OFS500 is on, a setting is provided that "¥500 OVERFLOW=1" indicating that the ¥ 500 overflow sensor OFS500 is on (Step 344). Then, a determination is made as to whether or not the previous coin has been processed as overflowing (Step 345). If it has been processed as overflowing, a setting is provided that the turning on of the solenoids in the stages following the ¥ 500 solenoid SOL500, i.e., the ¥ 10 solenoid SOL10, ¥ 50 solenoid SOL50, and $\phi$100 solenoid SOL100, is prohibited (Step 346), and the operation proceeds to Step 347. It should be noted that if it is determined in Step 345 that the previous coin has not been processed as overflowing, the operation proceeds to Step 343.

In addition, if it is determined in Step 341 that the previous coin is a coin of the same type of denomination, i.e., ¥ 500, the operation proceeds directly to Step 347.

True Coin Processing

Figure 24:
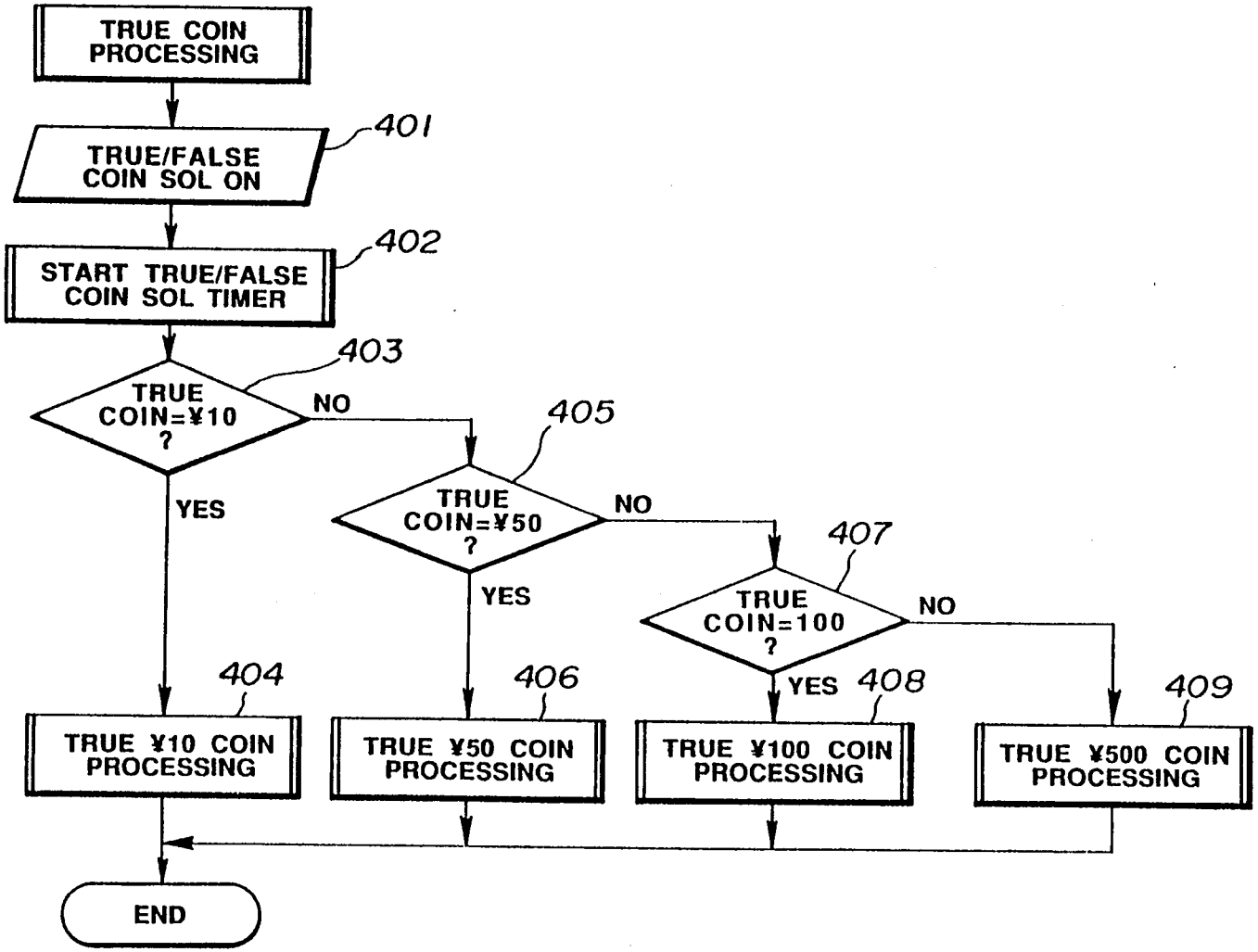
FIG. 24 is a flowchart illustrating the details of true coin processing in the flowchart shown in FIG. 18.

True coin processing is shown in FIG. 24. In the true coin processing, the true/false coin solenoid SOLSF is first turned on (Step 401), and an unillustrated true/false coin solenoid timer is started (Step 402). This true/false coin solenoid timer can be realized as a softwarewise timer in the control unit 100. In addition, various timers shown below can also be realized as softwarewise timers in the control unit 100.

Figure 25A:
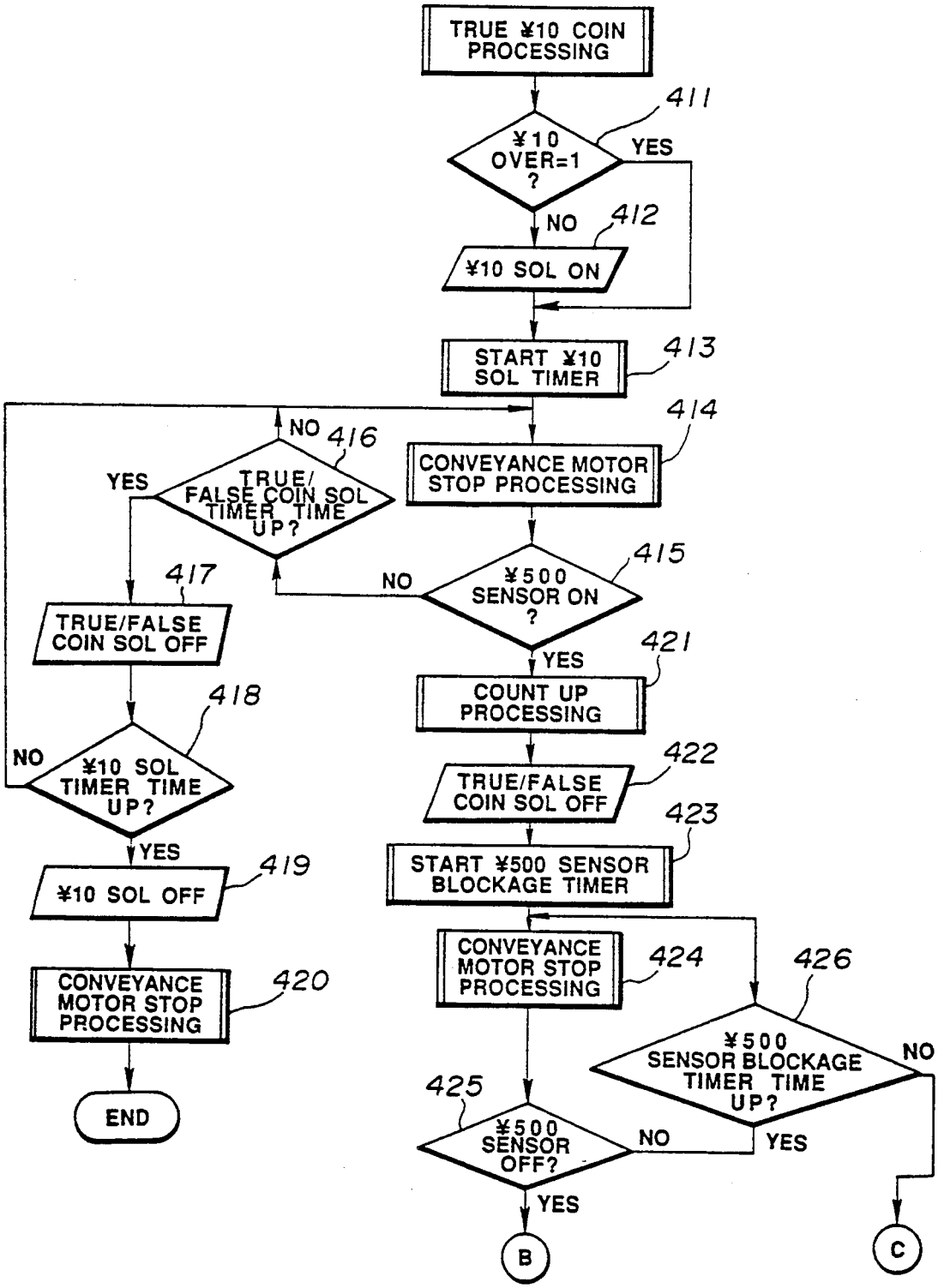
FIGS. 25(*a*) to 25(*c*) are flowcharts illustrating the details of true ¥ 10 coin processing in the flowchart shown in FIG. 24.
Figure 25B:
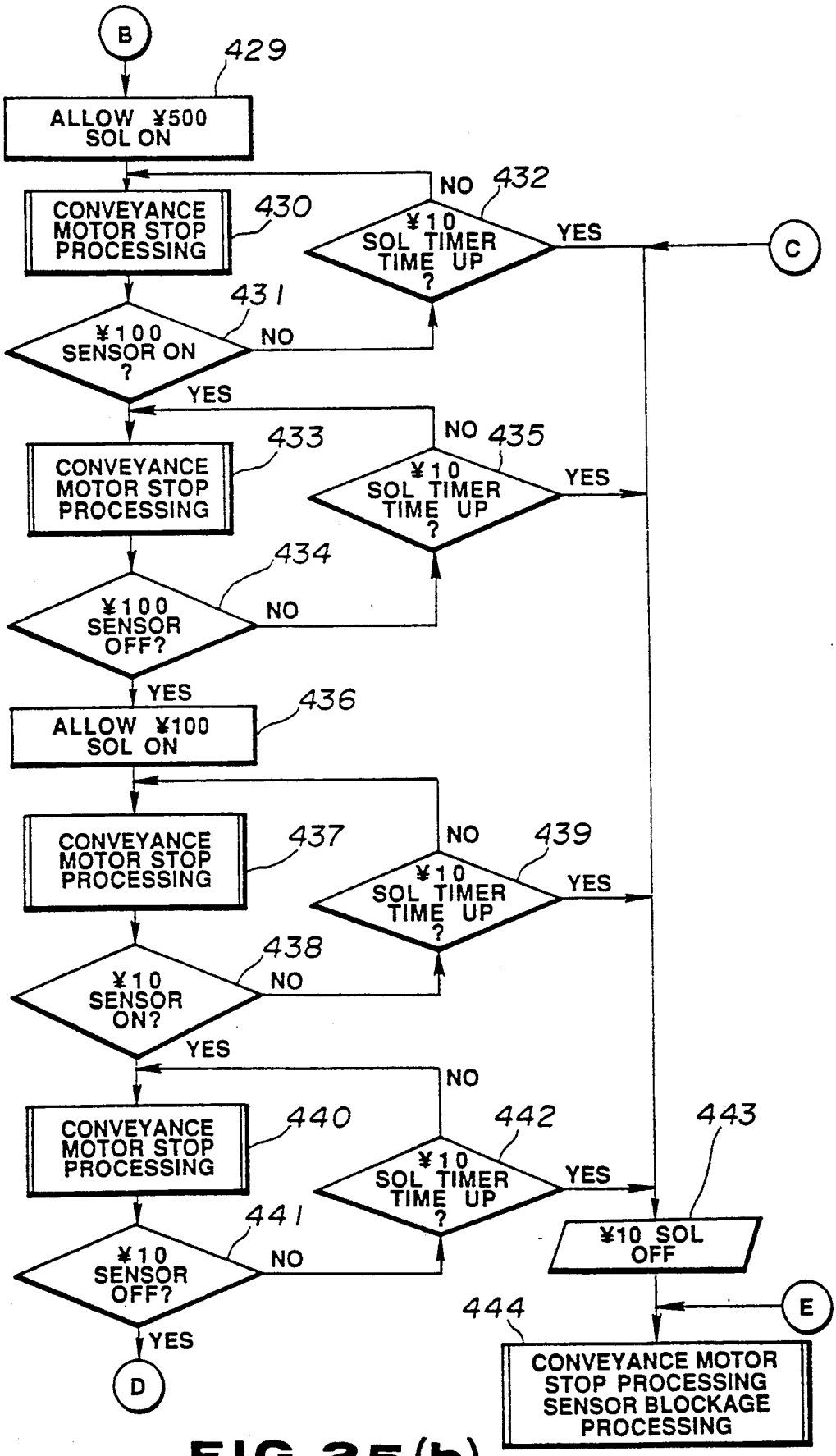
Figure 25C:
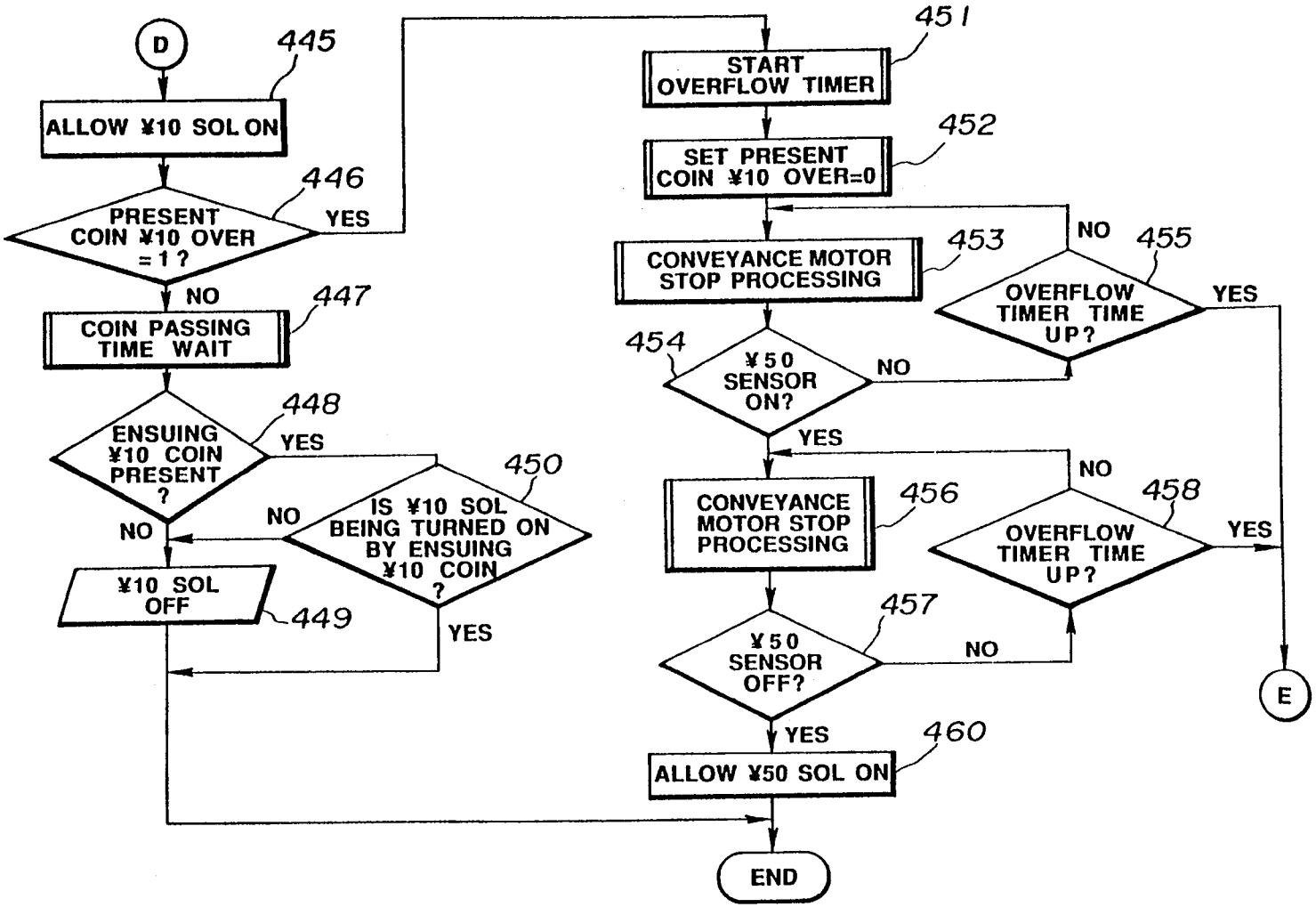

Next, a determination is made as to whether or not the true coin is ¥ 10 (Step 403). If the true coin is ¥ 10, true ¥ 10 coin processing is executed (Step 404). The details of this true ¥ 10 coin processing are shown in FIGS. 25(*a*) to 25(*c*) .

Figure 26A:
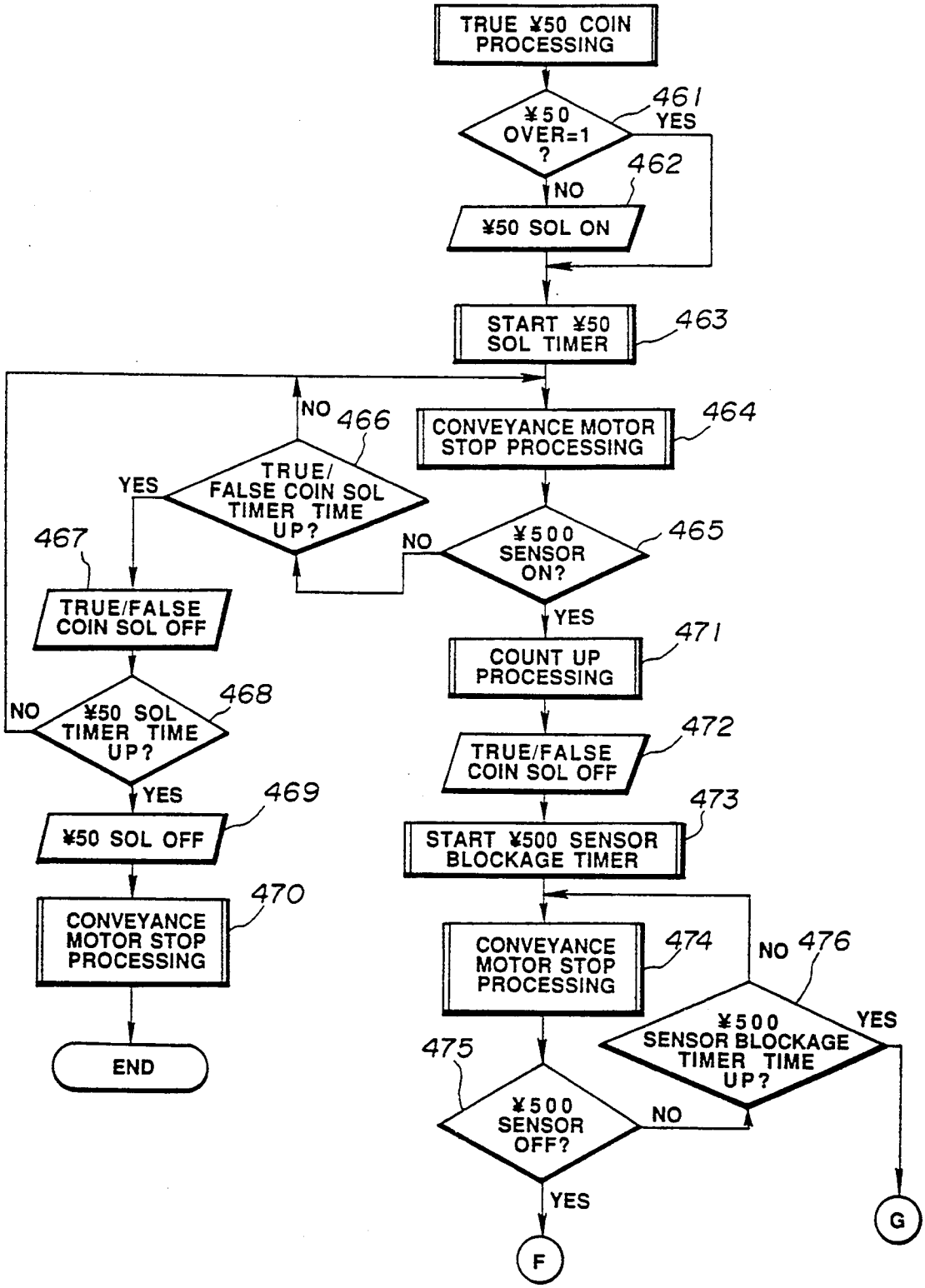
FIGS. 26(*a*) to 26(*c*) are flowcharts illustrating the details of true ¥ 50 coin processing in the flowchart shown in FIG. 24.
Figure 26B:
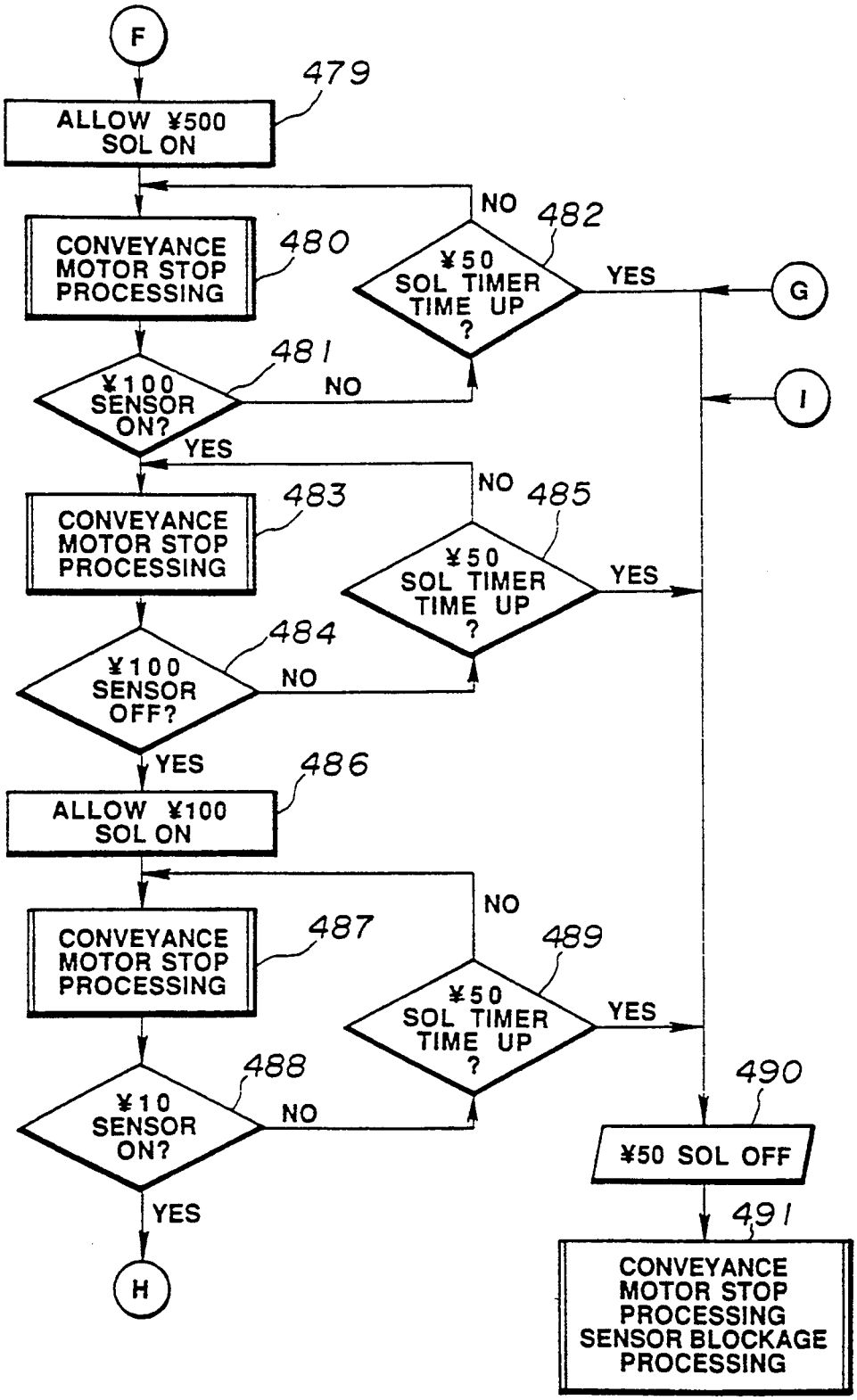
Figure 26C:
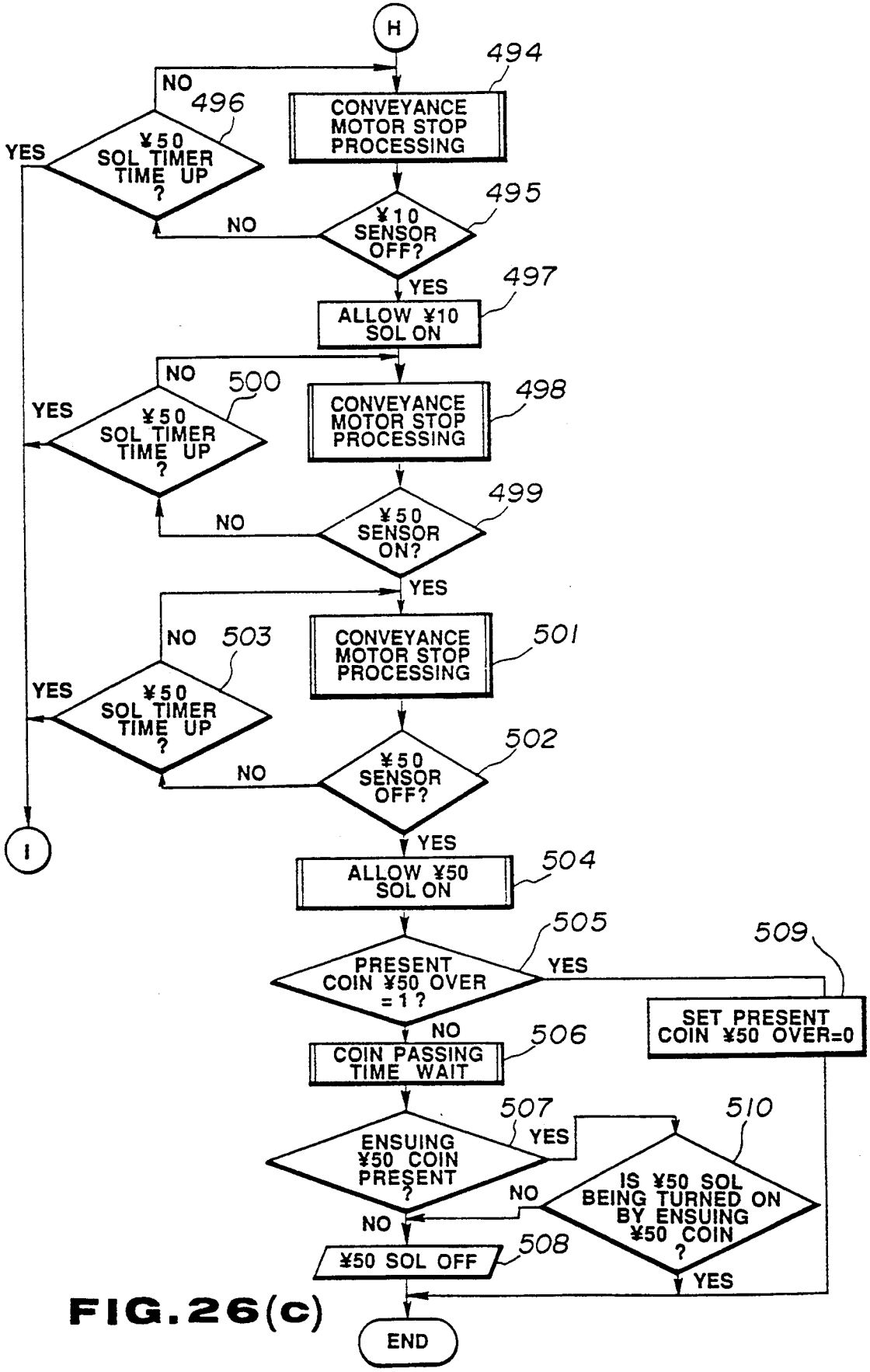

Meanwhile, if it is determined in Step 403 that the true coin is not ¥ 10, a determination is then made as to whether or not the true coin is ¥ 50 (Step 405). If the true coin is ¥ 50, true ¥ 50 coin processing is executed (Step 406). The details of this true ¥ 50 coin processing are shown in FIGS. 26(*a*) to 26(*c*).

Figure 27A:
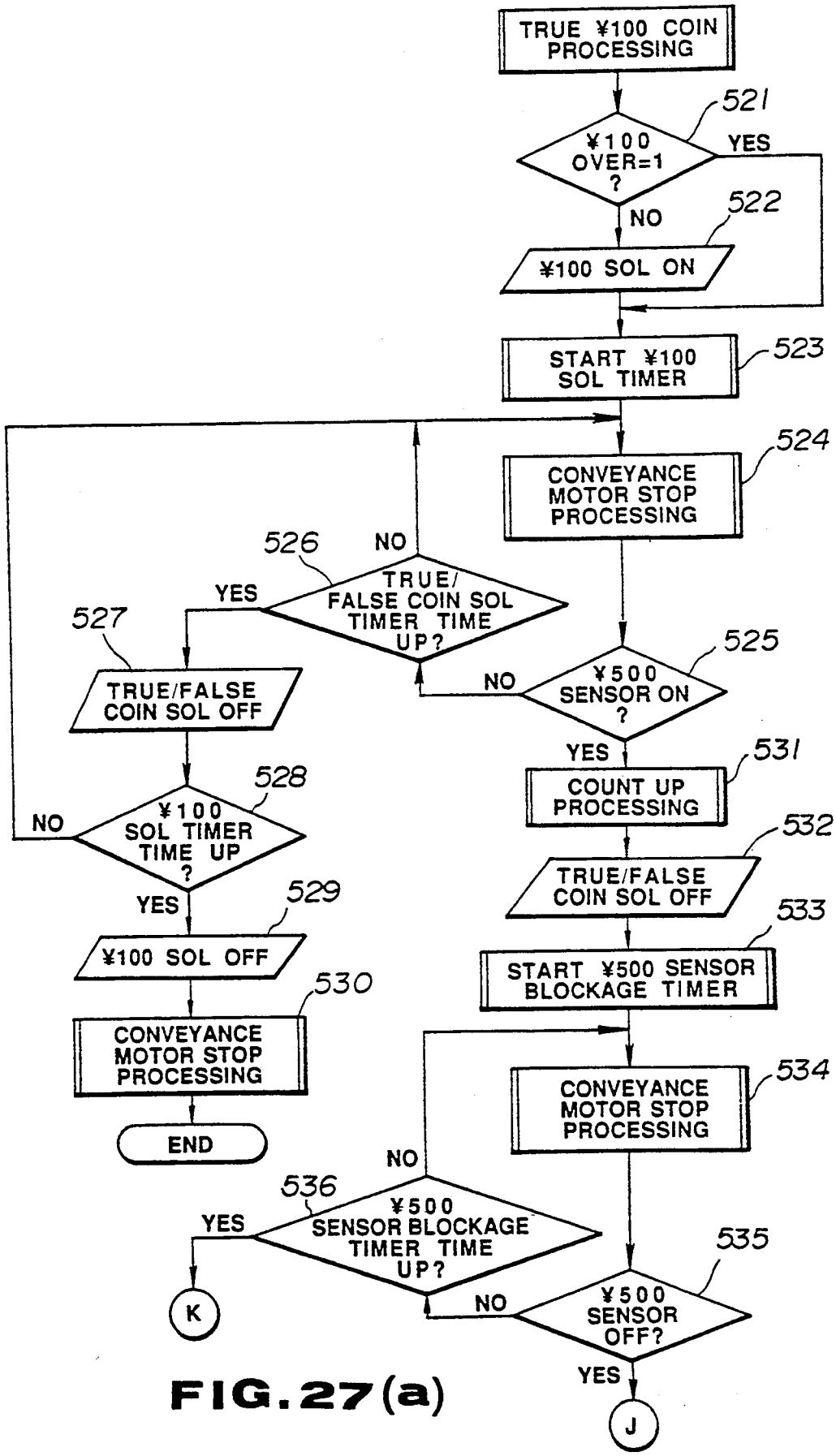
FIGS. 27(*a*) to 27(*c*) are flowcharts illustrating the details of true ¥ 100 coin processing in the flowchart shown in FIG. 24.
Figure 27B:
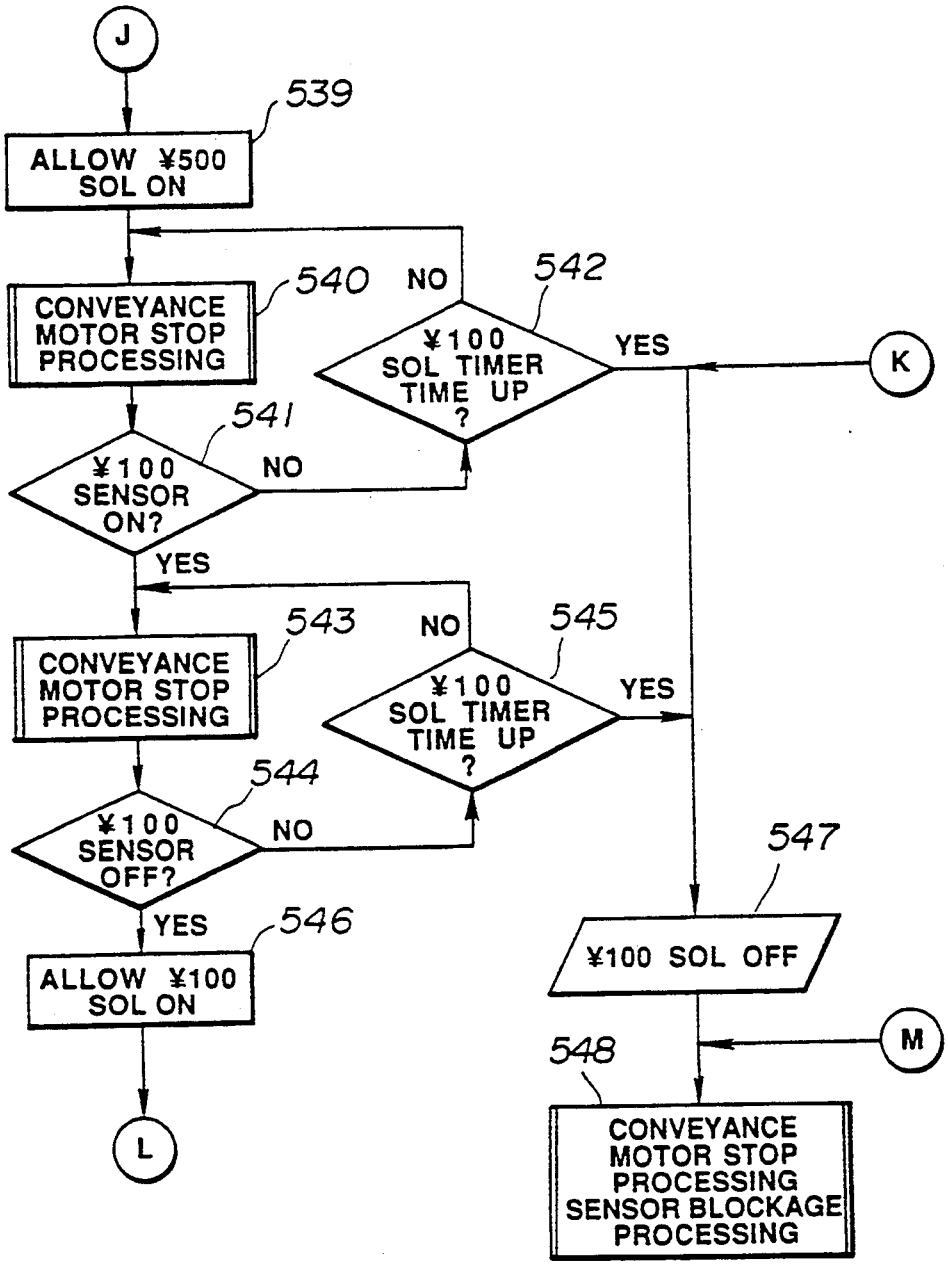
Figure 27C:
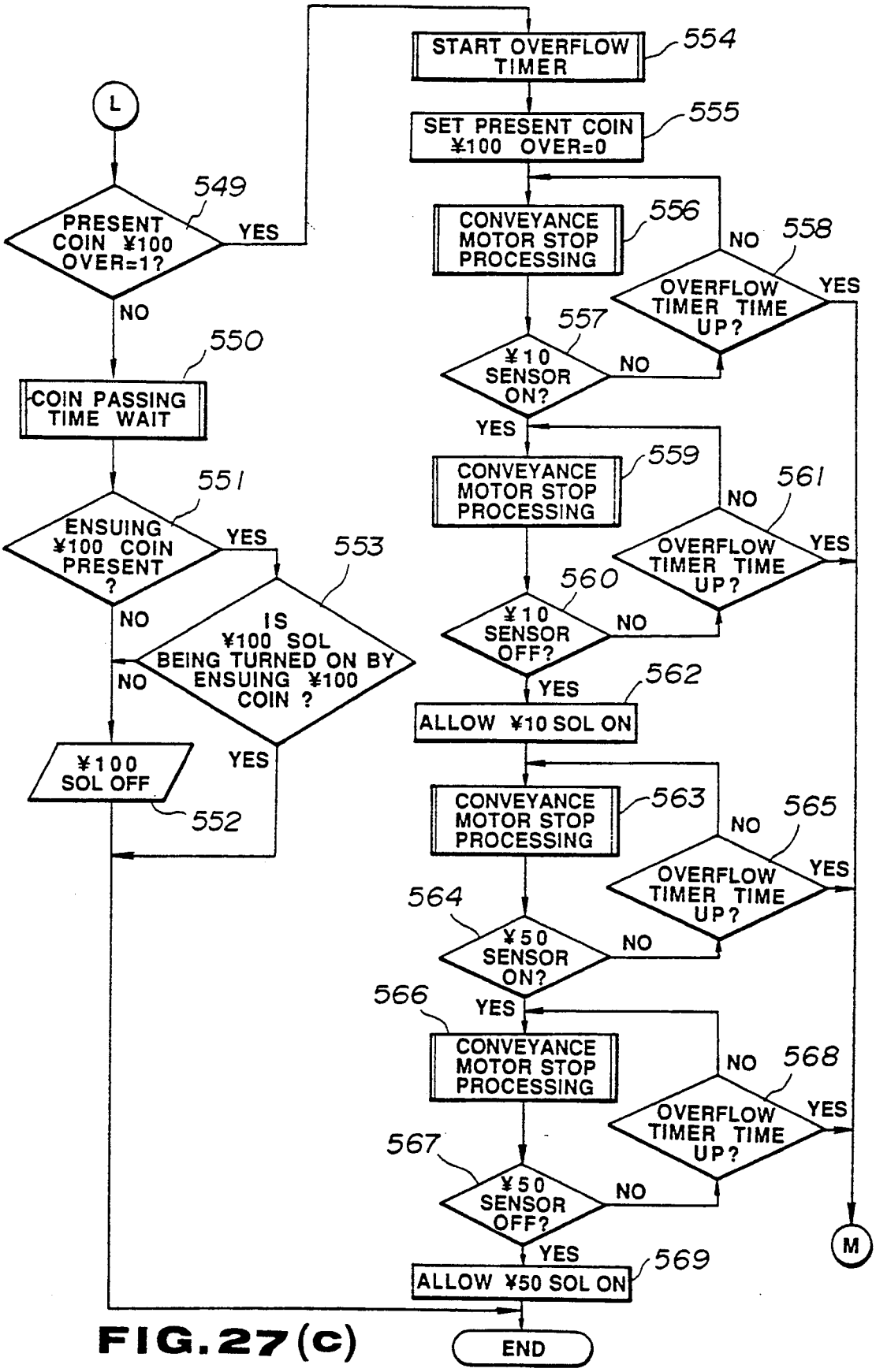

If it is determined in Step 405 that the true coin is not ¥50, a determination is then made as to whether or not the true coin is ¥ 100 (Step 407). If the true coin is ¥100, true ¥ 100 coin processing is executed (Step 408). The details of this true ¥ 100 coin processing are shown in FIGS. 27(*a*) to 27(*c*) .

Figure 28A:
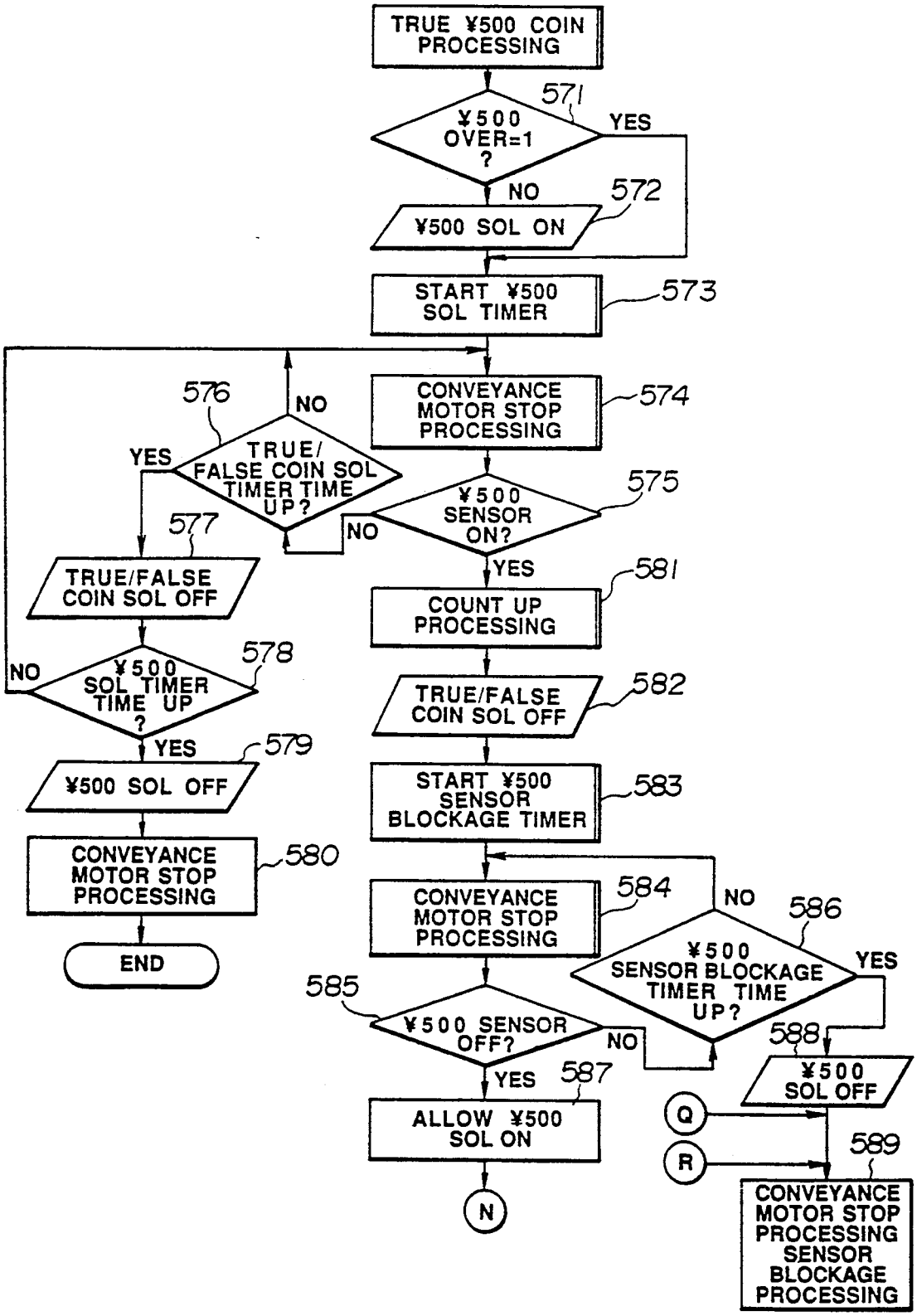
FIGS. 28(*a*) to 28(*c*) are flowcharts illustrating the details of true ¥ 500 coin processing in the flowchart shown in FIG. 24.
Figure 28B:
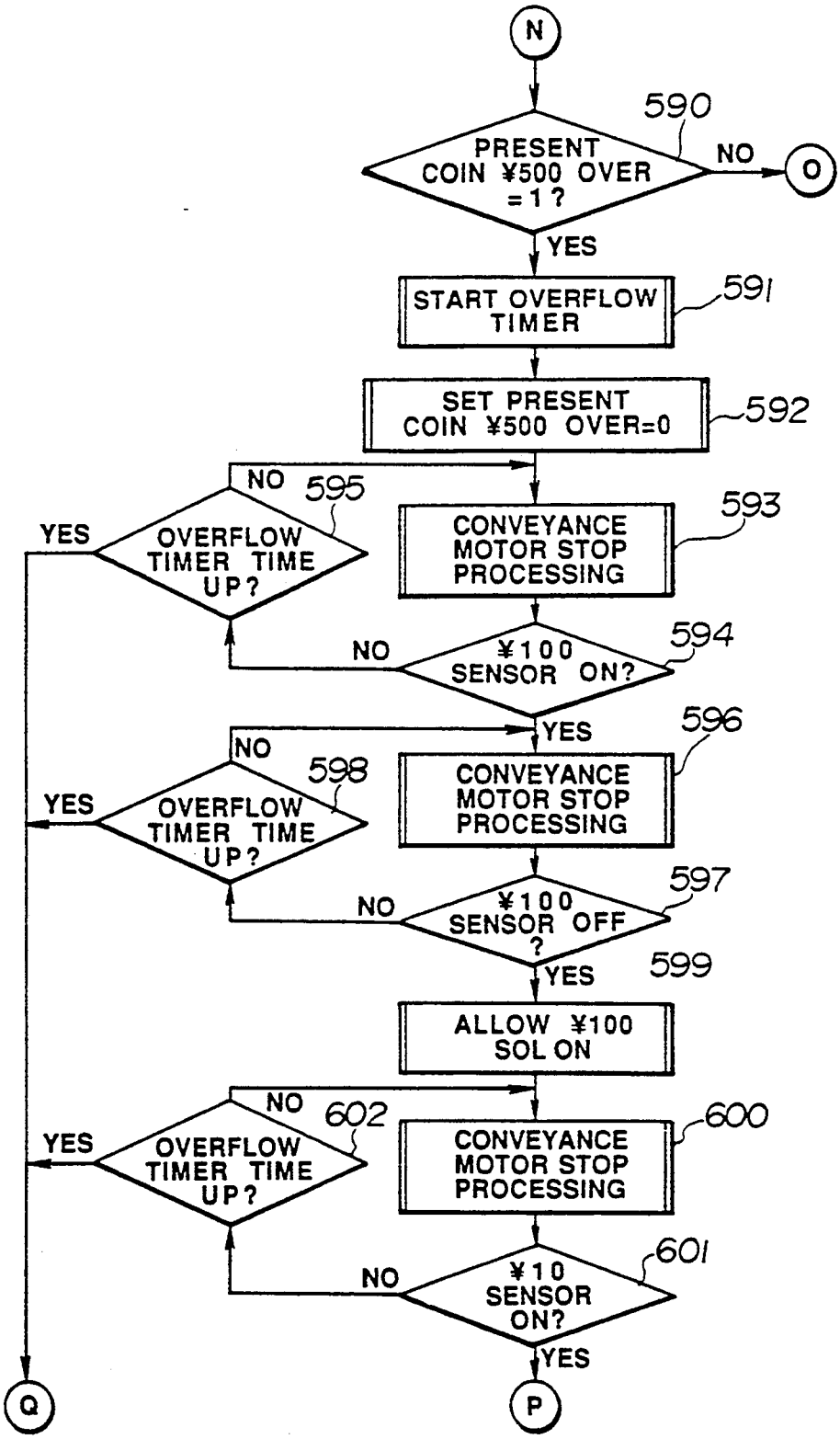
Figure 28C:
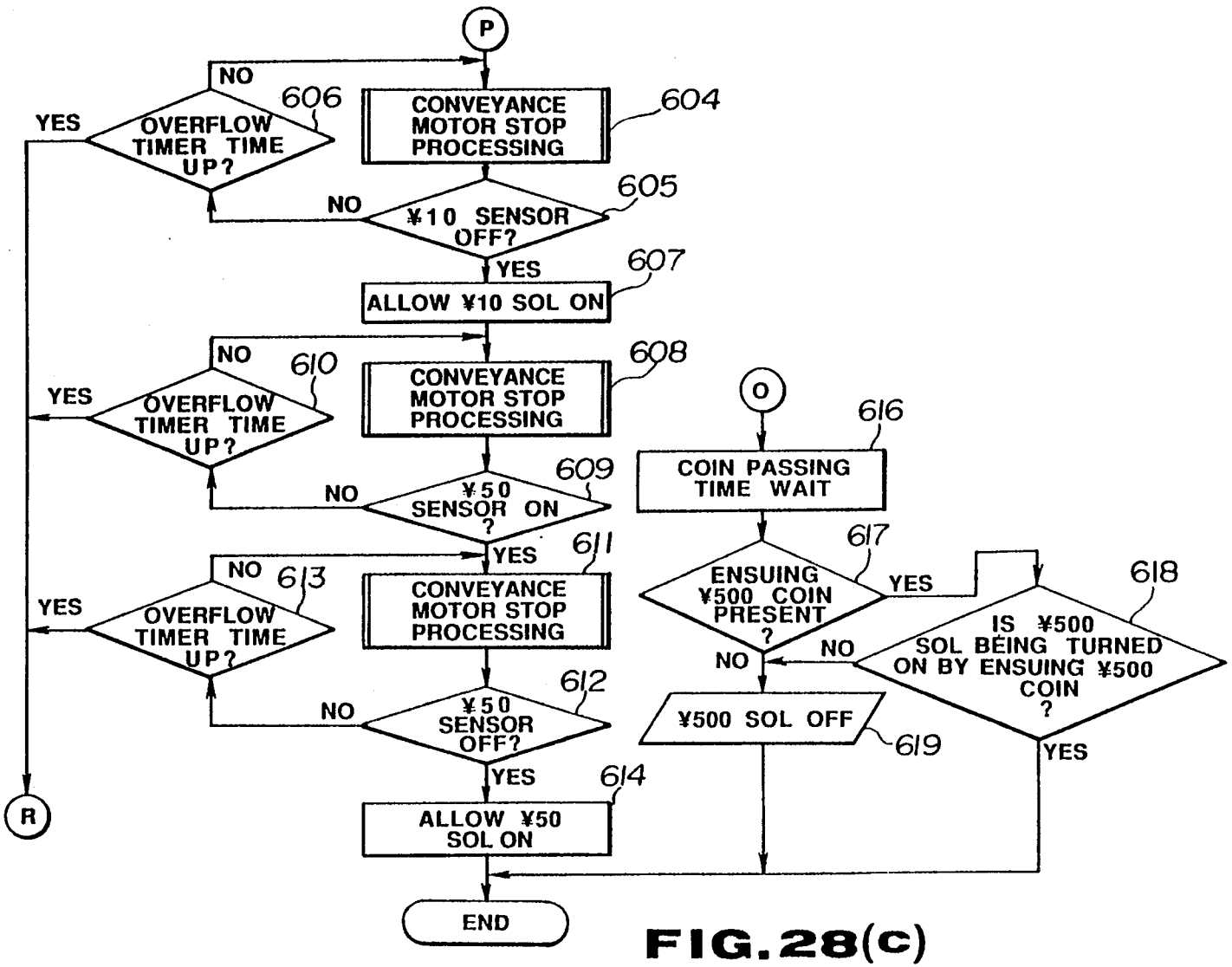

If it is determined in Step 407 that the true coin is not ¥100, it is judged that the true coin is ¥ 500, and true ¥ 500 coin processing is executed (Step 409). The details of this true ¥ 500 coin processing are shown in FIGS. 28(*a*) to 28(*c*).

True ¥ 10 Coin Processing

In FIGS. 25(*a*) to 25(*c*), a determination is first made as to whether or not a setting has been provided that "¥10 OVERFLOW=1," i.e., whether or not the ¥ 10 coin is to be subjected to overflow processing (Step 411). If "¥10 OVERFLOW=1" does not hold true, the ¥ 10 solenoid SOL10 is turned on (Step 412), and the operation proceeds to Step 413 to start an unillustrated ¥ 10 solenoid timer. Meanwhile, if "¥10 OVERFLOW=1" holds true, the operation directly proceeds to Step 413 to start the unillustrated ¥ 10 solenoid timer.

Subsequently, stop processing of the conveyance motor MO for driving the belt conveyance motor 14 is executed (Step 414), and a determination is made as to whether or not the ¥ 500 sensor SE500 is on (Step 415). If it is detected in Step 415 that the ¥ 500 sensor SE500 has been turned on before the time of the true/false coin solenoid timer is up, count up processing for counting the inserted coins is executed on the basis of the output of the ¥ 500 sensor SE500 (Step 421). This count up processing of the inserted coins is effected by using the output of determination by the sorting sensor SECO and the "on" output of the ¥ 500 sensor SE500.

Meanwhile, if the ¥ 500 sensor SE500 is not turned on even after the time of the true/false solenoid timer is up, the true/false coin solenoid SOLSF is turned off (Step 417). Then, if the time of the ¥ 10 solenoid timer is up (Step 418), the ¥ 10 solenoid SOL10 is turned off (Step 419), stop processing of the conveyance motor MO is executed (Step 420), and this flow of true ¥ 10 coin processing ends.

If count up processing ends in Step 421, the true/false coin solenoid SOLSF is turned off (Step 422). Then, an unillustrated ¥ 500 sensor blockage timer is started (Step 423), and stop processing of the conveyance motor MO is executed (Step 424). Then, the turning off of the ¥ 500 SE500 is turned off before the time of the ¥500 sensor SE500 is turned off before the time of the ¥500 sensor blockage timer is up (Step 426), a setting is provided that the 500 solenoid SOL500 is allowed to be turned on (Step 429) .

Meanwhile, even if the time of the ¥ 500 sensor blockage timer is up, unless the ¥ 500 sensor SE500 is turned off (Step 426), it is assumed that the portion where the ¥ 500 sensor SE500 is disposed is blocked with a coin, so that the ¥ 10 solenoid SOL10 is turned off (Step 443). Subsequently stop processing of the conveyance motor MO and sensor blockage processing are executed (Step 444).

If a setting is provided in Step 429 that the ¥ 500 solenoid is allowed to be turned on, stop processing of the conveyance motor MO is executed (Step 430), and the turning on of the ¥ 100 sensor SE100 is then monitored (Step 431). Here, if the ¥ 100 sensor SE100 is turned on before the time of the ¥ 10 solenoid timer is up (Step 432), stop processing of the conveyance motor MO is executed (Step 433), and the turning off of the ¥ 100 sensor SE100 is monitored (Step 434). Here, if the ¥ 100 sensor SE100 is turned off before the time of the ¥10 solenoid timer is up (Step 435), a setting is provided that the ¥ 100 solenoid SOL100 is allowed to be turned on (Step 436), stop processing of the conveyance motor MO is executed (Step 437), and the turning on of the ¥ 10 sensor SE10 is monitored (Step 438). Here, if the ¥10 sensor SE10 is turned on before the time of the ¥10 solenoid timer is up (Step 439), stop processing of the conveyance motor MO is executed (Step 440), and the turning off of the ¥ 10 sensor SE10 is monitored (Step 441). Here, if the ¥ 10 sensor SE10 is turned off before the time of the ¥ 10 solenoid timer is up (Step 442), a setting is provided that the ¥ 10 solenoid SOL10 is allowed to be turned on (Step 445).

It should be noted that even after the time of the ¥ 10 sensor blockage timer is up, if the ¥ 100 sensor SE100 is not turned on (Step 432), if the ¥ 100 sensor SE100 is not turned off (Step 435), if the ¥ 10 sensor SE10 is not turned on (Step 439), or if the ¥ 10 sensor SE10 is not turned off (Step 442), then it is assumed that the sensor portion is blocked with a coin, so that the ¥10 solenoid SOL10 is turned off (Step 443). Subsequently, stop processing of the conveyance motor MO and sensor blockage processing are executed (Step 444 ) .

After providing a setting in Step 445 that the ¥ 10 solenoid SOL10 is allowed to be turned on, a determination is made as to whether or not a setting has been provided that "¥10 OVERFLOW=1" with respect to the coin being presently processed (Step 446). If a setting has not been provided that "¥10 OVERFLOW=1," after waiting for a predetermined time required for the passage of the coin (Step 447), a determination is made as to whether or not there is an ensuing coin of the same type of denomination, i.e., ¥ 10 (Step 448). Here, if there is an ensuing ¥ 10 coin, a determination is made as to whether or not the ¥ 10 solenoid SOL10 has been turned on by the ensuing ¥ 10 coin (Step 450). Then, if there is no ensuing ¥ 10 coin, or in a case where the ¥ 10 solenoid SOL10 has not been turned on by the ¥ 10 coin despite the presence of the ensuing ¥ 10 coin, the ¥ 10 solenoid SOL10 is kept turned off (Step 449). Meanwhile, if the ¥ 10 solenoid SOL10 has been turned on by the ensuing ¥ 10 coin, this true ¥ 10 coin processing is ended without turning off the ¥ 10 solenoid SOL10.

If it is determined in Step 446 that a setting has been provided that "¥ 10 OVERFLOW=1" with respect to the coin being presently processed, the unillustrated overflow timer is started (Step 451), and a setting is provided with respect to the coin being presently processed that "¥10 OVERFLOW=0" (Step 452), stop processing of the conveyance motor MO is executed (Step 453), and the turning on of the ¥ 50 sensor SE50 is monitored (Step 454) . Here, if the ¥ 50 sensor SE50 is turned on before the time of the overflow timer is up (Step 455), stop processing of the conveyance motor MO is executed (Step 456), and the turning off of the 50 sensor SE50 is monitored (Step 457). Here, if the ¥ 50 sensor SE50 is turned off before the time of the overflow timer is up (Step 458), a setting is provided that by ¥ 50 solenoid SOL50 is allowed to be turned on (Step 460), and this true ¥ 10 coin processing ends.

It should be noted that in a case where, even after the time of the overflow timer is up, the ¥ 50 sensor SE50 is not turned on (Step 455) or the ¥ 50 sensor SE50 is not turned off (Step 458), it is assumed that the sensor portion is blocked with a coin, so that stop processing of the conveyance motor MO and sensor blockage processing are executed (Step 444).

True ¥ 50 Coin Processing

In FIGS. 26(*a*) to 26(*c*) , a determination is first made as to whether or not a setting has been provided that "¥50 OVERFLOW=1," i.e., whether or not the ¥ 50 coin is to be subjected to overflow processing (Step 461). If "¥50 OVERFLOW=1" does not hold true, the ¥ 50 solenoid SOL50 is turned on (Step 462), and the operation proceeds to Step 463 to start an unillustrated ¥ 50 solenoid timer. Meanwhile, if "¥50 OVERFLOW=1" holds true, the operation directly proceeds to Step 463 to start the unillustrated ¥ 50 solenoid timer.

Subsequently, stop processing of the conveyance motor MO for driving the belt conveyance motor 14 is executed (Step 464), and a determination is made as to whether or not the ¥500 sensor SE500 is on (Step 465). If it is detected in Step 465 that the ¥ 500 sensor SE500 has been turned on before the time of the true/false coin solenoid timer is up, count up processing for counting the inserted coins is executed on the basis of the output of the ¥ 500 sensor SE500 (Step 471). This count up processing of the inserted coins is effected by using the output of determination by the sorting sensor SECO and the "on" output of the ¥ 500 sensor SE500.

Meanwhile, if the ¥ 500 sensor SE500 is not turned on even after the time of the true/false solenoid timer is up, the true/false coin solenoid SOLSF is turned off (Step 467). Then, if the time of the ¥ 50 solenoid timer is up (Step 468), the ¥ 50 solenoid SOL50 is turned off (Step 469), stop processing of the conveyance motor MO is executed (Step 470), and this flow of true ¥ 50 coin processing ends.

If count up processing ends in Step 471, the true/false coin solenoid SOLSF is turned off (Step 472). Then, the unillustrated ¥ 500 sensor blockage timer is started (Step 473), and stop processing of the conveyance motor MO is executed (Step 474). Then, the turning off of the ¥ 500 sensor SE500 is monitored (Step 475), and if the ¥ 500 sensor SE500 is turned off before the time of the ¥ 500 sensor blockage timer is up (Step 476), a setting is provided that the ¥ 500 solenoid SOL500 is allowed to be turned on (Step 479).

Meanwhile, even if the time of the ¥ 500 sensor blockage timer is up, unless the ¥ 500 sensor SE500 is turned off (Step 476), it is assumed that the portion where the ¥ 500 sensor SE500 is disposed is blocked with a coin, so that the ¥ 50 solenoid SOL50 is turned off (Step 490). Subsequently, stop processing of the conveyance motor MO and sensor blockage processing are executed (Step 491).

If a setting is provided in Step 479 that the ¥ 500 solenoid is allowed to be turned on, stop processing of the conveyance motor MO is executed (Step 480), and the turning on of the ¥ 100 sensor SE100 is then monitored (Step 481). Here, if the ¥ 100 sensor SE100 is turned on before the time of the ¥ 50 solenoid timer is up (Step 482), stop processing of the conveyance motor MO is executed (Step 483), and the turning off of the ¥ 100 sensor SE100 is monitored (Step 484). Here, if the ¥100 sensor SE100 is turned off before the time of the ¥50 solenoid timer is up (Step 485), a setting is provided that the ¥ 100 solenoid SOL100 is allowed to be turned on (Step 486), stop processing of the conveyance motor MO is executed (Step 487), and the turning on of the ¥ 10 sensor SE10 is monitored (Step 488). Here, if the ¥ 10 sensor SE10 is turned on before the time of the ¥50 solenoid timer is up (Step 489), stop processing of the conveyance motor MO is executed (Step 494), and the turning off of the ¥ 10 sensor SE10 is monitored (Step 495). Here, if the ¥ 10 sensor SE10 is turned off before the time of the ¥ 50 solenoid timer is up (Step 496), a setting is provided that the ¥ 10 solenoid SOL10 is allowed to be turned on (Step 497).

Next, stop processing the conveyance motor is executed (Step 498), and the turning on of the ¥ 50 sensor SE50 is monitored (Step 499 ). Here, if the ¥ 50 sensor SE50 is turned on before the time of the ¥ 50 solenoid timer is up (Step 500), stop processing of the conveyance motor MO is executed (Step 501) , and the turning off of the ¥ 50 sensor SE50 is then monitored (Step 502). Here, if the ¥ 50 sensor SE50 is turned off before the time of the ¥ 50 solenoid timer is up (Step 503), a setting is provided that the ¥ 50 solenoid SOL50 is allowed to be turned on (Step 504).

It should be noted that even after the time of the ¥ 50 sensor blockage timer is up, if the ¥ 100 sensor SE100 is not turned on (Step 482), if the ¥ 100 sensor SE100 is not turned off (Step 485), if the ¥ 10 sensor SE10 is not turned on (Step 489), if the ¥ 10 sensor SE10 is not turned off (Step 496), if the ¥ 50 sensor SE50 is not turned on (Step 500), or if the ¥ 50 sensor SE50 is not turned off (Step 503), then it is assumed that the sensor portion is blocked with a coin, so that the ¥ 50 solenoid SOL50 is turned off (Step 490). Subsequently, stop processing of the conveyance motor MO and sensor blockage processing are executed (Step 491).

After providing a setting in Step 504 that the ¥ 50 solenoid SOL50 is allowed to be turned on, a determination is made as to whether or not a setting has been provided that "¥ 50 OVERFLOW = 1" with respect to the coin being presently processed (Step 505). If a setting has not been provided that "¥ 50 OVERFLOW = 1," after waiting for a predetermined time required for the passage of the coin (Step 506), a determination is made as to whether or not there is an ensuing coin of the same type of denomination, i.e., ¥ 50 (Step 507). Here, if there is an ensuing ¥ 50 coin, a determination is made as to whether or not the ¥ 50 solenoid SOL50 has been turned on by the ensuing ¥ 50 coin (Step 510). Then, if there is no ensuing ¥ 50 coin, or in a case where the ¥ 50 solenoid SOL50 has not been turned on by the ¥ 50 coin despite the presence of the ensuing ¥ 50 coin, the ¥ 50 solenoid SOL50 is kept turned off (Step 508). Meanwhile, if the ¥ 50 solenoid SOL50 has been turned on by the ensuing ¥ 50 coin, this true ¥ 50 coin processing is ended without turning off the ¥ 50 solenoid SOL50.

If it is determined in Step 505 that a setting has been provided that "¥ 50 OVERFLOW = 1" with respect to the coin being presently processed, a setting is provided with respect to the coin being presently processed that "¥ 50 OVERFLOW = 0" (Step 509), and this true ¥ 50 coin processing ends.

True ¥ 100 Coin Processing

In FIGS. 27(*a*) to 27(*c*), a determination is first made as to whether or not a setting has been provided that "¥ 100 OVERFLOW = 1," i.e., whether or not the ¥ 100 coin is to be subjected to overflow processing (Step 521). If "¥ 100 OVERFLOW = 1" does not hold true, the ¥ 100 solenoid SOL100 is turned on (Step 522), and the operation proceeds to Step 523 to start an unillustrated ¥ 100 solenoid timer. Meanwhile, if "¥ 100 OVERFLOW = 1" holds true, the operation directly proceeds to Step 523 to start the unillustrated ¥ 100 solenoid timer.

Subsequently, stop processing of the conveyance motor MO for driving the belt conveyance motor 14 is executed (Step 524), and a determination is made as to whether or not the ¥ 500 sensor SE500 is on (Step 525). If it is detected in Step 525 that the ¥ 500 sensor SE500 has been turned on before the time of the true/false coin solenoid timer is count up processing for counting the inserted coins is executed on the basis of the output of the ¥ 500 sensor SE500 (Step 531). This count up processing of the inserted coins is effected by using the output of determination by the sorting sensor SECO and the "on" output of the ¥ 500 sensor SE500.

Meanwhile, if the ¥ 500 sensor SE500 is not turned on even after the time of the true/false solenoid timer is up, the true/false coin solenoid SOLSF is turned off (Step 527). Then, if the time of the ¥ 100 solenoid timer is up (Step 528), the ¥ 100 solenoid SOL100 is turned off (Step 529), stop processing of the conveyance motor MO is executed (Step 530), and this flow of true ¥ 100 coin processing ends.

If count up processing ends in Step 531, the true/false coin solenoid SOLSF is turned off (Step 532). Then, the unillustrated ¥ 500 sensor blockage timer is started (Step 533), and stop processing of the conveyance motor MO is executed (Step 534). Then, the turning off of the ¥ 500 sensor SE500 is monitored (Step 535), and if the ¥ 500 sensor SE500 is turned off before the time of the ¥ 500 sensor blockage timer is up (Step 536), a setting is provided that attraction by the ¥ 500 solenoid SOL500 is allowed (Step 539).

Meanwhile, even if the time of the ¥ 500 sensor blockage timer is up, unless the ¥ 500 sensor SE500 is turned off (Step 536), it is assumed that the portion where the ¥ 500 sensor SE500 is disposed is blocked with a coin, so that the ¥ 100 solenoid SOL100 is turned off (Step 547). Subsequently, stop processing of the conveyance motor MO and sensor blockage processing are executed (Step 548).

If a setting is provided in Step 539 that the ¥ 500 solenoid is allowed to be turned on, stop processing of the conveyance motor MO is executed (Step 540), and the turning on of the ¥ 100 sensor SE100 is then monitored (Step 541). Here, if the ¥ 100 sensor SE100 is turned on before the time of the ¥ 100 solenoid timer is up (Step 542) , stop processing of the conveyance motor MO is executed (Step 543), and the turning off of the ¥ 100 sensor SE100 is monitored (Step 544), Here, if the ¥ 100 sensor SE100 is turned off before the time of the ¥ 100 solenoid timer is up (Step 545), a setting is provided that the ¥ 100 solenoid SOL100 is allowed to be turned on (Step 546).

It should be noted that even after the time of the ¥ 10 sensor blockage timer is up, if the ¥ 100 sensor SE100 is not turned on (Step 542), or if the ¥ 100 sensor SE100 is not turned off (Step 545), then it is assumed that the sensor portion is blocked with a coin, so that the ¥ 100 solenoid SOL100 is turned off (Step 547). Subsequently, stop processing of the conveyance motor MO and sensor blockage processing are executed (Step 548).

After providing a setting in Step 546 that the ¥ 100 solenoid SOL100 is allowed to be turned on, a determination is made as to whether or not a setting has been provided that "¥ 100 OVERFLOW = 1" with respect to the coin being presently processed (Step 549). If a setting has not been provided that "¥ 100 OVERFLOW = 1," after waiting for a predetermined time required for the passage of the coin (Step 550), a determination is made as to whether or not there is an ensuing coin of the same type of denomination, i.e., ¥ 100 (Step 551). Here, if there is an ensuring ¥ 100 coin, a determination is made as to whether or not the ¥ 100 solenoid SOL100 has been attracted by the ensuing ¥100 coin (Step 553). Then, if there is no ensuing ¥100 coin, or in a case where the ¥100 solenoid SOL100 has not been turned on by the ¥100 coin despite the presence of the ensuing ¥100 coin, the ¥100 solenoid SOL100 is kept turned off (Step 552). Meanwhile, if the ¥100 solenoid SOL100 has been turned on by the ensuing ¥100 coin, this true ¥100 coin processing is ended without turning off the ¥100 solenoid SOL100.

If it is determined in Step 549 that a setting has been provided that "¥100 OVERFLOW=1" with respect to the coin being presently processed, the unillustrated overflow timer is started (Step 554), and a setting is provided with respect to the coin being presently processed that "¥100 OVERFLOW=0" (Step 50), stop processing of the conveyance motor MO is executed (Step 556), and the turning on of the ¥10 sensor SE10 is monitored (Step 557). Here, if the ¥10 sensor SE10 is turned on before the time of the overflow timer is up (Step 558), stop processing of the conveyance motor MO is executed (Step 559), and the turning off of the ¥10 sensor SE10 is monitored (Step 560). Here, if the ¥10 sensor SE10 is turned off before the time of the overflow timer is up (Step 561), a setting is provided that the ¥10 solenoid SOL10 is allowed to be turned on (Step 562).

Next, stop processing of the conveyance motor MO is executed (Step 563), and the turning on of the ¥50 sensor SE50 is monitored (Step 564). Here, if the ¥50 sensor SE50 is turned on before the time of the overflow timer is up (Step 565), stop processing of the conveyance motor MO is executed (Step 566), and the turning off of the ¥50 sensor SE50 is monitored (Step 567). Here, if the ¥50 sensor SE50 is turned off before the time of the overflow timer is up (Step 568), a setting is provided that the ¥50 solenoid SOL50 is allowed to be turned on (Step 569), and this true ¥100 coin processing ends.

It should be noted that even after the time of the overflow timer is up, if the ¥10 sensor SE10 is not turned on (Step 558), if the ¥10 sensor SE10 is not turned off (Step 561), if the ¥50 sensor SE50 is not turned on (Step 565), or if the ¥50 sensor SE50 is not turned off (Step 568), then it is assumed that the sensor portion is blocked with a coin, so that stop processing of the conveyance motor MO and sensor blockage processing are executed (Step 548).

True ¥500 Coin Processing

In FIGS. 28(*a*) to 28(*c*), a determination is first made as to whether or not a setting has been provided that "¥500 OVERFLOW=1," i.e., whether or not the ¥500 coin is to be subjected to overflow processing (Step 571). If "¥500 OVERFLOW=1" does not hold true, the ¥500 solenoid SOL500 is turned on (Step 572), and the operation proceeds to Step 573 to start an unillustrated ¥500 solenoid timer. Meanwhile, if "¥500 OVERFLOW=1" holds true, the operation directly proceeds to Step 573 to start the unillustrated ¥500 solenoid timer.

Subsequently, stop processing of the conveyance motor MO for driving the belt conveyance motor 14 is executed (Step 574), and a determination is made as to whether or not the ¥500 sensor SE500 is on (Step 575). If it is detected in Step 575 that the ¥500 sensor SE500 has been turned on before the time of the true/false coin solenoid timer is up, count up processing for counting the inserted coins is executed on the basis of the output of the ¥500 sensor SE500 (Step 581). This count up processing of the inserted coins is effected by using the output of determination by the sorting sensor SECO and the "on" output of the ¥500 sensor SE500.

Meanwhile, if the ¥500 sensor SE500 is not turned on even after the time of the true/false solenoid timer is up, the true/false coin solenoid SOLSF is turned off (Step 577). Then, if the time of the ¥500 solenoid timer is up (Step 578), the ¥500 solenoid SOL500 is turned off (Step 579), stop processing of the conveyance motor MO is executed (Step 580), and this flow of true ¥500 coin processing ends.

If count up processing ends in Step 581, the true/false coin solenoid SOLSF is turned off (Step 582). Then, the unillustrated ¥500 sensor blockage timer is started (Step 583), and stop processing of the conveyance motor MO is executed (Step 584). Then, the turning off of the ¥500 sensor SE500 is monitored (Step 585), and if the ¥500 sensor SE500 is turned off before the time of the ¥500 sensor blockage timer is up (Step 586), a setting is provided that the ¥500 solenoid SOL500 is allowed to be turned on (Step 587).

Meanwhile, even if the time of the ¥500 sensor blockage timer is up, unless the ¥500 sensor SE500 is turned off (Step 586), it is assumed that the portion where the ¥500 sensor SE500 is disposed is blocked with a coin, so that the ¥500 solenoid SOL500 is turned off (Step 588). Subsequently, stop processing of the conveyance motor MO and sensor blockage processing are executed (Step 589).

After providing a setting in Step 587 that the ¥500 solenoid SOL500 is allowed to be turned on, a determination is made as to whether or not a setting has been provided that "¥500 OVERFLOW=1" with respect to the coin being presently processed (Step 590). If a setting has not been provided that "¥500 OVERFLOW=1," after waiting for a predetermined time required for the passage of the coin (Step 616), a determination is made as to whether or not there is an ensuing coin of the same type of denomination, i.e., ¥500 (Step 617). Here, if there is an ensuing ¥500 coin, a determination is made as to whether or not the ¥500 solenoid SOL500 has been turned on by the ensuing ¥500 coin (Step 618). Then, if there is no ensuing ¥500 coin, or in a case where the ¥500 solenoid SOL500 has not been turned on by the ensuing 610 500 coin despite the presence of the ensuing ¥500 coin, the ¥500 solenoid SOL500 is kept turned off (Step 619). Meanwhile, if the ¥500 solenoid SOL500 has been turned on by the ensuing ¥500 coin, this true ¥500 coin processing is ended without turning off the ¥500 solenoid SOL500.

If it is determined in Step 590 that a setting has been provided that "¥500 OVERFLOW=1" with respect to the coin being presently processed, the unillustrated overflow timer is started (Step 591), and a setting is provided with respect to the coin being presently processed that "¥500 OVERFLOW=0" (Step 592), stop processing of the conveyance motor MO is executed (Step 593), and the turning on of the ¥100 sensor SE100 is monitored (Step 594). Here, if the ¥100 sensor SE100 is turned on before the time of the overflow timer is up (Step 595), stop processing of the conveyance motor MO is executed (Step 596), and the turning off of the ¥100 sensor SE100 is monitored (Step 597). Here, if the ¥100 sensor SE100 is turned off before the time of the overflow timer is up (Step 598), a setting is provided that the ¥100 solenoid SOL100 is allowed to be turned on (Step 599).

Next, stop processing of the conveyance motor MO is executed (Step 600), and the turning on of the ¥ 10 sensor SE10 is monitored (Step 601). Here, if the ¥ 10 sensor SE10 is turned on before the time of the overflow timer is up (Step 602), stop processing of the conveyance motor MO is executed (Step 604), and the turning off of the ¥ 10 sensor SE10 is monitored (Step 605). Here, if the ¥ 10 sensor SE10 is turned off before the time of the overflow timer is up (Step 606), a setting is provided that the ¥ 10 solenoid SOL10 is allowed to be turned on (Step 607).

Next, stop processing of the conveyance motor MO is executed (Step 608), and the turning on of the ¥ 50 sensor SE50 is monitored (Step 609). Here, if the ¥ 50 sensor SE50 is turned on before the time of the overflow timer is up (Step 610), stop processing of the conveyance motor MO is executed (Step 611), and the turning off the ¥ 50 sensor SE50 is monitored (Step 612). Here, if the ¥ 50 sensor SE50 is turned off before the time of the overflow timer is up (Step 613), a setting is provided that the ¥ 50 solenoid SOL50 is allowed to be turned on (Step 614), and this true ¥ 500 coin processing ends.

It should be noted that even after the time of the overflow timer is up, if the ¥ 100 sensor SE100 is not turned on (Step 595), if the ¥ 100 sensor SE100 is not turned off (Step 598), if the ¥ 10 sensor SE10 is not turned on (Step 602), if the ¥ 10 sensor SE10 is not turned off (Step 606), if the ¥ 50 sensor SE50 is not turned on (Step 610), or if the ¥ 50 sensor SE50 is not turned off (Step 613), then it is assumed that the sensor portion is blocked with a coin, so that stop processing of the conveyance motor MO and sensor blockage processing are executed (Step 589).

Coin Blockage Correction Processing

Figure 29:
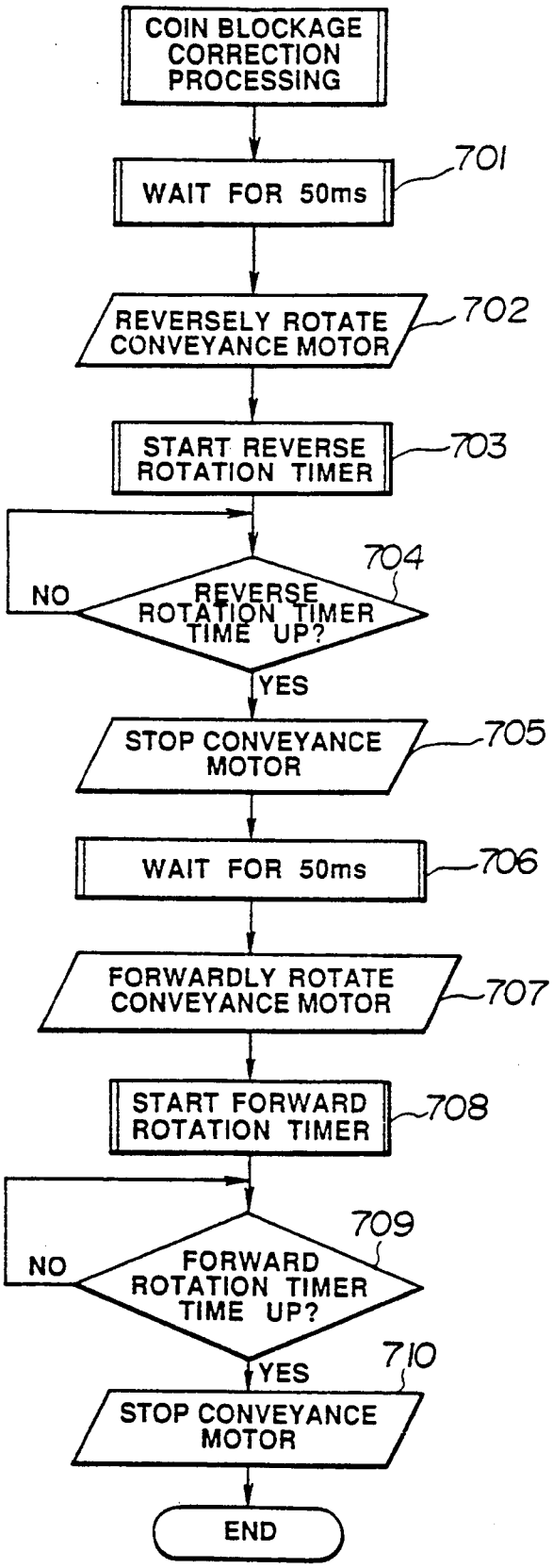
FIG. 29 is a flowchart illustrating the details of coin blockage correction processing in the coin sorting processing shown in FIG. 18.

In this embodiment, the arrangement provided is such that coins are introduced by means of belt conveyance. Accordingly, in this embodiment, a method based on the control of the conveyance motor MO is adopted as a measure against the coin blockage in the belt conveying passage 14. That is, as shown in FIG. 29, in the coin blockage correction processing of this embodiment, after first waiting for a fixed duration (50 ms in the flow chart), the conveyance motor MO is reversely rotated (Step 701), and an unillustrated reverse rotation timer is started (Step 703). Then, when the time of the reverse rotation timer is up (Step 704), the conveyance motor MO is stopped (Step 705). Then, after waiting for a fixed duration (50 ms in the flowchart) (Step 706), the conveyance motor MO is rotated forwardly (Step 707), and an unillustrated forward rotation timer is started (Step 708). When the time of the forward rotation timer is up (Step 709), the conveyance motor MO is stopped (Step 710), and this coin blockage correction processing ends.

It should be noted that although in this embodiment the number of revolutions in reverse and forward rotation is one, if the reverse and forward rotation is repeated, the coin blockage can be corrected more positively.

Coin Paying-Out Processing

The details of coin paying-out processing are shown in FIG. 30. In this embodiment, an arrangement is provided to allow four modes to be selectively used in paying out change. The selection of the modes is effected by the mode selection switch SWMO shown in FIG. 12.

Among the four modes selected by the mode selection switch SWMO, mode 1 is designed to reduce the paying-out speed of change. In this mode 1, coins to be paid out as change are handled half and half by the main tubes (¥ 500 tube CT500, ¥ 100 tube CT100, ¥ 10 tube CT10, and ¥ 50 tube CT50) and the sub tubes (auxiliary tube CTD and auxiliary tube CTE), respectively, and are paid out simultaneously from both the main tubes and the sub tubes. For instance, in cases where four ¥ 100 coins and four ¥ 10 coins are to be paid out as change, if a case is considered in which the auxiliary tube CTD has been set for ¥ 10 and the auxiliary tube CTE has been set for ¥ 100, two ¥ 100 coins and two ¥ 100 coins are respectively paid out simultaneously from the ¥ 100 tube CT100 and the auxiliary tube CTE, and two ¥ 10 coins and two ¥ 10 coins are respectively paid out simultaneously from the ¥ 10 tube CT10 and the auxiliary tube CTD. It should be noted that if the main tubes become empty, coins are paid out preferentially from the sub tubes.

Mode 2 is used for preferentially paying out deposited coins. In this mode 2, change is paid out only from the main tubes until the main tubes become empty, and change is paid out from the sub tubes when the main tubes become empty.

In mode 3, the paying out of change is carried out on the basis of mode 1, but in a case where coins have been manually replenished to the main tubes in the standby state, change is paid out from the main tubes up to a predetermined number of coins, and change is subsequently paid out in accordance with mode 1.

In addition, in mode 4, although the paying out of change is basically carried out on the basis of mode 2, in a case where coins have been manually replenished to the main tubes in the standby state, change is paid out from the main tubes up to a predetermined number of coins, and change is subsequently paid out in accordance with mode 2.

In coin paying-out processing shown in FIG. 30, a determination is first made as to whether or not coins are to be paid out on the basis of the operation of an inventory switch (Step 801). If coins are not to be paid out on the basis of the operation of the inventory switch, a determination is then made as to whether or not the mode selected by the mode selection switch SWMO is mode 1 (Step 804). Here, in the case of mode 1, the paying out of coins in accordance with the specifications of mode 1 is carried out (Step 805), and the paying out of change in accordance with mode 1 is repeated until the paying out of change is completed (Step 806).

If the mode selected by the mode selection switch SWMO is not mode 1, a determination is then made as to whether or not the mode selected by the mode selection switch SWMO is mode 2 (Step 812). Here, in the case of mode 2, the paying out of change in accordance with the specifications of mode 2 is carried out (Step 813), and the paying out of change in accordance with mode 2 is repeated until the paying out of change is completed (Step 814).

If the mode selected by the mode selection switch SWMO is not mode 2, a determination is then made as to whether or not the mode selected by the mode selection switch SWMO is mode 3 (Step 815). Here, in the case of mode 3, the paying out of change in accordance with the specifications of mode 3 is carried out (Step 816), and the paying out of change in accordance with mode 3 is repeated until the paying out change is completed (Step 817).

If the mode selected by the mode selection switch SWMO is not mode 3, it is assumed that mode 4 has been selected, and the paying out of change in accordance with the specifications of mode 4 is carried out (Step 818), and the paying out of change in accordance with mode 4 is repeated until the paying out of change is completed (Step 819).

Meanwhile, if it is determined in Step 801 that the case is the paying out of coins on the basis of the operation of the inventory switch, the paying out of coins corresponding to the inventory switch turned on is effected (Step 821), and when inventory stop is inputted by the pressing of any of the inventory switches (Step 822), the paying out of inventory coins ends.

FIGS. 31 to 34 illustrate an example of configuration in a case where the coin processing apparatus of this embodiment is actually mounted in an automatic vending machine.

Figure 31:
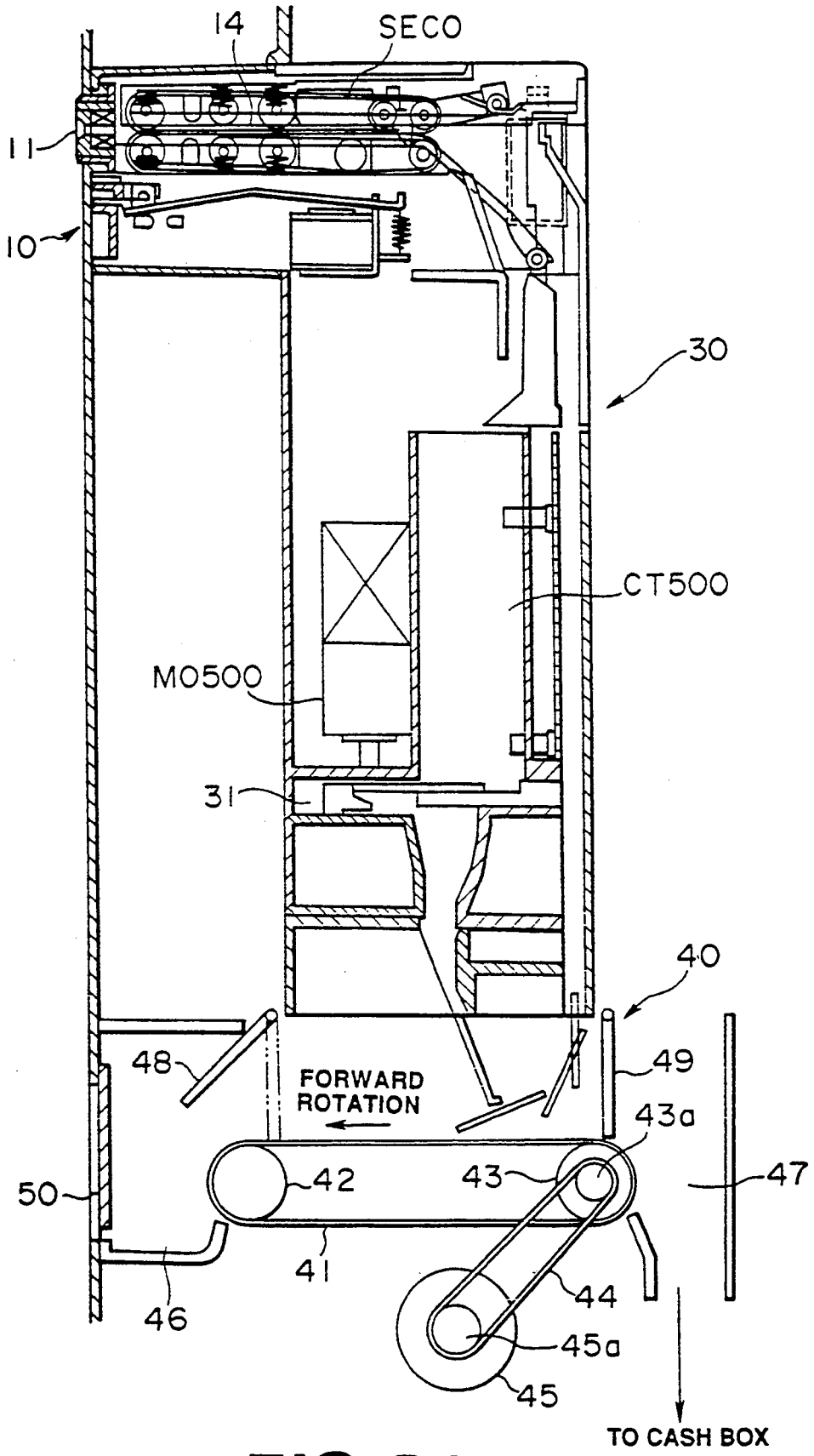
FIG. 31 is a diagram illustrating an example of configuration of a case in which the coin processing apparatus of this embodiment is incorporated in an automatic vending machine.

The example shown in FIG. 31 is configured such that a coin delivery section 40 is added to the coin processing apparatus comprising the coin receiving section 10 and the main body section 30.

As described earlier, the coin receiving section 10 includes the coin slot 11, the belt conveying passage 14 for horizontally conveying a coin inserted through the coin slot 11, and the sorting sensor SECO disposed along the belt conveying passage 14.

The main body section 30 includes the coin distributing section for distributing the inserted coin on the basis of the output of the sorting sensor SECO and the plurality of coin tubes CT500, CT100, CT10, and CT50 for accumulating coins to be used as change by types of denominations. Disposed at the lower end of the coin tube CT500 is a ¥500 coin paying-out mechanism 31 for paying out ¥500 coins accumulated in the coin tube CT500, and this ¥500 coin paying-out mechanism 31 is driven by a ¥500 coin paying-out motor MO500. In addition, the cassette tube coin paying-out mechanism 32 (FIG. 32) is disposed at the lower ends of the coin tubes CT100, CT10, and CT50. This cassette tube coin paying-out mechanism 32 is driven by a cassette tube coin paying-out motor MOCT.

The coin delivery section 40 based on belt conveyance is formed below the main body section 30. This coin delivery section 40 based on belt conveyance is adopted to reduce the vertical dimension of the coin processing apparatus from the ¥500 coin paying-out mechanism 31 and the cassette tube coin paying-out mechanism 32 to a coin return section 46.

A coin delivery belt 41 is disposed at a position where coins paid out by the ¥500 coin paying-out mechanism 31 and the cassette tube coin paying-out mechanism 32 are received. The coin delivery belt 41 is trained between a pair of rollers 42, 43, and is driven by a coin delivery motor 45 via a pulley 45*a* fitted on the rotating shaft of the coin delivery motor 45, a belt 44, and a pulley 43*a* fitted on the shaft of the roller 43, and the roller 43, in such a manner as to be capable of being changed over between forward rotation and reverse rotation.

As shown in FIG. 31, when the coin delivery belt 41 is rotated forwardly, the coin which dropped on the coin delivery belt 41 is led to the coin return section 46 via a gate 48. The coin in the coin return section 46 can be taken out by the user via a gate 50.

Figure 32:
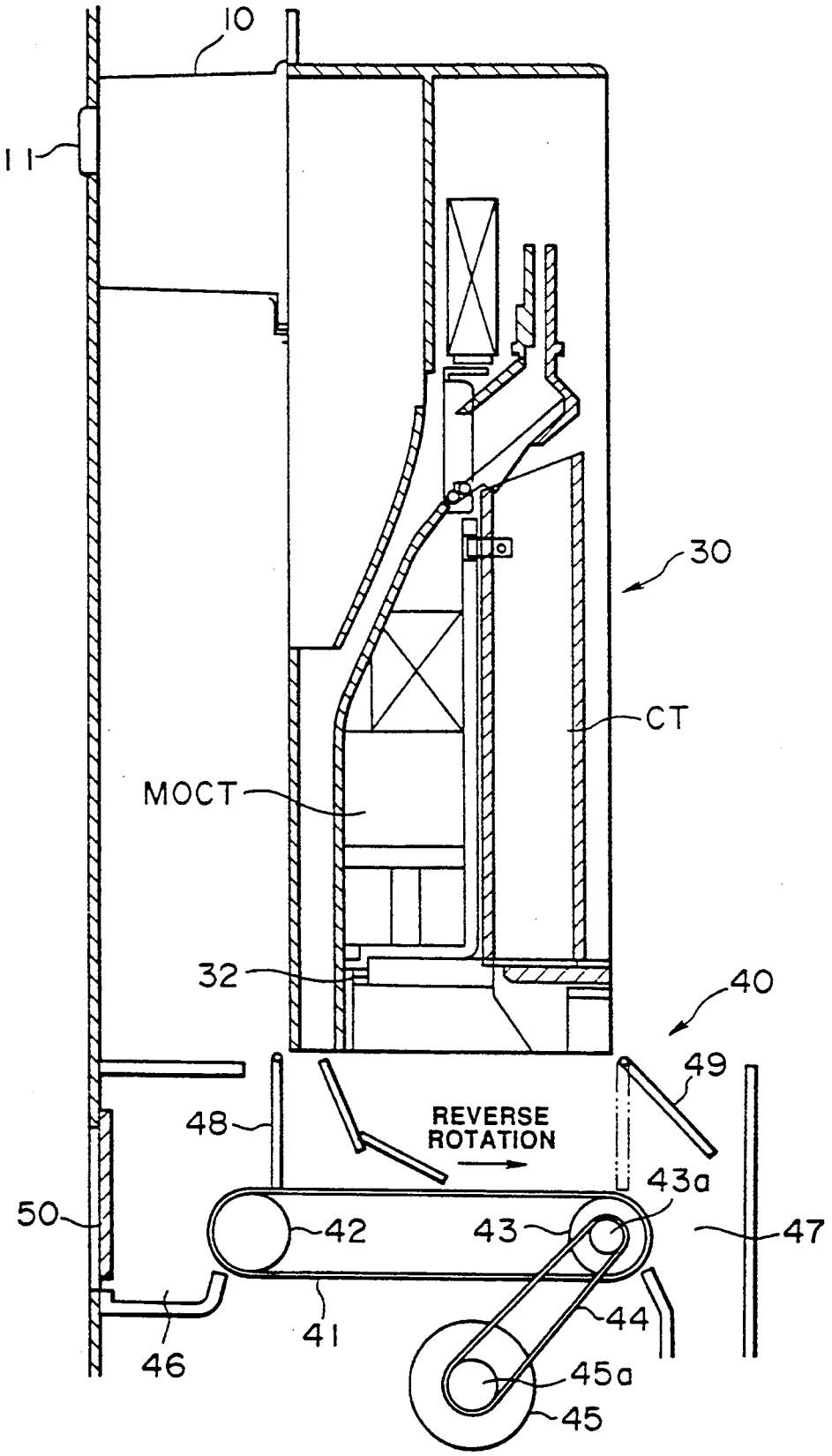
FIG. 32 is a diagram illustrating the operation of introducing the coin to be paid out to a cash box.

In addition, as shown in FIG. 32, when the coin delivery belt 41 is rotated reversely, the coin dropped on the coin delivery belt 41 is introduced to a coin passage 47 which leads to the cash box via a gate 49. Incidentally, as for the control of this coin delivery section 40, a detailed description will be given later with reference to the flow chart shown in FIG. 34.

Figure 33:
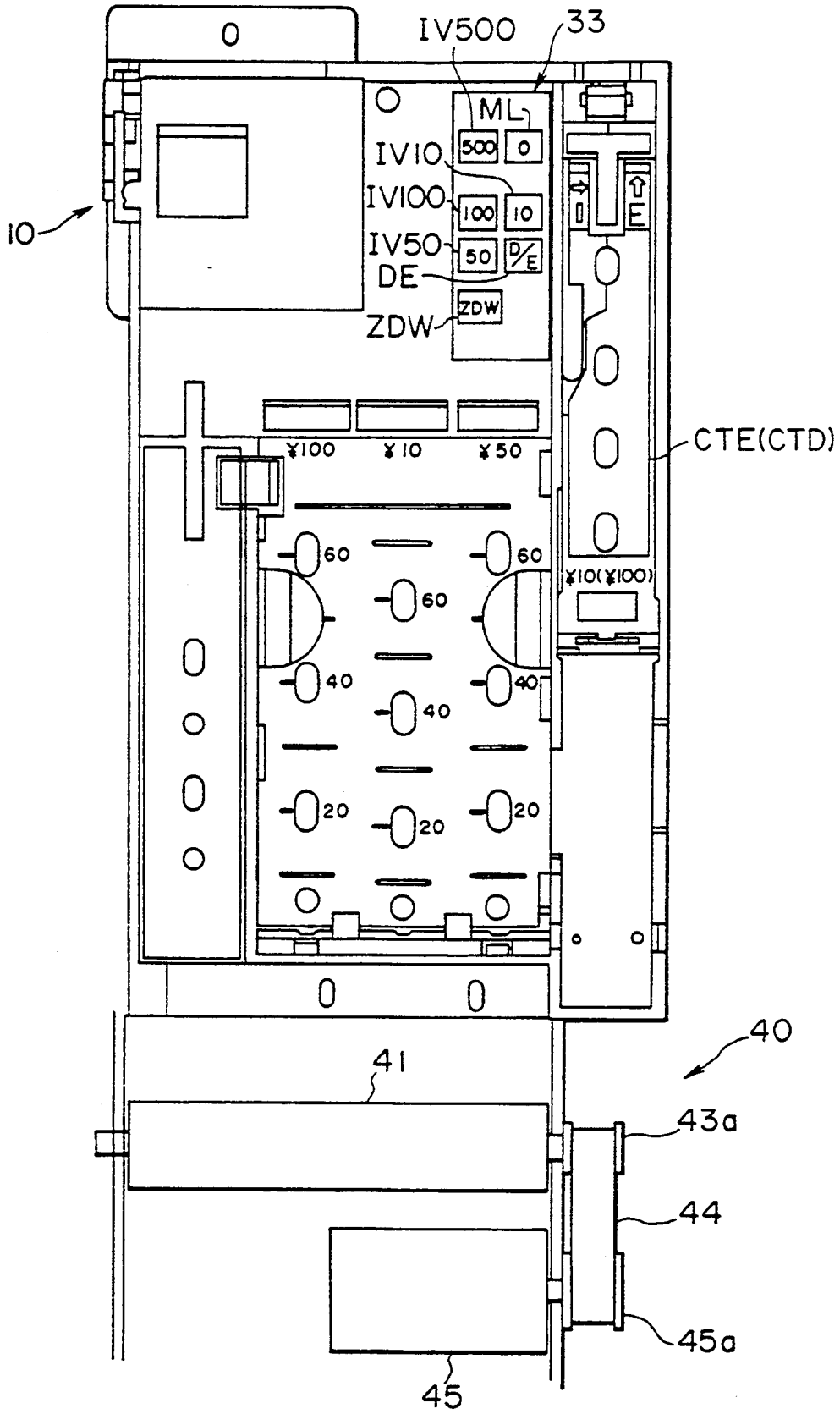
FIG. 33 is a rear view of the configuration shown in FIGS. 31 and 32.

In FIG. 33, the panel 33 is provided with inventory switches for forcedly paying out coins accumulated in the coin tubes. Specifically, the panel 33 is provided with the internal auxiliary unit inventory switch DE, external auxiliary unit inventory switch ZDW, ¥500 inventory switch IV500, ¥100 inventory switch IV100, ¥10 inventory switch IV10, ¥50 inventory switch IV50, and monitor lamp ML for displaying the state of inventory.

Figure 34:
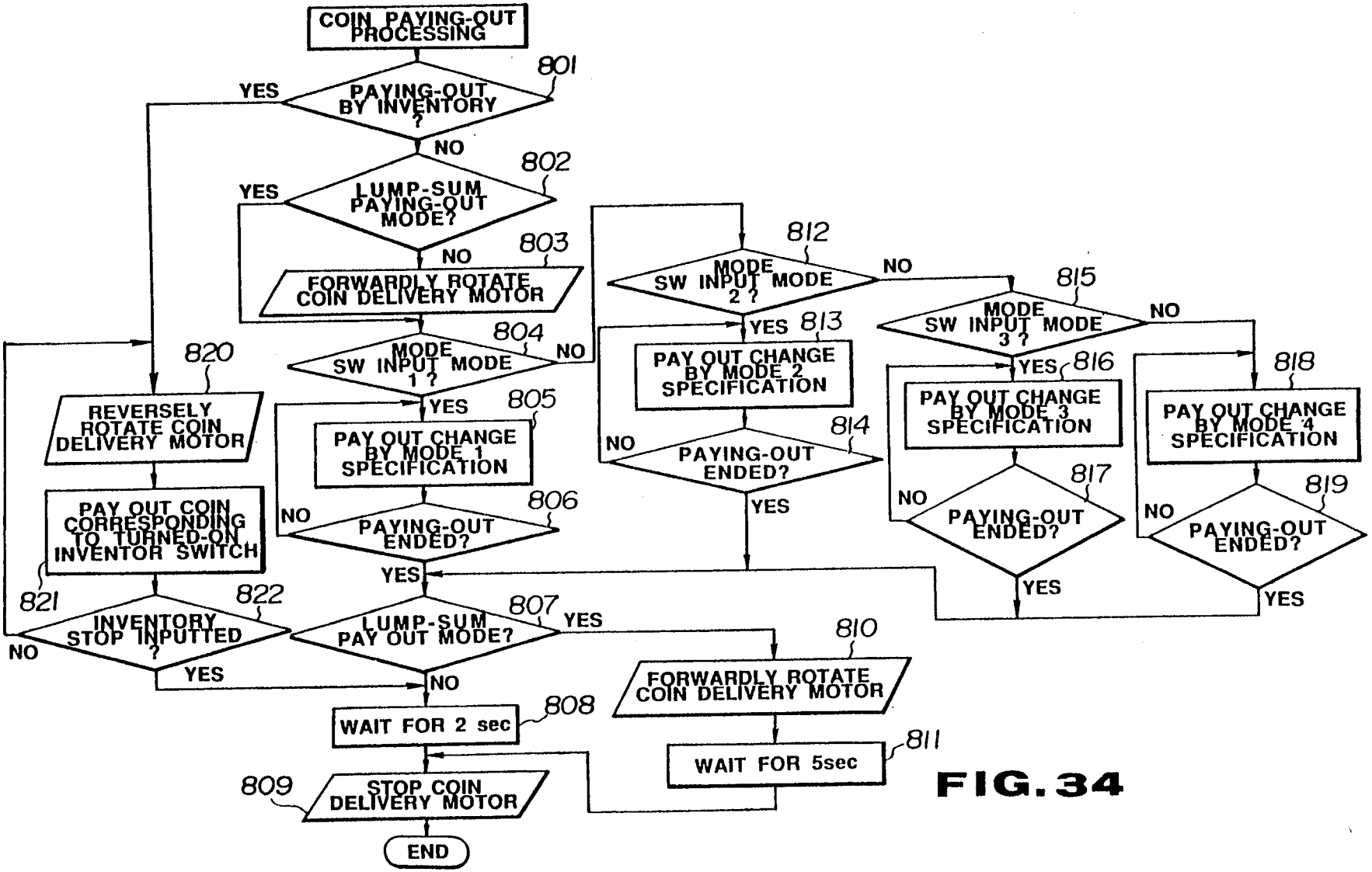
FIG. 34 is a flowchart illustrating the details of coin paying-out processing in a case where the configuration of the embodiment is adopted.

The details of coin paying-out processing in this example of configuration are shown in FIG. 34. In this example of configuration as well, an arrangement is provided to allow four modes to be selectively used in paying out change in the same way as coin paying-out processing shown in FIG. 30.

That is, in FIG. 34, the operation described in Steps 801, 804–806, 812–819, 821, and 822 is the same as that shown in FIG. 30.

That is, in the coin paying-out processing shown in FIG. 34, a determination is first made as to whether or not coins are to be paid out on the basis of the operation of an inventory switch (Step 801). If coins are not to be paid out on the basis of the operation of the inventory switch, a determination is then made as to whether or not the mode is a lump-sum paying-out mode (Step 802). The lump-sum paying-out mode referred to herein means a mode in which after coins to be paid out are allowed to drop on the coin delivery belt 41 (FIG. 31), the coin delivery belt 41 is rotated forwardly so as to pay out the coins on the coin delivery belt 41 in a lump.

When it is determined in Step 802 that the mode is the lump-sum paying-out mode, the operation proceeds to Step 804 without forwardly rotating the coin delivery motor 45 (FIG. 31). Meanwhile, if it is determined in Step 802 that the mode is not the lump-sum paying-out mode, the coin delivery motor 45 is rotated forwardly (Step 803), and the operation proceeds to Step 804.

In Step 804, a determination is made as to whether or not the mode selected by the mode selection switch SWMO is mode 1. Here, in the case of mode 1, the paying out of coins in accordance with the specifications of mode 1 is carried out (Step 805), and the paying out of change in accordance with mode 1 is repeated until the paying out of change is completed (Step 806).

If the mode selected by the mode selection switch SWMO is not mode 1, a determination is then made as to whether or not the mode selected by the mode selection switch SWMO is mode 2 (Step 812). Here, in the case of mode 2, the paying out of change in accordance with the specifications of mode 2 is carried out (Step 813), and the paying out of change in accordance with mode 2 is repeated until the paying out of change is completed (Step 814).

If the mode selected by the mode selection switch SWMO is not mode 2, a determination is then made as to whether or not the mode selected by the mode selection switch SWMO is mode 3 (Step 815). Here, in the case of mode 3, the paying out of change in accordance with the specifications of mode 3 is carried out (Step 816), and the paying out of change in accordance with mode 3 is repeated until the paying out of change is completed (Step 817).

If the mode selected by the mode selection switch SWMO is not mode 3, it is assumed that mode 4 has been selected, and the paying out of change in accordance with the specifications of mode 4 is carried out (Step 818), and the paying out of change in accordance with mode 4 is repeated until the paying out of change is completed (Step 819).

Then, a determination is made again as to whether or not the mode is the lump-sum paying-out mode (Step 807). Here, if the mode is the lump-sum paying-out mode, the coin delivery motor 45 is rotated forwardly, and the coins on the coin delivery belt 41 are paid out to the coin return section 46 in a lump (Step 810). Subsequently, after the lapse of a fixed duration (Step 811), the coin delivery motor 45 is stopped (Step 809).

It should be noted that if it is determined in Step 807 that the mode is not the lump-sum paying-out mode, after the lapse of a fixed duration (Step 808), the coin delivery motor 45 is stopped (Step 809).

Meanwhile, if it is determined in Step 801 that the case is the paying out of coins on the basis of the operation of the inventory switch, the coin delivery motor 45 is rotated reversely (Step 820), and the paying out of coins corresponding to the inventory switch turned on is effected (Step 821). Then, when inventory stop is input ted by the pressing of any of the inventory switches (Step 822), after the lapse of a fixed duration (Step 808), the coin delivery motor 45 is stopped (Step 809).

In accordance with the above-described arrangement, since the discrimination of coins is effected while the coins inserted through the coin slot are being conveyed substantially horizontally, and the coins are conveyed substantially horizontally in the coin delivery section, the vertical dimension of the coin processing apparatus can be reduced. As a result, in cases where the coin processing apparatus is applied to an automatic vending machine or the like, it is possible to reduce the distance between the coin slot and the coin return port, so that the user of the automatic vending machine or the like need not bend down to receive change.

What is claimed is:

1. A coin processing apparatus comprising:

coin conveying means for horizontally conveying coins inserted through a coin slot at a predetermined speed along a coin conveying passage;

coin discriminating means disposed along said coin conveying passage or determining the denomination of the coin being conveyed by said coin conveying means along said coin conveying passage and emitting a corresponding denomination identification output;

a plurality of coin accumulating means providing for each denomination of coin, for accumulating the coins by denominations;

said coin accumulating means being arranged in a direction perpendicular to a direction of conveyance of said coins in said coin conveying passage, distributing means for distributing the coins passed through said coin conveying passage to one of said plurality of coin accumulating means in correspondence with said denomination identification output of said coin discriminating means, said distributing means including:

an inclined coin passage through which the coin passing through said coin conveying passage rolls down;

a plurality of coin distributing means each disposed along said inclined coin passage and in correspondence with said plurality of coin accumulating means and adapted to selectively execute a first distributing operation for passing a coin rolling through said inclined coin passage and a second distributing operation for directing the coin from said inclined coin passage to a corresponding one of said coin distributing means; and coin paying-out means for conveying the coins in a substantially horizontal direction from the coins accumulated in said plurality of coin accumulating means, to a coin return means.

2. A coin processing apparatus according to claim 1, further comprising:

means for detecting whether a previously distributed coin is of the same type of denomination as a coin being presently distributed; and means for returning a coin as a false coin if the previously distributed coin is of a different type of denomination from the coin being presently distributed, and if the first distributing operation of any one of said coin distributing sections leading to the coin distributing means corresponding to the discriminated type of denomination has been set in a prohibited state.

3. A coin processing apparatus according to claim 2, further comprising:

means for processing the coin as a true coin if the previously distributed coin is of the same type of denomination as the coin being presently distributed, and even if the first distributing operation of any one of said coin distributing sections leading to the coin distributing means corresponding to the discriminated type of denomination has been set in a prohibited state.

4. A coin processing apparatus according to claim 1, further comprising:

coin delivery means for conveying the coin paid out from said coin paying-out means in the substantially horizontal direction and delivering the coin to a coin return section.

5. A coin processing apparatus according to claim 4, wherein said coin delivery means comprises a second belt conveying means for conveying the coin paid out from said coin paying-out means by means of a belt.

6. A coin processing apparatus according to claim 5, wherein said second belt conveying means, when rotated forwardly, delivers the coin on said belt to said coin return section and, when rotated reversely, delivers the coin on said belt to a cash box.

7. A coin processing apparatus according to claim 1, further comprising:

coin paying-out mode designating means for designating a coin paying-out mode, wherein said coin accumulating means are provided with main tubes and sub tubes with respect to the same types of denominations, and wherein said coin paying-out means selectively executes a first coin paying-out mode in which coins to be paid out as change are handled half and half by said main tubes and said sub tubes, respectively, in correspondence with the designation by said coin paying-out mode designating means and are paid out simultaneously from both said main tubes and said sub tubes, and a second coin paying-out mode in which change is paid out only from said main tubes until said main tubes become empty, and change is paid out from said sub tubes when said main tubes become empty.

8. A coin processing apparatus according to claim 1, further comprising:

coin paying-out mode designating means for designating a coin paying-out mode, wherein said coin accumulating sections are provided with main tubes and sub tubes with respect to the same types of denominations, and wherein said coin paying-out means selectively executes a first coin paying-out mode in which coins to be paid out as change are handled half and half by said maim tubes and said sub tubes, respectively, in correspondence with the designation by said coin paying-out mode designating means and are paid out simultaneously from both said main tubes and said sub tubes, a second coin paying-out mode in which change is paid out only from said main tubes until said main tubes become empty, and change is paid out from said sub tubes when said main tubes become empty, a third coin paying-out mode in which, in a case where the coins are manually replenished to said main tubes during standby, change is paid out preferentially from said main tubes up to a predetermined number of the coins, and change is subsequently paid out in accordance with the first coin paying-out mode, and a fourth coin paying-out mode in which, in a case where the coins are manually replenished to said main tubes during standby, change is paid out preferentially from said main tubes up to a predetermined number of the coins, and change is subsequently paid out in accordance with the second coin paying-out mode.

9. A coin processing apparatus according to claim 1, further comprising:

a plurality of inventory switches disposed in correspondence with said plurality of coin accumulating sections and adapted to designate the collection of accumulated coins in said coin accumulating sections; and discrimination accuracy changeover control means which, after a specific inventory switch among said plurality of inventory switches is turned on, shifts the mode to a shifted accuracy changeover control mode upon turning on of a power source, and changes over the discrimination accuracy of the coins in said coin discriminating means by the operation of said plurality of inventory switches in this accuracy changeover control mode.

10. A coin processing apparatus according to claim 9, wherein the discrimination accuracy of the coins changed over by said discrimination accuracy changeover means includes first accuracy, second accuracy, and third accuracy, wherein the first accuracy is normal coin-acceptance accuracy;

the second accuracy is coin-acceptance accuracy in which the restriction of coin acceptance is made stricter than that of the normal coin-acceptance accuracy; and the third accuracy is accuracy for prohibiting the acceptance of the coin.

11. A coin processing apparatus according to claim 9, wherein said plurality of inventory switches comprise:

a first inventory switch corresponding to an internal auxiliary unit for accumulating coins for change;

a second inventory switch corresponding to an external inventory unit for accumulating the coins for change; and a plurality of third inventory switches corresponding to the respective types of denominations of the coins for change, wherein said specific inventory switch operated before the turning on of the power source for effecting a shift to the accuracy changeover control mode is one of said first and second inventory switches.

12. A coin processing apparatus according to claim 10, wherein said discrimination accuracy changeover control means effects a shift to the first accuracy, second accuracy, or third accuracy changeover control mode through the operation of said specific inventory switch.

13. A coin processing apparatus according to claim 11, wherein said discrimination accuracy changeover control means changes over the discrimination accuracy of the coins by the types of denominations through the operation of said third inventory switches.

14. A coin processing apparatus according to claim 9, further comprising:

means for exiting from the accuracy changeover control mode upon the pressing of a return switch for designating the return of the coin or upon the detection of the coin inserted through said coin slot.

15. A coin processing apparatus according to claim 14, further comprising:

inlet sensor means disposed at said coin slot and adapted to selectively sense a usable coin; and shutter means actuated on the basis of an output from said inlet sensor means so as to open said coin slot.

16. A coin processing apparatus according to claim 15, wherein said inlet sensor means includes a coil whose inductance changes when the coin is inserted.

17. A coin processing apparatus according to claim 15, wherein said shutter means comprises:

a shutter solenoid energized by said output of said inlet sensor means; and a shutter for closing said coin slot when said shutter solenoid is de-energized, and for opening said coin slot when said shutter solenoid is energized.

18. A coin processing apparatus according to claim 1, wherein said coin distributing sections comprise:

L-shaped levers arranged along a coin passage, and which in a projecting state constitute a bottom portion of the inclined coin passage and allow the coin to roll through said inclined coin passage and in a withdrawn state said levers block the inclined coin passage and open the bottom portion of the inclined coin passage; and solenoids for driving said L-shaped levers.

19. A coin processing apparatus according to claim 18, wherein said solenoids are adapted to drive said L-shaped levers to the withdrawn state by being energized, and reset said L-shaped levers to the projecting state by being de-energized.

20. A coin processing apparatus according to claim 1, wherein each of said coin distributing means comprises:

coin sensors disposed in correspondence with said coin distributing sections and adapted to detect the coin passing therethrough;

a timer for setting expected passing times of the coin passing through each of said coin distributing means, respectively; and control means, in response to the discrimination by said coin discriminating means, for setting a prohibited state of the second distributing operation of all of coin distributing means disposed upstream of one of the coin distributing section corresponding to the discriminated denomination coin and sequentially canceling the prohibited state of the second distributing operation of said coin distributing means if the coin has passed through each of the coin distributing means within said expected passing times set in said timer.

21. A coin processing apparatus according to claim 20, further comprising:

coin blockage detecting means for detecting coin blockage on an assumption that the coin blockage has occurred if the coin did not pass through the coin distributing means within the preset time.

22. A coin processing apparatus according to claim 1, wherein said plurality of coin accumulating means comprise:

a plurality of overflow sensors for detecting that amount of coins held in any one of said coin accumulating means exceeds a predetermined number of coins, and generating a corresponding overflow output, and wherein said distributing means comprises:

means for introducing to a cash box the coins from said coin accumulating means on the basis of said overflow output.

23. A coin processing apparatus according to claim 22, wherein said overflow sensors are constituted by photosensors respectively disposed at predetermined positions in said coin tubes and adapted to optically detect the coins in said coin tubes.

24. A coin processing apparatus according to claim 22, wherein each of said photosensors comprises a light-emitting element and a light-receiving element for receiving light emitted from said light-emitting element, and detects the coin on the basis of an output of said light-receiving element when an optical path leading from said light-emitting element to said light-receiving element is shielded by the coin in the coin tube wherein the optical path leading from said light-emitting element to said light-receiving element is inclined with respect to the plane of the coin in said coin tube at least by the thickness of one coin in said coin tube.

25. A coin processing apparatus according to claim 1, further comprising:

inlet sensor means disposed at said coin slot and adapted to selectively sense a genuine coin.

26. A coin processing apparatus according to claim 25, wherein said inlet sensor includes a coil whose inductance changes when the coin is inserted.

27. A coin processing apparatus according to claim 1, further comprising:

gate sensor means disposed on an inner side of said coin slot by being spaced apart from said coin slot at least by a distance greater than the diameter of the coin having a maximum diameter among the coins; and means for starting said coin discriminating means when the inserted coin has been detected by said sensor means.

28. A coin processing apparatus according to claim 1, further comprising:

inlet sensor means disposed at said coin slot and adapted to selectively sense a genuine coin;

gate sensor means disposed on an inner side of said coin slot by being spaced apart from said coin slot at least by a distance greater than a diameter of the coin having a maximum diameter among the genuine coins; and means for starting said coin discriminating means when the inserted coin has been detected by said inlet sensor means and detected by said gate sensor means.

29. A coin processing apparatus according to claim 28, wherein said inlet sensor means is turned on at the time of detection of the coin, and is turned off at the time of nondetection thereof, and said coin processing means starts the processing of the inserted coin on condition that the inserted coin has been detected by said gate sensor means after said inlet sensor means has been turned on and off.

30. A coin processing apparatus according to claim 1, further comprising:

inlet sensor means disposed at said coin slot and adapted to selectively sense a genuine coin;

shutter means actuated on the basis of an output of detection by said inlet sensor means so as to open said coin slot;

gate sensor means disposed on an inner side of said coin slot by being spaced apart from said coin slot at least by a distance greater than the diameter of the coin having a maximum diameter among the genuine coins; and means for starting said coin discriminating means when the inserted coin has been detected by said sensor means and detected by said gate sensor means.

31. A coin processing apparatus according to claim 1, further comprising:

an inlet sensor disposed at said coin slot and adapted to be turned on through the insertion of a coin and to be turned off through the passage of the coin;

a shutter actuated on the basis of an output by said inlet sensor so as to open said coin slot;

first storage means for storing a first signal indicative of said inlet sensor being turned on;

a gate sensor disposed on an inner side of said coin slot by being spaced apart from said coin slot at least by a distance greater than the diameter of the coin having a maximum diameter among the coins, and adapted to be turned on upon detection of a passing coin;

second storage means for storing a second signal indicative of said gate sensor being turned on when the first signal is stored in said first storage means;

third storage means for storing a third signal indicative of the completion of discrimination of the coin by said coin discrimination means when the second signal is stored in said second storage means; and means for restarting discrimination processing by said coin discriminating means when the third signal is stored in said third storage means.

32. A coin processing apparatus according to claim 31, further comprising:

shutter abnormality detecting means for detecting shutter abnormality when said shutter fails to be actuated within a fixed duration after the turning on of said inlet sensor.

33. A coin processing apparatus according to claim 31, further comprising:

means for starting conveyance by said conveying means on the basis of the memory of said first storage means;

a first timer for starting counting for a fixed duration on the basis of the memory in said first storage means; and means for suspending conveyance by said conveying means and waits for the turning off of said inlet sensor, unless said inlet sensor is turned off before the time of said first timer is up.

34. A coin processing apparatus according to claim 31, further comprising:

pulse generating means for generating a pulse each time said conveying means moves the coin by a distance of a fixed unit;

pulse counting means for starting the counting of pulses generated from said pulse generating means when memory is present in said second storage means; and means for suspending conveyance by said belt conveying means and executes correction processing of coin blockage, unless memory is stored in said third storage means before a count value of said pulse counting means reaches a predetermined value.

35. A coin processing apparatus according to claim 34, wherein said correction processing of coin blockage is effected by at least once repeating an operation in which said belt conveying means is driven for a fixed duration by reversing the direction of conveyance by said belt conveying means and conveyance by said belt conveying means is then suspended, and subsequently said belt conveying means is driven for a fixed duration by changing the direction of conveyance by said belt conveying means in a forward direction and conveyance by said belt conveying means is then suspended.

* * * * *